US010912701B2

(12) United States Patent
Wijesundara et al.

(10) Patent No.: US 10,912,701 B2
(45) Date of Patent: Feb. 9, 2021

(54) FLUID-DRIVEN ACTUATORS AND RELATED METHODS

(71) Applicant: Board of Regents, The University of Texas System, Austin, TX (US)

(72) Inventors: Muthu Wijesundara, Fort Worth, TX (US); Wei Carrigan, Arlington, TX (US); Mahdi Haghshenas Jaryani, Waxahachie, TX (US)

(73) Assignee: The Board of Regents of the University of Texas System, Austin, TX (US)

( * ) Notice: Subject to any disclaimer, the term of this patent is extended or adjusted under 35 U.S.C. 154(b) by 800 days.

(21) Appl. No.: 14/990,257

(22) Filed: Jan. 7, 2016

(65) Prior Publication Data

US 2018/0303698 A1 Oct. 25, 2018

Related U.S. Application Data

(60) Provisional application No. 62/100,652, filed on Jan. 7, 2015, provisional application No. 62/185,410, filed on Jun. 26, 2015.

(51) Int. Cl.
*A61H 1/02* (2006.01)
*F15B 18/00* (2006.01)
(Continued)

(52) U.S. Cl.
CPC ..... *A61H 1/0288* (2013.01); *F15B 15/08* (2013.01); *F15B 15/10* (2013.01); *F15B 18/00* (2013.01);
(Continued)

(58) Field of Classification Search
CPC ..... A61H 1/0288; A61H 2201/1238; A61H 2201/1409; A61H 2201/1638;
(Continued)

(56) References Cited

U.S. PATENT DOCUMENTS 3,283,799 A 11/1966 Barbera
3,538,628 A 11/1970 Einstein
(Continued)

FOREIGN PATENT DOCUMENTS

KR 2007/0090474 9/2007
WO WO/15/191007 12/2015

OTHER PUBLICATIONS

Aubin et al., "A pediatric robotic thumb exoskeleton for at-home rehabilitation : The isolated orthosis for thumb actuation (IOTA)"., International Journal of Intelligent Computing and Cybernetics 7(3), 2014.

(Continued)

*Primary Examiner* — Christopher D. Prone
*Assistant Examiner* — Tiffany P Shipmon
(74) *Attorney, Agent, or Firm* — Meunier Carlin & Curfman LLC

(57) ABSTRACT

This disclosure includes manipulating apparatuses and related methods. Some manipulating apparatuses include an actuator having a semi-rigid first segment, a semi-rigid second segment, and one or more flexible cells disposed between the first segment and the second segment, where the actuator is configured to be coupled to a fluid source such that the fluid source can communicate fluid to vary internal pressures of the one or more cells, and where each cell is configured such that adjustments of an internal pressure of the cell causes angular displacement of the second segment relative to the first segment.

19 Claims, 33 Drawing Sheets

(51) Int. Cl.
*F15B 15/08* (2006.01)
*F15B 15/10* (2006.01)

(52) U.S. Cl.
CPC ..... *A61H 2201/1238* (2013.01); *A61H 2201/1409* (2013.01); *A61H 2201/165* (2013.01); *A61H 2201/1638* (2013.01); *A61H 2201/1645* (2013.01); *A61H 2201/1676* (2013.01); *A61H 2201/501* (2013.01); *A61H 2201/5007* (2013.01); *A61H 2201/5038* (2013.01); *A61H 2201/5043* (2013.01); *A61H 2201/5051* (2013.01); *A61H 2201/5061* (2013.01); *A61H 2201/5069* (2013.01); *A61H 2201/5071* (2013.01); *A61H 2201/5079* (2013.01); *A61H 2201/5084* (2013.01); *F15B 2211/6309* (2013.01)

(58) Field of Classification Search
CPC ..... A61H 2201/1645; A61H 2201/165; A61H 2201/1676; A61H 2201/5007; A61H 2201/501; A61H 2201/5038; A61H 2201/5043; A61H 2201/5051; A61H 2201/5061; A61H 2201/5071; A61H 2201/5079; A61H 2201/5069; A61H 2201/5084; F15B 15/08; F15B 15/10; F15B 2211/6309; A61F 2/586; A61F 2005/0155
See application file for complete search history.

(56) References Cited

U.S. PATENT DOCUMENTS

| | | | | |
|---|---|---|---|---|
| 3,574,386 | A | 4/1971 | Frost | |
| 3,834,046 | A | 9/1974 | Fowler | |
| 5,156,629 | A | 10/1992 | Shane et al. | |
| 5,237,501 | A | 8/1993 | Gusakov | |
| 5,267,365 | A | 12/1993 | Walter | |
| 5,423,094 | A | 6/1995 | Arsenault et al. | |
| 5,881,407 | A | 3/1999 | Chu Pt | |
| 5,916,664 | A | 6/1999 | Rudy | |
| 6,092,249 | A | 7/2000 | Kamen et al. | |
| 6,560,803 | B2 | 5/2003 | Zur | |
| 8,127,373 | B1 | 3/2012 | Fodemski | |
| 8,523,794 | B2 | 9/2013 | Iker et al. | |
| 2002/0004120 | A1 | 1/2002 | Hillier | |
| 2002/0128572 | A1 | 9/2002 | Chang | |
| 2003/0009913 | A1 | 1/2003 | Potter et al. | |
| 2003/0110938 | A1* | 6/2003 | Seto | B25J 9/142 92/92 |
| 2003/0131417 | A1 | 7/2003 | Roux | |
| 2003/0181990 | A1 | 9/2003 | Phillips | |
| 2004/0083550 | A1 | 5/2004 | Graebe | |
| 2005/0043585 | A1 | 2/2005 | Dana et al. | |
| 2006/0085919 | A1 | 4/2006 | Kramer et al. | |
| 2006/0174518 | A1 | 8/2006 | Fogarty et al. | |
| 2009/0000037 | A1 | 1/2009 | Graebe | |
| 2011/0118635 | A1* | 5/2011 | Yamamoto | A61H 1/02 601/5 |
| 2011/0163885 | A1 | 7/2011 | Poulos et al. | |
| 2012/0054965 | A1 | 3/2012 | Kummer et al. | |
| 2014/0013514 | A1 | 1/2014 | Misaki | |
| 2014/0026327 | A1 | 1/2014 | Taylor | |
| 2014/0167460 | A1 | 6/2014 | Prexl et al. | |
| 2015/0335167 | A1 | 11/2015 | Cinquin | |
| 2016/0252110 | A1* | 9/2016 | Galloway | A61B 34/70 60/327 |
| 2017/0086588 | A1 | 3/2017 | Zouzal et al. | |

OTHER PUBLICATIONS

Balasubramanian et al., "Robot-assisted rehabilitation of hand function" Curr. Opin. Neurol. 23(6), 2010. Available: http://journals.lww.com/co-neurology/Fulltext/2010/12000/Robot_assisted_rehabilitation_of_hand_function.19.aspx.

Birch et al., "Design of a continuous passive and active motion device for hand rehabilitation", Presented at Engineering in Medicine and Biology Society, 2008. EMBS 2008. 30th Annual International Conference of the IEEE. 2008, . DOI: 10.1109/IEMBS.2008.4650162.

Connelly et al., "A pneumatic glove and imrnersive virtual reality environment for hand rehabilitative training after stroke" Neural Systems and Rehabilitation Engineering, IEEE Transactions On 18(5), pp. 551-559. 2010. DOI: 10.1109/TNSRE.2010.2047588.

Haghshenas-Jaryani M, Carrigan W, Wijesundara MBJ: "Design and Development of a Novel Soft-and-Rigid Actuator System for Robotic Applications", Paper No. 47761, Proceedings of the ASME 2015 International Design Engineering Technical Conferences & Computers and Information in Engineering Conference IDETC/CIE2015 Aug. 2-5, 2015, Boston, MA, USA.

Heo and Kim. "Power-assistive finger exoskeleton with a palmar opening at the fingerpad" Biomedical Engineeiing, IEEE Transactions on 61(11), pp. 2688-2697. 2014. . DOI: 10.1109/TBME.2014.2325948.

Ho et al., "An EMG-driven exoskeleton hand robotic training device on chronic stroke subjects: Task training system for stroke rehabilitation" Presented at Rehabilitation Robotics (ICORR), 2011 IEEE International Conference on. 2011, . DOI: 10.1109/ICORR.2011.5975340.

Hume et al., "Functional range of motion of the joints of the hand," J.Hand Surg., vol. 15, No. 2, March pp. 240-243. 1990.

Kadowaki et al., "Development of Soft Power-Assist Glove and Control Based on Human Intent," Journal of Robotics and Mechatronics, vol. 23, No. 2, pp. 281-291.

Kawasaki et al., "Development of a hand motion assist robot for rehabilitation therapy by patient self-motion control" Presented at Rehabilitation Robotics, 2007. ICORR 2007. IEEE 10$^{th}$ International Conference on. 2007, . DOI: 10.1109/ICORR.2007.4428432.

Loureiro and Harwin. "Reach & grasp therapy: Design and control of a 9-DOF robotic neuro-rehabilitation system" Presented at Rehabilitation Robotics, 2007. ICORR 2007. IEEE 10th International Conference on. 2007, . DOI: 10.1109/ICORR.2007.4428510.

Lum et al., "Robotic approaches for rehabilitation of hand function after stroke" American Journal of Physical Medicine & Rehabilitation 91(11), 2012. Available: http://dx.doi.org/10.1097/PHM.0b013e31826bcedb. DOI: 10.1097/PHM.0b013e31826bcedb.

Polygerinos et al., "Soft robotic glove for combined assistance and at-home rehabilitation", Robotics and Autonomous Systems (0), Available: http://dx.doi.org/10.1016/j.robot.2014.08.014.

Polygerinos et al., "Towards a soft pneumatic glove for hand rehabilitation" Presented at Intelligent Robots and Systems (IROS), 2013 IEEE/RSJ International Conference on. 2013, . DOI: 10.1109/IROS.2013.6696549.

Schabowsky et al., "Development and pilot testing of HEXORR: Hand EXOskeleton rehabilitation robot" Journal of NeuroEngineering and Rehabilitation 7(1), pp. 36. 2010. Available: http://www.jneuroengrehab.com/content/7/1/36.

Ueki et al., "Development of a Hand-Assist Robot With Multi-Degrees-of-Freedom for Rehabilitation Therapy," Mechatronics, IEEE/ASME Transactions on, vol. 17, No. 1, pp. 136-146.

Ueki et al., "Development of Virtual reality exercise of hand motion assist robot for rehabilitation therapy by patient self-motion control" Presented at Engineering in Medicine and Biology Society, 2008. EMBS 2008. 30th Annual International Conference of the IEEE. 2008, . DOI: 10.1109/IEMBS.2008.4650156.

Wege et al., "Development and control of a hand exoskeleton for rehabilitation" Human Interaction with Machines, G. Hommel and S. Huanye, Eds. 2006, 149-157, DOI: 10.1007/1-4020-4043-1_16.

Board, et al. "A comparison of trans-tibial amputee suction and vacuum socket conditions." *Prosthetics and Orthotics International*, 25(3);202-209, 2001.

Brand, "Tenderizing the Foot," *Foot & Ankle International*, 24(6); 457-461, 2003.

Bus, et al., "The Effectiveness of Footwear and Offloading Interventions to Prevent and Heal Foot Ulcers and Reduce Plantar

(56) References Cited

OTHER PUBLICATIONS

Pressure in Diabetes: A Systematic Review," *Diabetes Metabolism Research & Reviews*, 24 (S1); 99-118, 2008.
Chantelau, et al., "How Effective is Cushioned Therapeutic Footwear in Protecting Diabetic Feet? a Clinical Study," *Diabetic Medicine*, 7(4); 355-359, 1990.
Convery & Buis, "Conventional Patellar-Tendon-Bearing (PTB) Socket/ Stump Interface Dynamic Pressure Distributions Recorded During the Prosthetic Stance Phase of Gait of a Trans-Tibial Amputee," *Prosthetics and Orthotics International*, 22(3);193-198, 1998.
Dargis, et al., "Benefits of a Multidisciplinary Approach in the Management of Recurrent Diabetic Foot Ulceration in Lithuania: A Prospective Study," *Diabetes Care*, 22(9); 1428-1431, 1999.
Edmonds, et al., "Improved Survival of the Diabetic Foot: The Role of a Specialized Foot Clinic," *Quarterly Journal of Medicine*, 60(232); 763-771, 1986.
Faudzi, et al., "Design and Control of New Intelligent Pneumatic Cylinder for Intelligent Chair Tool Application," 2009 IEEE/IAS International Conference on Advanced Intelligent Mechatronics, Singapore, 1909-1914, 2009.
Hagberg & Branemark, "Consequences of Non-Vascular Trans-Femoral Amputation: A Survey of Quality of Life, Prosthetic Use and Problems." *Prosthetics and Orthotics International*, 25(3); 186-194, 2001.
Hamanami, et al., "Finding the Optimal Setting of Inflated Air Pressure for a Multi-Cell Air Cushion for Wheelchair Persons with Spinal Cord Injury," *Acta Medica Okayama*, 58(1): 37-44, 2004.
International Preliminary Report on Patentability in International Application No. PCT/US2014/072338 dated Jun. 28, 2016.
International Preliminary Report on Patentability Issued in Corresponding PCT Application No. PCT/US2018/028599, dated Oct. 22, 2019.
International Preliminary Report on Patentability Issued in Corresponding PCT Application No. PCT/US2017/064218, dated Jun. 4, 2019.
International Preliminary Report on Patentability Issued in Corresponding PCT Application. No. PCT/US2017/063400, dated May 28, 2019.
International Search Report and Written Opinion in International Application No. PCT/US2014/072338 dated Jun. 2, 2015.
International Search Report and Written Opinion Issued in Corresponding PCT Application No. PCT/US2017/064218, dated Mar. 28, 2018.
International Search Report and Written Opinion Issued in Corresponding PCT Application No. PCT/US2017/063400, dated Feb. 9, 2018.
International Search Report and Written Opinion Issued in Corresponding PCT Application No. PCT/US2018/28599, dated Aug. 1, 2018.
Lavery, et al., "Shear-Reducing Insoles to Prevent Foot Ulceration in High-Risk Diabetic Patients," *Advances in Skin & Wound Care*, 25(11); 519-524, 2012.
Reiber, et al., "Effect of Therapeutic Footwear on Foot Reulceration in Patients with Diabetes: A Randomized Controlled Trial," *The Journal of the American Medical Association*, 287(19); 2552-2558, 2002.
Sanders, et al., "Clinical Utility of In-Socket Residual Limb Volume Change Measurement: Case Study Results," *Prosthetics and Orthotics International*, 33(4); 378-390, 2009.
Uccioli, et al., "Manufactured Shoes in the Prevention of Diabetic Foot Ulcers," *Diabetes Care*, 18(10); 1376-1378, 1995.
Vermeulen, et al., "Trajectory Planning for the Walking Biped Lucy," *The International Journal of Robotics Research*, 25(9): 867-887, 2006.

* cited by examiner

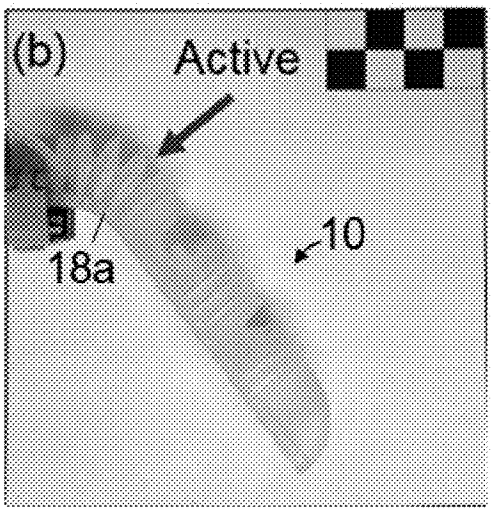
FIG. 3A
FIG. 3B
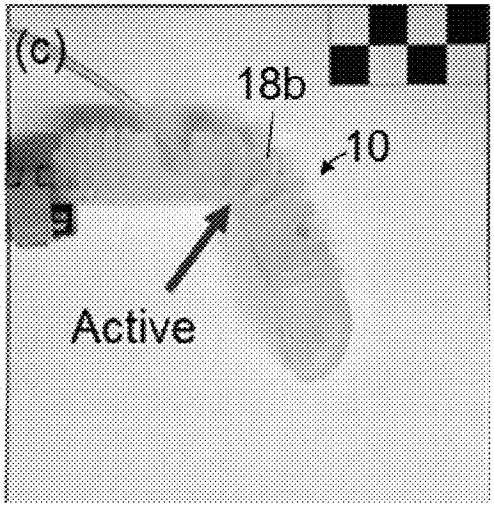
FIG. 3C
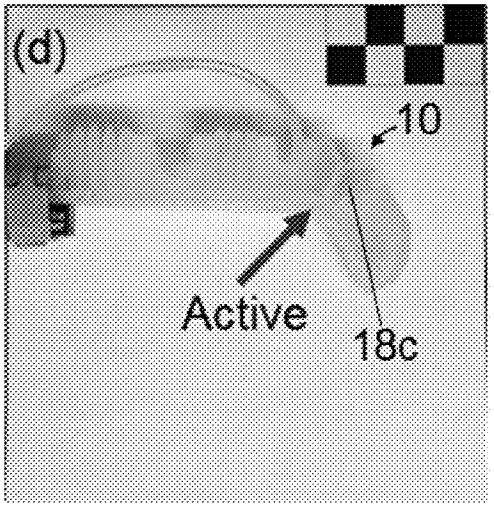
FIG. 3D

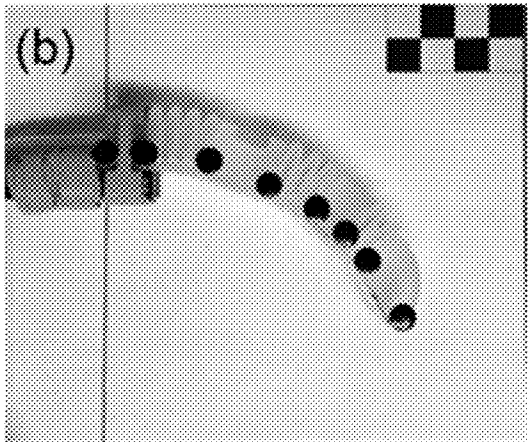
FIG. 24A
FIG. 24B
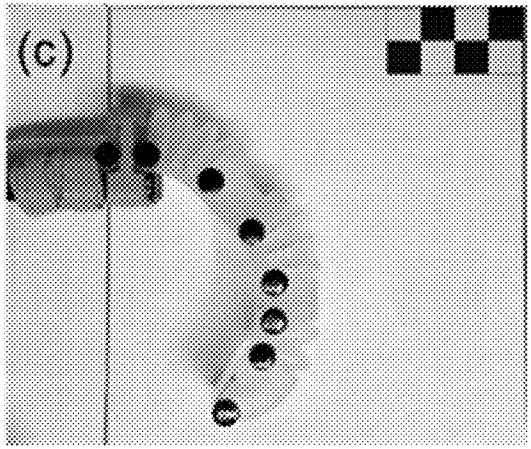
FIG. 24C
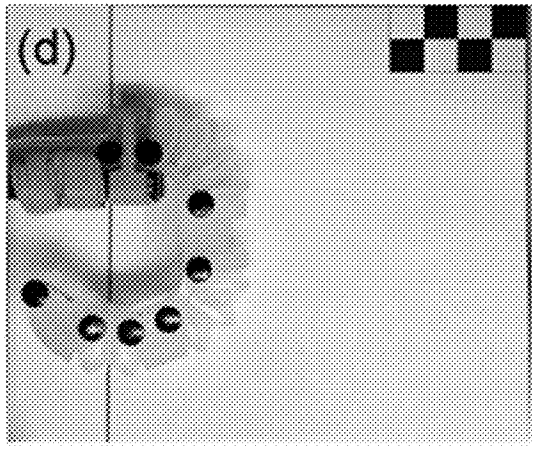
FIG. 24D

FLUID-DRIVEN ACTUATORS AND RELATED METHODS

CROSS-REFERENCE TO RELATED APPLICATIONS

This application claims priority to (1) U.S. Provisional Patent Application No. 62/100,652, filed Jan. 7, 2015 and (2) U.S. Provisional Patent Application No. 62/185,410, filed Jun. 26, 2015, both of which are incorporated by reference in their entireties.

BACKGROUND

1. Field of Invention

The present invention relates generally to actuators, and more specifically, but not by way of limitation, to fluid-driven actuators for use in manipulating apparatuses, such as, for example, joint rehabilitation devices, robotic end-effectors, and/or the like.

2. Description of Related Art

Rehabilitation devices, and perhaps more particularly, joint rehabilitation devices (e.g., dynamic orthotic devices, continuous passive motion (CPM) machines, active resistive movement devices), in some instances, may be used to guide, encourage, and/or induce certain desired body motions in a patient. To illustrate, a joint rehabilitation device configured to be worn on a patient's hand may be configured to assist the patient in performing certain body motions (e.g., reaching, grasping, releasing, and/or the like) that the patient may have difficulty performing without assistance. Through the use of such a joint rehabilitation device and over a period of time, the patient may become able to perform such body motions without the assistance of the joint rehabilitation device.

Current joint rehabilitation devices are generally one of two types: hard actuation systems [1-11] and soft actuation systems [12-14]. Typical hard actuation systems may be made of non-flexible materials (e.g., metals, and/or the like) and may involve electrical motors or pneumatic cylinders for actuation. Such systems, and particularly those that are configured to assist a patient in performing relatively complex body movements (e.g., grasping with a hand), may be correspondingly complex, costly, cumbersome, heavy, obtrusive, and/or the like (e.g., having complicated series of mechanical linkages). Typical soft actuation systems may involve soft muscle-like actuators; however, such systems generally require relatively high pressures for effective actuation (e.g., greater than 100 kilopascal gauge) and may not be capable of providing for control of complex body motions (e.g., motions that require individual actuation of selected joints in a human hand). Additionally, such high actuation pressures may require complicated control hardware and/or present safety issues.

SUMMARY

Some embodiments of the present actuators and/or apparatuses are configured, through one or more fluid-driven flexible cells disposed between two semi-rigid and/or rigid segments and configured to cause angular displacement of one of the two segments relative to the other of the two segments, to provide for complex articulations (e.g., similar to the articulation of a human hand) while minimizing, for example, mechanical complexity (e.g., to function as an end-effector for a robotic device, a joint rehabilitation device, and/or the like).

Some embodiments of the present manipulating apparatuses comprise: an actuator (e.g., that comprises: a semi-rigid first segment; a semi-rigid second segment; and one or more flexible cells disposed between the first segment and the second segment, each cell having a first end and a second end); where the actuator is configured to be coupled to a fluid source such that the fluid source can communicate fluid to vary internal pressures of the one or more cells; and where each cell is configured such that adjustments of an internal pressure of the cell rotates the first end relative to the second end to angularly displace the second segment relative to the first segment.

Some embodiments of the present manipulating apparatuses comprise: an actuator (e.g., that comprises: a semi-rigid first segment; a semi-rigid second segment; a semi-rigid third segment; a first flexible cell disposed between the first segment and the second segment; and a second flexible cell disposed between the first segment and the third segment); where the actuator is configured to be coupled to a fluid source such that the fluid source can communicate fluid to vary internal pressures of the first and second cells; where the first cell is configured such that adjustments of an internal pressure of the first cell angularly displaces the second segment relative to the first segment about a first axis; and where the second cell is configured such that adjustments of an internal pressure of the second cell angularly displaces the third segment relative to the first segment about a second axis that is non-parallel to the first axis. In some embodiments, the second axis is substantially perpendicular to the first axis.

Some embodiments of the present apparatuses comprise: an actuator comprising a semi-rigid first segment, a semi-rigid second segment, and one or more fluid-filled flexible cell disposed between the first segment and the second segment and pivotally coupling the first segment to the second segment, where the actuator is configured such that angular displacement of the second segment relative to the first segment varies an internal pressure of at least one of the one or more cells, and one or more sensors, each configured to capture data indicative of an internal pressure of at least one of the one or more cells.

In some embodiments of the present apparatuses, at least one of the segments is removably coupled to at least one of the cell(s).

Some embodiments of the present apparatuses further comprise a projection coupled to at least one of the cell(s), the projection configured to be received by a corresponding recess of at least one of the segments to couple the at least one of the cell(s) to at least one of the segments. In some embodiments, the projection comprises: a first end coupled to the cell and having a first transverse dimension measured in a first direction; and a second end having a second transverse dimension measured in the first direction, the second transverse dimension larger than the first transverse dimension.

In some embodiments of the present apparatuses, at least one of the segments is unitary with a sidewall that at least partially defines at least one of the cell(s).

In some embodiments of the present apparatuses, at least one of the segments is unitary with a sidewall that at least partially defines at least one of the cell(s).

In some embodiments of the present apparatuses, at least one of the cell(s) is at least partially defined by a sidewall having a ridged or corrugated portion.

In some embodiments of the present apparatuses, at least one of the cell(s) is at least partially defined by a sidewall having a smooth portion.

In some embodiments of the present apparatuses, at least one of the cell(s) is at least partially defined by a sidewall having an elastic portion.

In some embodiments of the present apparatuses, at least one of the cell(s) is at least partially defined by a sidewall having a semi-rigid portion.

In some embodiments of the present apparatuses, at least one of the cell(s) is at least partially defined by a sidewall having a thickness of 0.1 millimeters (mm) to 10 mm.

In some embodiments of the present apparatuses, the actuator is configured such that an internal pressure in at least one of the cells can be varied independently of an internal pressure in another one of the cells. In some embodiments, at least one of the cells is configured to be coupled to a first fluid channel and at least one other of the cells is configured to be coupled to a second fluid channel. In some embodiments, the actuator is configured such that an internal pressure in each of the cells can be varied independently of an internal pressure in each of others of the cells. In some embodiments, each of the cells is configured to be coupled to a respective fluid channel.

Some embodiments of the present apparatuses further comprise: a fluid source configured to be coupled to the actuator and to vary internal pressures of the cell(s).

In some embodiments of the present apparatuses, at least one of the segments defines a fluid channel in fluid communication with at least one of the cell(s).

In some embodiments of the present apparatuses, at least a portion of at least one of the segments is rigid.

In some embodiments of the present apparatuses, when the segments are substantially aligned with one another, the cell(s) extend along the actuator a total length that is from 10% to 90% of a length of the actuator. In some embodiments, when the first and second segments are substantially aligned with one another, the cell(s) disposed between the first and second segments extend a total length along an axis of the actuator that extends through the first and second segments that is from 10% to 90% of a length of the actuator along the axis.

In some embodiments of the present apparatuses, the actuator is configured to be coupled across a joint of a human body part. Some embodiments further comprise: one or more straps configured to couple the actuator across the joint of the human body part.

Some embodiments of the present apparatuses comprise a plurality of the present actuators. Some embodiments further comprise: a frame or wearing fixture; where each of the plurality actuators is coupled to the frame or wearing fixture. In some embodiments, the apparatus is configured to be coupled to a human hand such that each of the plurality of actuators is coupled to a human finger of the human hand.

Some embodiments of the present apparatuses further comprise: one or more sensors configured to detect one or more physical characteristics. In some embodiments, at least one of the one or more sensors comprises a pressure sensor in fluid communication with the interior of at least one of the cell(s) and configured to capture data indicative of an internal pressure of the at least one cell. In some embodiments, at least one of the one or more sensors comprises a pressure sensor coupled to one of the segments and configured to capture data indicative of a force applied between the segment and an object coupled to the segment. In some embodiments, at least one of the one or more sensors comprises at least one of a position, velocity, and acceleration sensor configured to capture data indicative of movement of the second segment relative to the first segment.

Some embodiments of the present apparatuses further comprise: a processor configured to control the fluid source to adjust the internal pressure in the cell(s). Some embodiments comprise a haptics processor configured to receive data captured by at least one of the one or more sensors and identify one or more processor-executable commands associated with data captured by the at least one sensor. In some embodiments, the haptics processor is configured to execute at least one of the one or more processor-executable commands. In some embodiments, the haptics processor is configured to transmit at least one of the one or more processor-executable commands to a processor.

Some embodiments of the present methods (e.g., of rehabilitating a human joint) comprise: coupling an actuator across the human joint (the actuator comprising: a semi-rigid first segment; a semi-rigid second segment; and a fluid-driven flexible cell disposed between the first segment and the second segment); and communicating fluid to the cell to cause angular displacement of the second segment relative to the first segment to induce movement in the human joint. Some embodiments further comprise: communicating fluid from the cell to resist angular displacement of the second segment relative to the first segment to resist movement in the human joint.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the term "substantially" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment(s) depicted in the figures.

FIGS. 3A-3D each depict, for one embodiment of the present actuators, an example of selective and independent actuation of one or more elastomeric cells.

FIGS. 24A-24D depict an exemplary actuation of one embodiment of the present actuators.

DETAILED DESCRIPTION OF ILLUSTRATIVE EMBODIMENTS

Figure 1A:
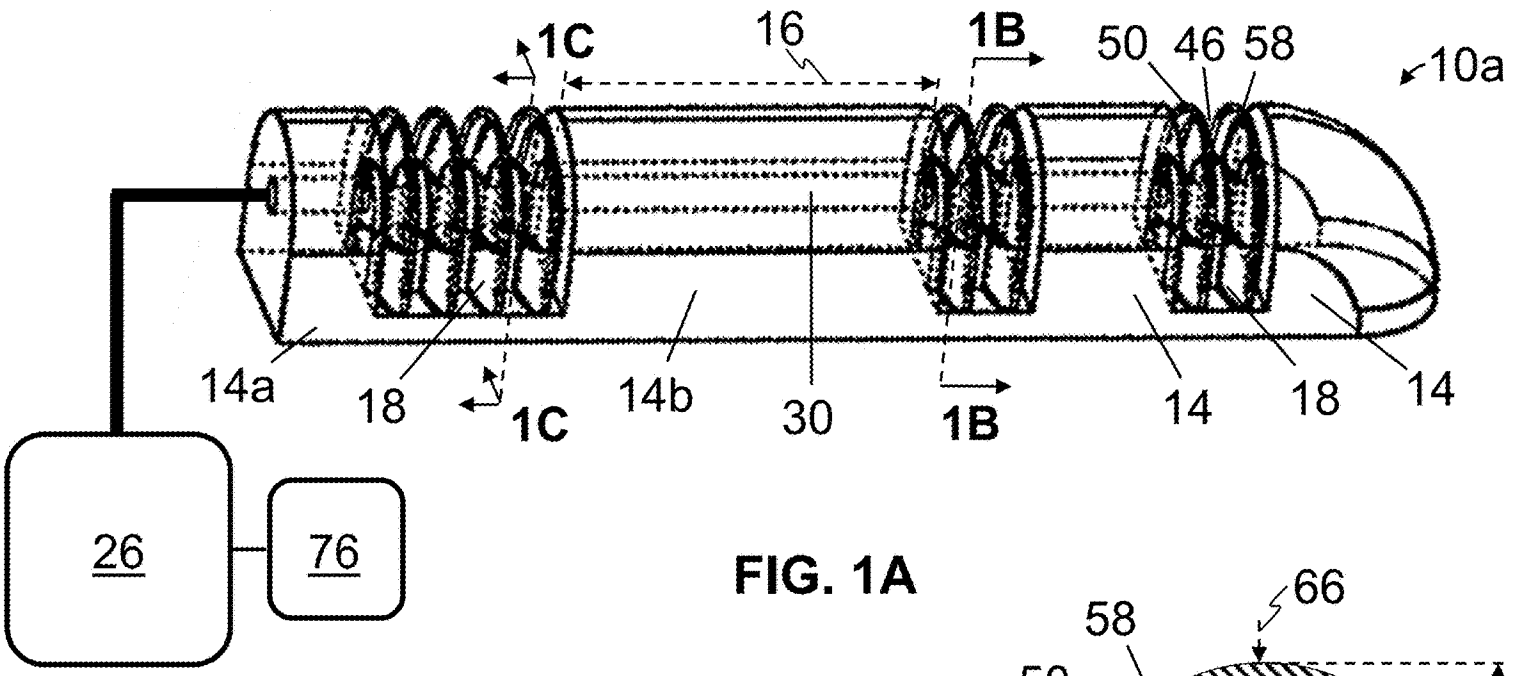
FIG. 1A is a transparent perspective view of a first embodiment of the present actuators, which may be suitable for use in some embodiments of the present manipulating apparatuses.
Figure 1B:
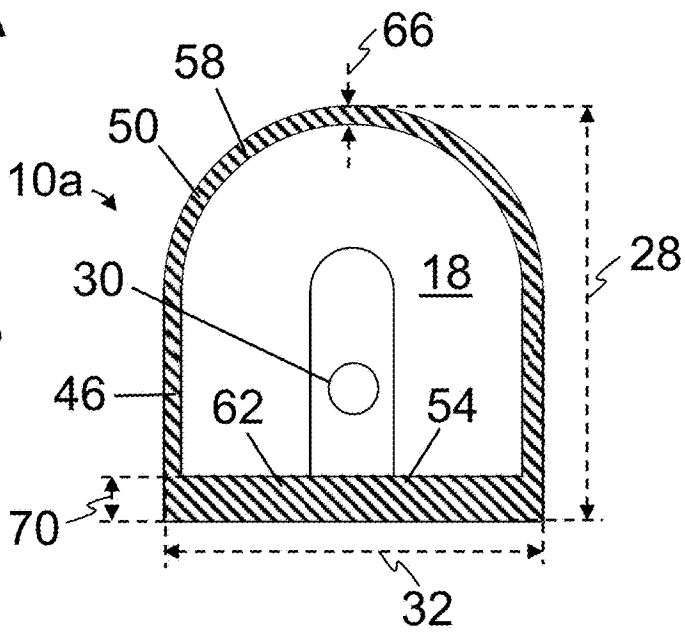
FIG. 1B is a cross-sectional end view of the actuator of FIG. 1A.

Referring now to FIGS. 1-2, shown therein and designated by the reference numeral 10*a* is a first embodiment of the present actuators, which may be suitable for use alone and/or included in the present manipulating apparatuses (e.g., 82, 94, and/or the like, described in more detail below). In the embodiment shown, actuator 10*a* comprises a first segment 14*a* and a second segment 14*b* (e.g., two or more segments, sometimes referred to collectively as "segments 14," for example, four (4) segments 14, as shown). In this embodiment, segments 14 are semi-rigid or rigid (e.g., solid and resistant to bending, but not necessarily inflexible), comprising an elastomer having a relatively high hardness (e.g., greater than Shore 40 A). However, in other embodiments, segments 14 can comprise any suitable material such as, for example, a polymer (e.g., a plastic, a rubber, a silicone rubber, and/or the like), a metal, a composite (e.g., a composite polyurethane, and/or the like), and/or the like, whether rigid and/or flexible. Segments 14 can have any suitable length 16, such as, for example, greater than any one of, or between any two of: 2, 4, 6, 8, 10, 12, 14, 16, 18, 20, 25, 30, 35, 40, 45, and/or 50 mm (e.g., up to or greater than 500 mm).

Figure 1C:
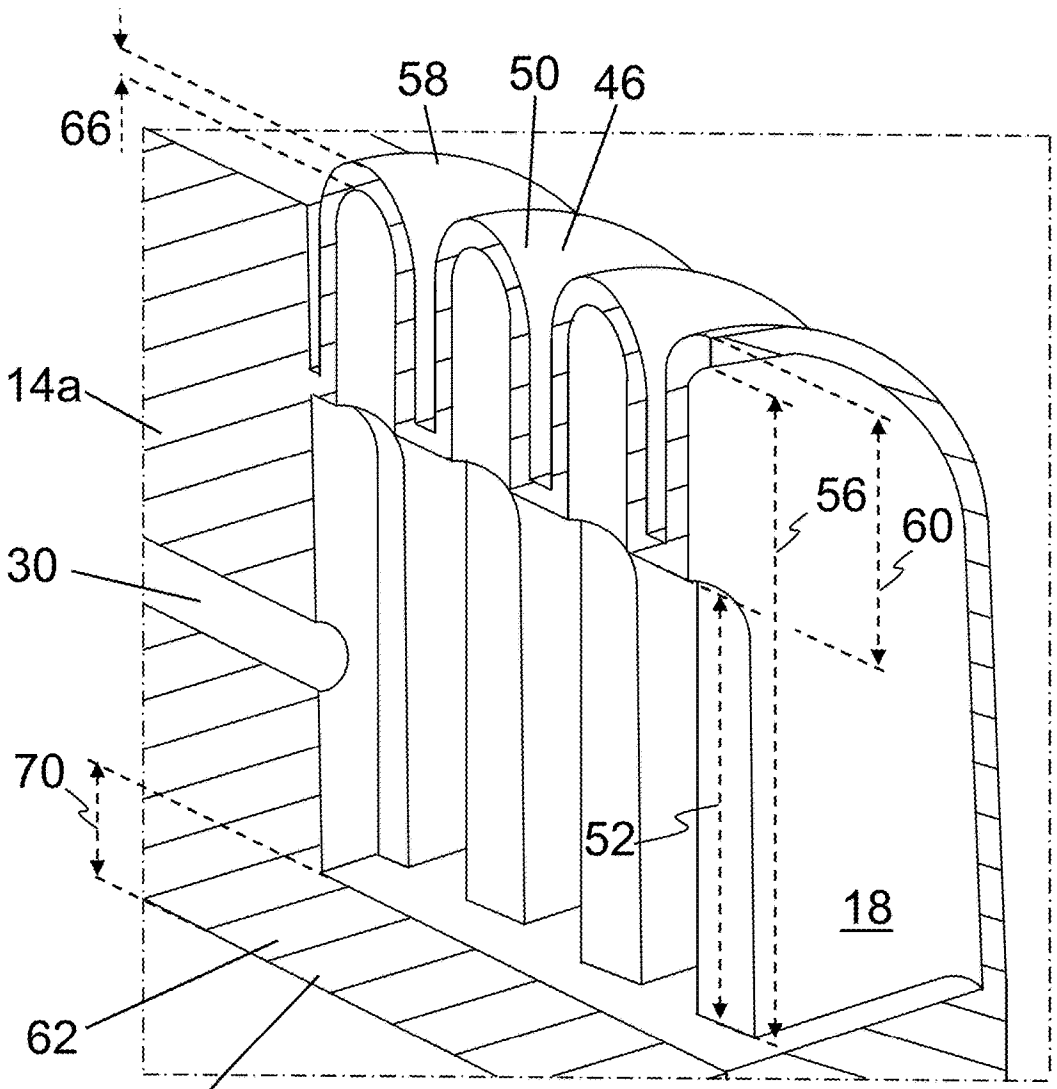
FIG. 1C is a cross-sectional and partially cutaway perspective view of the actuator of FIG. 1A.
Figure 2A:
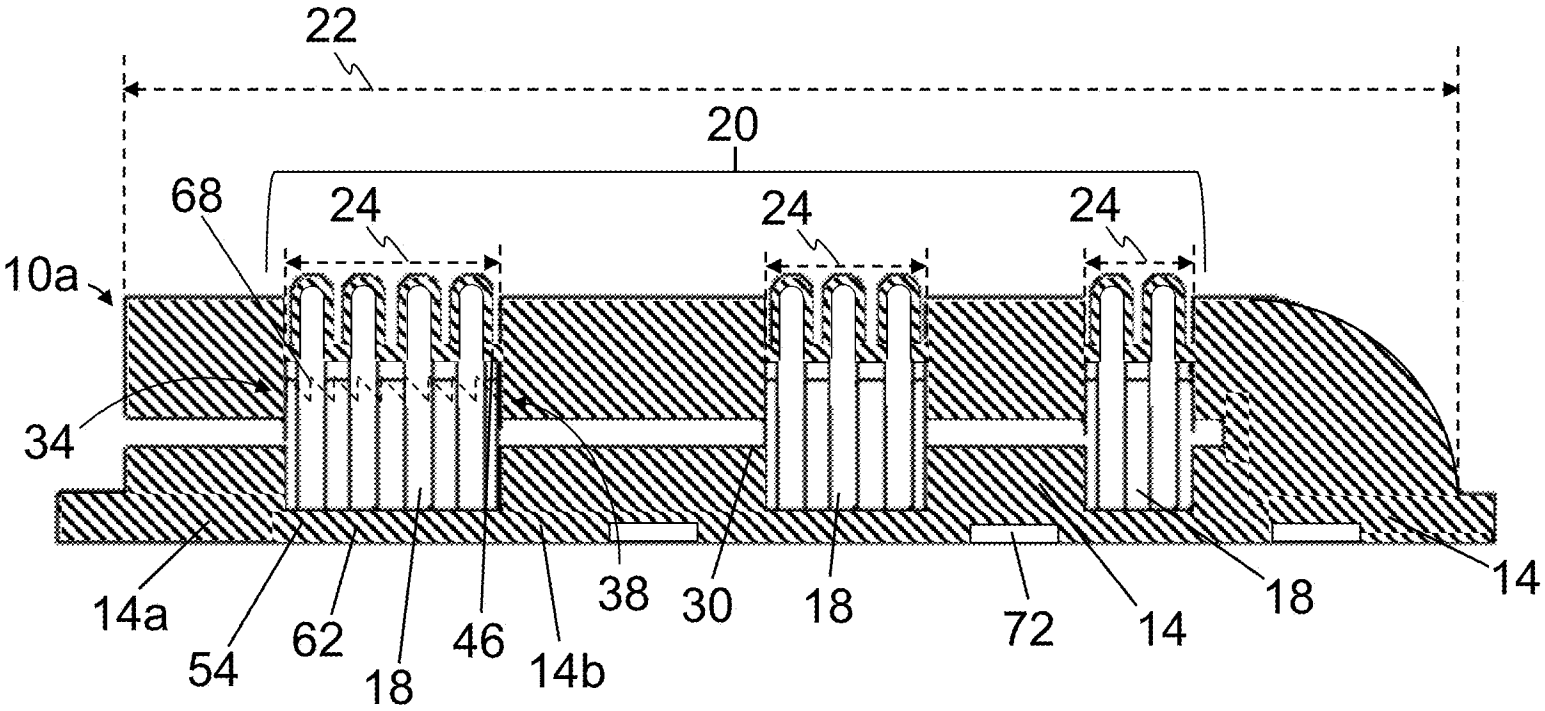
FIG. 2A is cross-sectional side view of the actuator of FIG. 1A, shown in a first state.
Figure 2B:
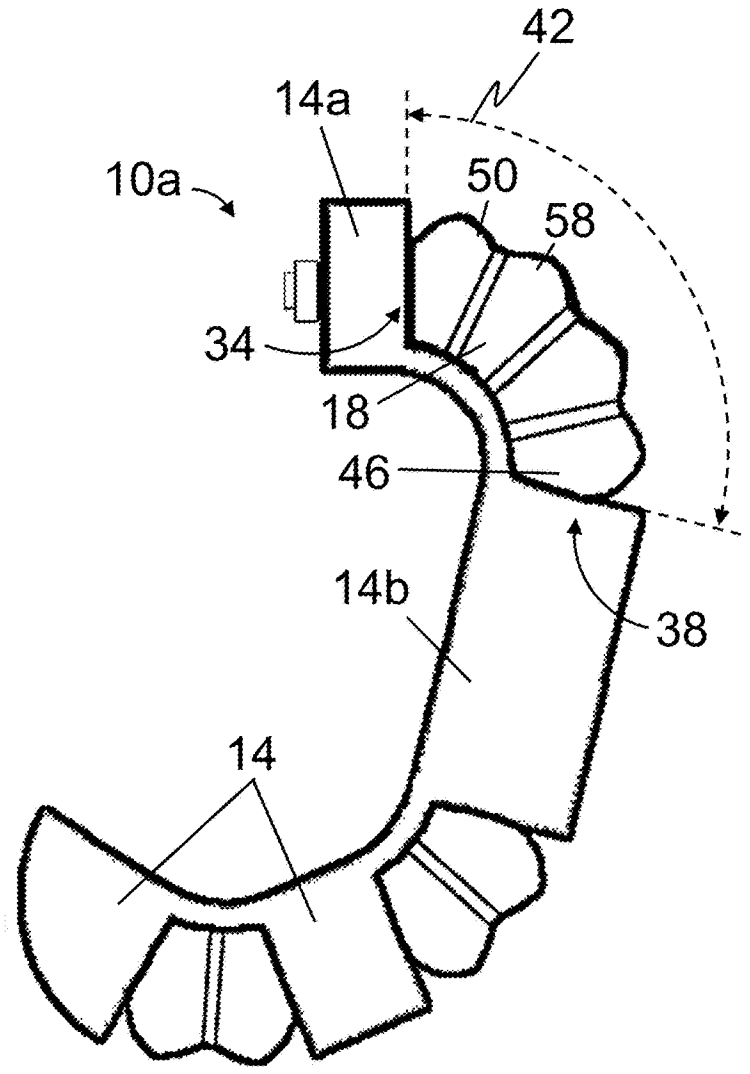
FIG. 2B is a side view of the actuator of FIG. 1A, shown in a second state.

In the depicted embodiment, actuator 10*a* comprises one or more cells 18 (e.g., elastomeric cells), each disposed between two of segments 14 (e.g., in the embodiment shown, a cell 18 is disposed between first segment 14*a* and second segment 14*b*). In this embodiment, at least one of segments 14 is unitary with a structure (e.g., sidewall 46) that also at least partially defines cell 18 (FIGS. 1C and 2A). Cell(s) 18 can comprise any suitable material, such as, for example, a polymer (e.g., a silicone rubber, a polyurethane rubber, a natural rubber, polychloroprene, other elastic material(s), and/or the like). Thus, some embodiments of the present actuators and/or apparatuses may be characterized as hybrid systems, composed of 'soft' components, such as elastomeric cell(s) 18, as well as 'rigid' components, such as segments 14.

Cells 18 can have any suitable dimensions (e.g., whether or not identical to others of the respective elastomeric cells), such as, for example, longitudinal first dimensions (e.g., lengths 24) greater than any one of or between any two of: 5, 8, 10, 12, 14, 16, 18, 20, 25, 30, 35, 40, 45, and/or 50 mm (e.g., up to or greater than 500 mm), transverse second dimensions (e.g., widths 32) greater than any one of or between any two of: 5, 8, 10, 12, 14, 16, 18, 20, 25, and/or 30 mm (e.g., up to or greater than 300 mm), and heights (e.g., 28) greater than any one of or between any two of: 10, 12, 14, 16, 18, 20, 25, and/or 30 mm (e.g., up to or greater than 300 mm) (e.g., length 24, width 32, and height 28 of an elastomeric cell 18 may be measured when an internal pressure of the elastomeric cell is substantially equal to an ambient pressure, or a pressure in an environment external to and adjacent actuator 10*a*). In the depicted embodiment, and as measured when segments 14 are substantially aligned with one another (e.g., not angularly displaced relative to one another, as in FIGS. 1A, 1C, and 2A), one or more elastomeric cells 18 extend along the actuator a total length 20 (e.g., a sum of lengths 24 of each cell 18 and any intervening segments) that is from 10% to 90% of a length 22 of actuator 10*a*. The present actuators can have any suitable length 22, such as, for example, greater than any one of or between any two of 10, 15, 20, 25, 30, 35, 40, 45, 50, 60, 70, 80, 90, 100, 125, 150, 175, and/or 200 mm (e.g., up to or greater than 500 mm).

In the embodiment shown, actuator 10*a* is configured to be coupled to a fluid source, (e.g., 26, FIG. 1A), such as, for example, a pump, such that the fluid source can communicate fluid to vary an internal pressure of at least one of cells 18, and, some embodiments of the present actuators and/or manipulating apparatuses comprise such a fluid source 26. The present actuators can be used with any suitable fluid, including gasses (e.g., air), liquids (e.g., water), and/or the like. Respective fluid source(s) of the present actuators and/or manipulating apparatuses can comprise any suitable fluid source, such as, for example, a pump, which may be dual-action (e.g., capable of communicating fluid to and from at least one of cells 18, to respectively increase and decrease an internal pressure of the at least one of the one or more elastomeric cells), and may include associated components such as for example, manifolds, regulators, valves, and/or the like. In this embodiment, fluid source 26 is configured to vary an internal pressure of at least one of cells 18 to a pressure above an ambient pressure (e.g., such that the at least one cell is pressurized), as well as to a pressure below an ambient pressure (e.g., such that the at least one of cells 18 is subject to negative pressure).

In this embodiment, at least one segment 14 defines a fluid channel 30 in fluid communication with at least one of one or more elastomeric cells 18 (e.g., to which fluid source 26 may be fluidly coupled, for example, through flexible and/or rigid fluid lines or conduits, such that the fluid source is in fluid communication with at least one of cells 18). In some embodiments, the present actuators may be configured such that an internal pressure in at least a first one of cells 18 can be varied independently of an internal pressure in at least a second one other of cells 18 (e.g., via a dedicated respective fluid channel 30 for each of the first and second elastomeric cells). In some embodiments, the present actuators are configured such that an internal pressure in each of cells 18 can be varied independently of an internal pressure in each of others of the elastomeric cells (e.g., via a dedicated respective fluid channel 30 for each of the one or more elastomeric cells). In these and similar embodiments, the present actuators and/or manipulating apparatuses may thus be configured to allow for selective and independent actuation of certain ones of cells 18 (e.g., allowing for a wide range of possible actuator movements). For example, for an actuator 10 (FIG. 3A), FIG. 3B depicts selective and independent actuation of a cell 18*a*, FIG. 3C depicts selective and independent actuation of a cell 18*b*, and FIG. 3D depicts selective and independent actuation of a cell 18*c*.

In the depicted embodiment, each of cells 18 is configured such that adjustments of an internal pressure of the elastomeric cell angularly displaces segments 14 adjacent the elastomeric cell relative to one another. For example, in the embodiment shown, adjustments of an internal pressure of one or more cells 18 disposed between first segment 14*a* and second segment 14*b* causes angular displacement of second segment 14*b* relative to first segment 14*a* (e.g., resulting in movement between a first state, shown in FIG. 2A, to a second state, shown in FIG. 2B). Segments 14, due in part to their semi-rigid or rigid nature, can thereby effectively transmit forces during such relative angular displacement, such as, for example, even under internal pressures within cells 18 that are relatively close to an ambient pressure (e.g., lower than 70 kilopascal gauge).

By way of illustration, in the depicted embodiment, each of cells 18 comprises a first end 34 and a second end 38. In the embodiment shown, for each of cells 18, as an internal pressure of the cell is adjusted, first end 34 rotates relative to second end 38 to angularly displace adjacent segments 14 relative to one another (e.g., second segment 14*b* relative to first segment 14*a*, as shown). In this embodiment, for a cell 18 disposed between first segment 14*a* and second segment 14*b*, such rotation of first end 34 relative to second end 38 is depicted as a pitching displacement (e.g., generally in the plane of path 42); however, in other embodiments, cells 18 may be configured such that adjustments to an internal pressure of the cells causes pitching, rolling, and/or yawing of first end 34 relative to second end 38 (e.g., and thus, relative pitching, rolling, and/or yawing, respectively, of adjacent segments 14).

Such relative motion of adjacent segments 14 due to internal pressure adjustments within one or more cells 18 may be tailored, at least through configuration of the cell(s). For example in the embodiment shown, for each cell 18, as an internal pressure of the cell is adjusted, at least a first portion of a sidewall 46 that at least partially defines the elastomeric cell is configured to deform (e.g., expand or contract) to a larger degree than a second portion of the sidewall, and the relative positions of these portions defines the direction of movement. More particularly, expansion and/or contraction of the first and second portions of the sidewall may be unequal, thereby causing angular displacement of first end 34 of the cell relative to second end 38 of the cell, and angular displacement of segments adjacent the elastomeric cell.

To illustrate, in this embodiment, at least one elastomeric cell 18 is at least partially defined by a sidewall 46 having a ridged or corrugated portion 50, and a smooth (e.g., non-corrugated or planar, at least in certain positions or actuation states) portion 54. In this embodiment, at least one elastomeric cell 18 has an internal height which varies along the elastomeric cell (e.g., due, at least in part, to a corrugated portion 50 of a sidewall 46 that at least partially defines the elastomeric cell). For example, in the depicted embodiment (FIG. 1C), an elastomeric cell 18, defined at least in part by a sidewall 46 having a corrugated portion 50, has a maximum internal height 56 that is from 1.1 to 10.1 times larger than a minimum internal height 52 (e.g., the maximum internal height and the minimum internal height being measured when an internal pressure of the elastomeric cell is substantially equal to an ambient pressure, or a pressure in an environment external to and adjacent actuator 10*a*). In this embodiment, for such an elastomeric cell, corrugated portion 50 of sidewall 46 may extend a maximum distance 60 above minimum internal height 52, where the maximum distance is from 0.1 to 10 times the minimum internal height.

For a given cell 18, portion(s) 50 of sidewall 46 may expand and/or contract to a larger degree under an increase and/or decrease in an internal pressure of the elastomeric cell than portion(s) 54 of the sidewall. To further illustrate, in the embodiment shown, at least one cell 18 is at least partially defined by a sidewall 46 having an highly-flexible (e.g., elastic) portion 58, and a less-flexible (e.g., semi-rigid) portion 62. For a given cell 18, portion(s) 58 of sidewall 46 may expand and/or contract to larger degree under an increase and/or decrease in an internal pressure of the elastomeric cell than portion(s) 62 of the sidewall. For example, in the depicted embodiment, portion 58 has a first thickness 66, and portion 62 has a second thickness 70 that is larger than first thickness 66. In some embodiments, first thickness 66 may be from 0.1 mm to 10 mm, and second thickness 70 may be from 0.5 mm to 20 mm. For a given cell, thinner portion(s) of sidewall 46 (e.g., having first thickness 66) may expand and/or contract to a larger degree under an increase and/or decrease in internal pressure of the elastomeric cell than thicker portion(s) of the sidewall (e.g., having second thickness 70).

Thus, at least through configuration of sidewall(s) 46 via varying thicknesses and/or shape (e.g., ridged or corrugated and/or smooth portions, elastic and/or semi-rigid portions, and/or the like) an relative pitching, rolling, and/or yawing between adjacent segments 14 may be induced by changes in internal pressures of one or more elastomeric cells 18. In some embodiments, adjacent segments (e.g., 14*a* and 14*b*) may be biased towards a particular position relative to one another (e.g., such an aligned position, as shown in FIG. 2A), for example, by one or more springs disposed between the adjacent segments (e.g., which may be disposed within and/or through one or more elastomeric cells 18 located between the adjacent segments, as shown for spring 68, a potential location for which is illustrated generally in FIG. 2A).

In the embodiment shown, actuator 10*a* comprises one or more sensors (e.g., 72*a*) configured to detect one or more physical characteristics (e.g., pressure, shear, and/or the like). For example, in this embodiment, sensors (e.g., 72*a*) are coupled to segments 14 (FIG. 2A). In other embodiments, sensor(s) (e.g., 72*a*) may be disposed at any suitable location, such as, for example, coupled to fluid source 26, disposed within fluid channel 30, and/or the like. In the depicted embodiment, sensors 72*a* may be pressure sensors configured to capture data indicative of a pressure applied by segments 14 to an object (e.g., a user's hand, an object to be grasped, and/or the like).

In the embodiment shown, actuator 10*a* (e.g., and/or a corresponding manipulating apparatus comprising actuator 10*a*) comprises a processor 76 configured to control fluid source 26 to adjust an internal pressure in one or more elastomeric cells 18, such as, for example, by executing commands that may be stored in a memory coupled to the processor and/or communicated to the processor.

In some embodiments, such instructions and/or actions caused by execution of such instructions depend upon and/or are adjusted based upon data captured by sensor(s) (e.g., 72*a*). Sensor(s) (e.g., 72*a*) of the present actuators and/or manipulating apparatuses can comprise any suitable sensor, such as, for example, a pressure sensor (e.g., whether configured to capture data indicative of a pressure between an actuator on an object, in fluid communication with one of elastomeric cells 18, such as an in-line pressure sensor, and/or the like), a force sensor, a torque sensor, a position sensor, a velocity sensor, an acceleration sensor, and/or the like. For example, processor 76 may receive a command to cause flexion of actuator 10*a*, communicate with fluid source 26 to increase an internal pressure of one or more cells 18 (e.g., individually or collectively) and, in some embodiments, may communicate with sensor(s) (e.g., 72*a*) to ensure that actuator 10*a* does not apply a pressure to an object (e.g., a user's hand, an object to be grasped, and/or the like) that exceeds a threshold (e.g., for safety and/or comfort, to prevent damage to the object, and/or the like). For further example, processor 76 may receive a command to cause actuator 10*a* to exert a specified pressure, force, and/or torque on an object (e.g., a user's hand, an object to be grasped, and/or the like), and, in some embodiments, may communicate with sensor(s) (e.g., 72*a*) to ensure that actuator 10*a* exerts the specified pressure, force, and/or torque on the object (e.g., the sensor(s) and/or processor may form at least part of a feedback control system). In some embodiments, data from such sensor(s) (e.g., 72*a*) may be received by a processor (e.g., 76) that may calculate therapeutic parameters, such as, for example, a range of motion, a grasping strength, levels of joint stiffness, muscle contracture, and/or the like, and/or the like.

Figure 4:
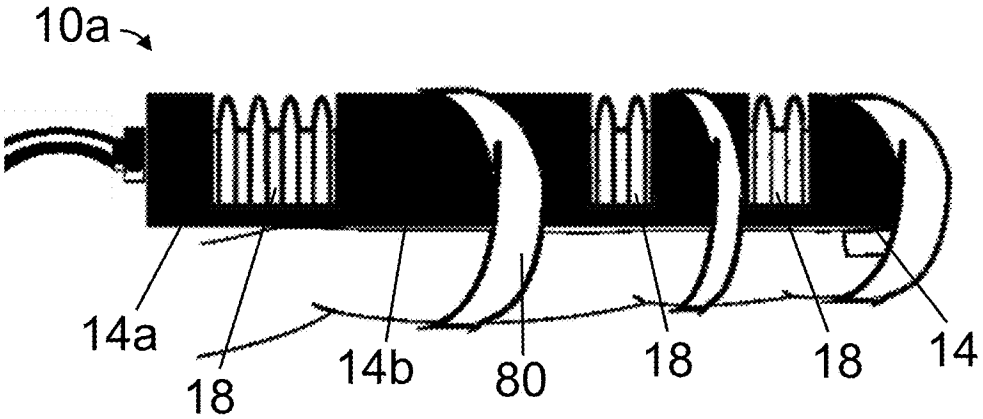
FIG. 4 is a side view of the actuator of FIG. 1A, shown coupled to a human finger.

As shown in FIG. 4, some embodiments of the present actuators (e.g., 10*a*) are configured to be coupled across a joint of a human body part (e.g., a joint of a human finger, arm, shoulder, back, neck, hip, leg, foot, toe, and/or the like). For example, in the embodiment shown, actuator 10*a* comprises one or more straps 80 configured to couple the actuator across joints of a human finger (e.g., with cells 18 each overlying the one of the metacarpophalangeal, proximal interphalangeal, and distal interphalangeal joints of the human finger, and segments 14 dimensioned accordingly, such that flexion and/or extension of the actuator induces flexion and/or extension of the human finger). In other embodiments, actuator 10*a* can be coupled across a joint of a human body part in any suitable fashion (e.g., tape, adhesive, and/or the like).

Figure 5A:
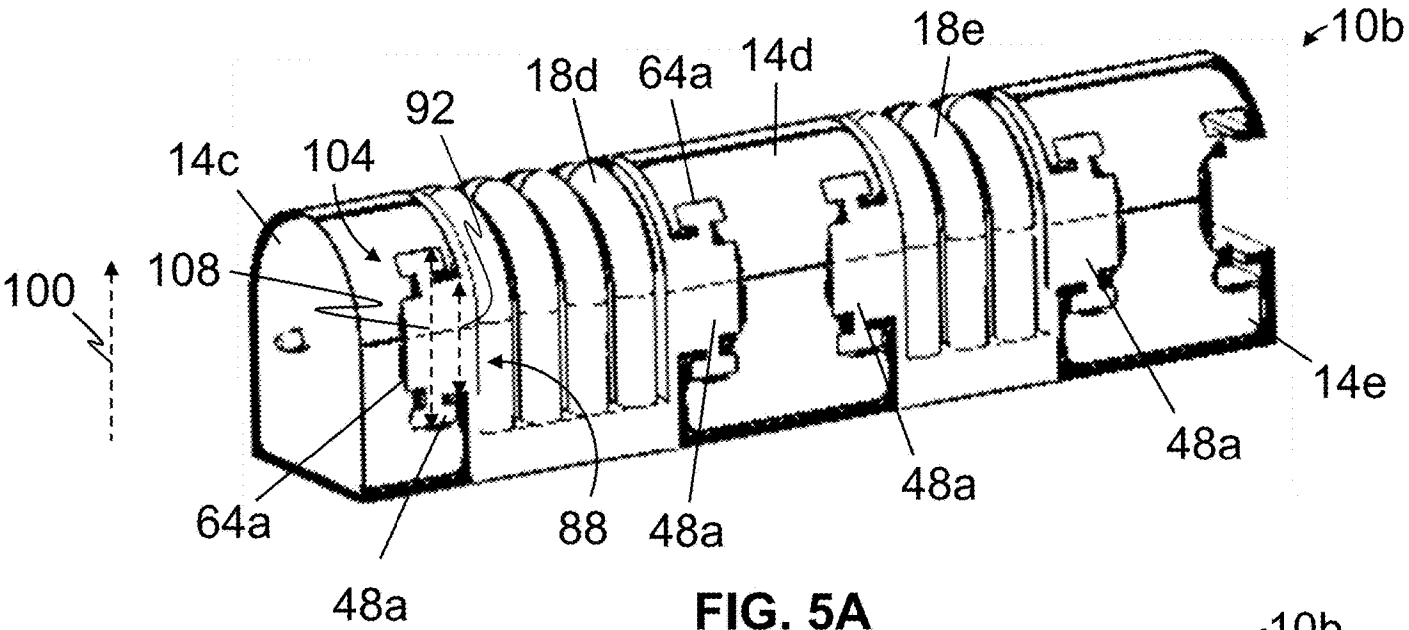
FIG. 5A is a perspective view of a second embodiment of the present actuators, which may be suitable for use in some embodiments of the present manipulating apparatuses.
Figure 5B:
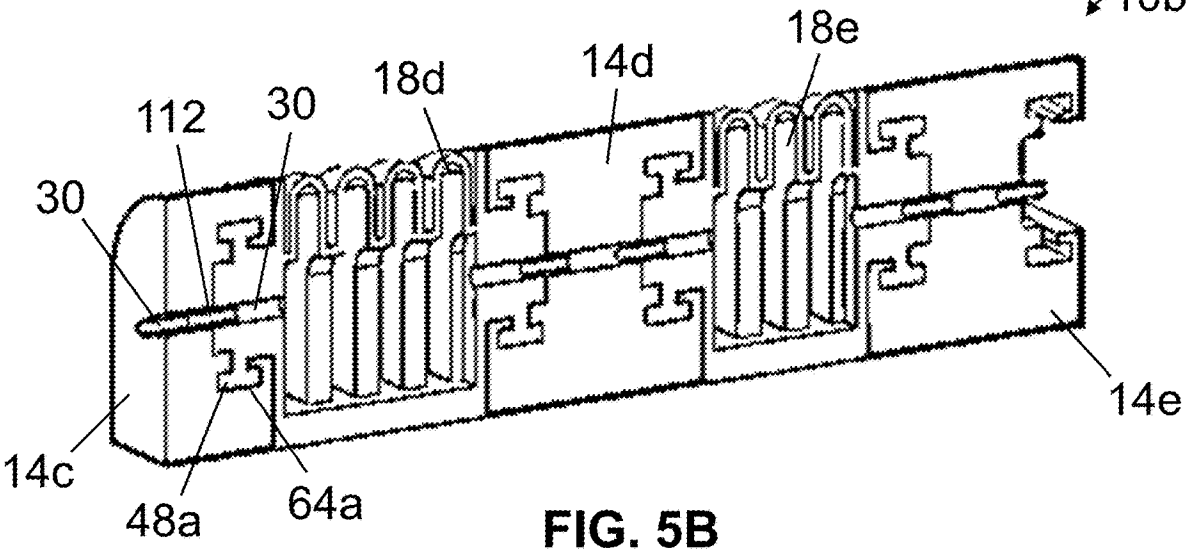
FIGS. 5B and 5C are cross-sectional and cross-sectional exploded views, respectively, of the actuator of FIG. 5A.
Figure 5C:
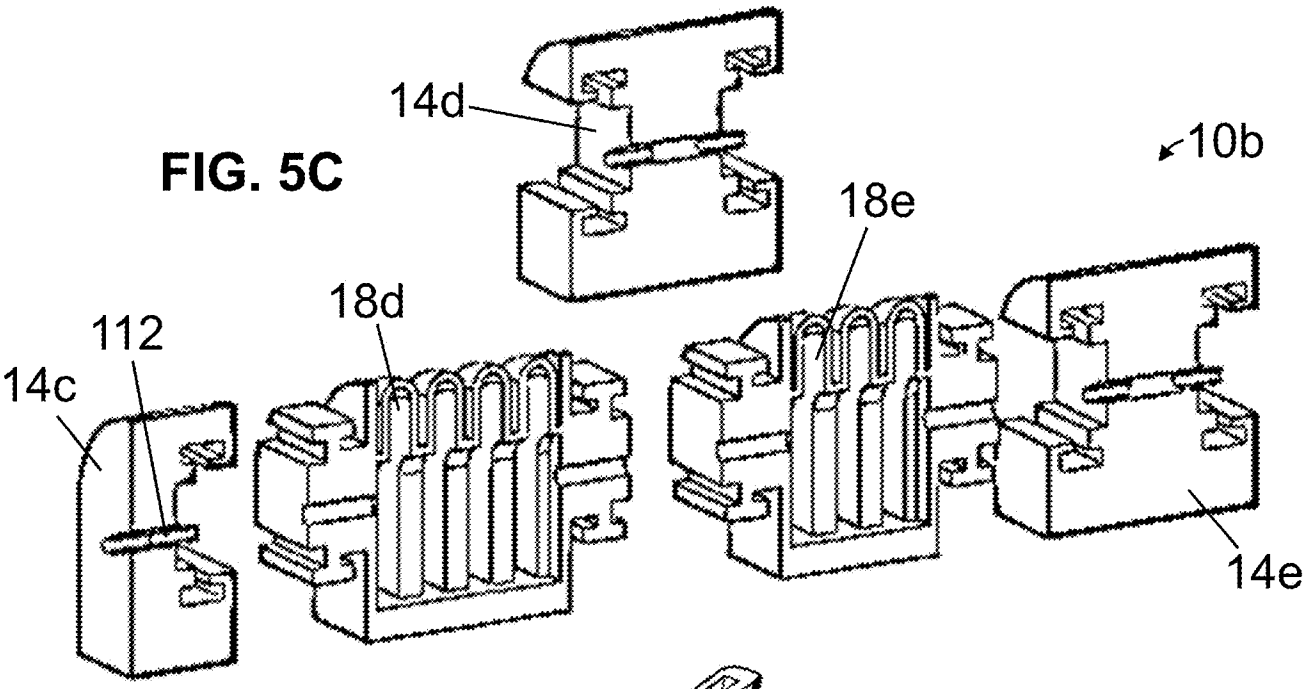

Referring now to FIGS. 5A-5C, shown is a second embodiment 10*b* of the present actuators, which may be suitable for use in some embodiments of the present manipulating apparatuses (e.g., 82, 94, and/or the like). Actuator 10*b* may be substantially similar to actuator 10*a*, with the primary exceptions described below. In the embodiment shown, at least one of segments 14 is removably coupled to at least one elastomeric cell 18. For example, in this embodiment, segment 14*c* is removably coupled to cell 18*d*, segment 14*d* is removably coupled to cell 18*d* and cell 18*e*, and segment 14*e* is removably coupled to cell 18*e*. In the depicted embodiment, actuator 10*b* comprises one or more projections 48*a*, each coupled to (e.g., unitary with) one of elastomeric cell(s) 18 and configured to be (e.g., slidably) received by a corresponding recess 64*a* of a segment 14 to couple the cell to the segment. In this embodiment, each of one or more projections 48*a* comprises a first end 88 coupled to one of elastomeric cell(s) 18, the first end having a first transverse dimension 92 measured in a first direction (e.g., generally along a direction indicated by arrow 100) and a second end 104 having a second transverse dimension 108 measured in the first direction, the second transverse dimension being larger than the first transverse dimension (e.g., such that when the projection is received by a corresponding recess 64*a*, the projection and recess may be resemble and/or function as a tenon, such as a hammer-head tenon, and a corresponding mortise). For example, first transverse dimension 92 may be from 20 to 80% of a height 28 of actuator 10*b*, and/or second transverse dimension 108 may be from 10 to 90% of height 28 of the actuator. In these ways and others, actuator 10*b* may allow for a removable coupling between at least one of segments 14 and at least one elastomeric cell 18, while minimizing a risk of inadvertent separation of the segment and the cell, fluid leakage between the segment and the cell, and/or the like.

Figure 6:
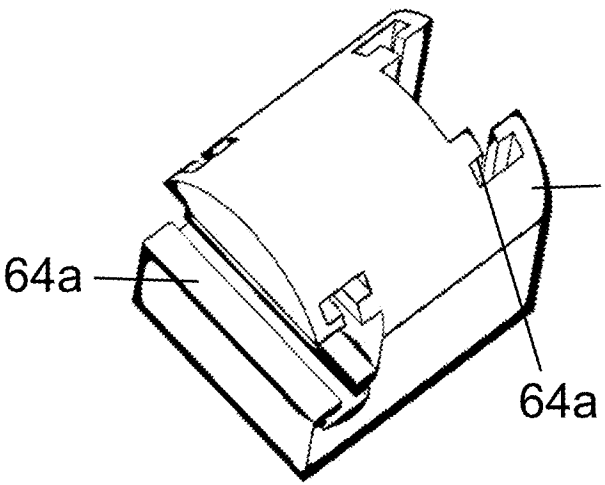
FIG. 6 is a perspective view of a segment, which may be suitable for use in some embodiments of the present actuators.

At least through such removable coupling between at least one of segments 14 and at least one of elastomeric cell(s) 18, actuator 10*b* may be reconfigurable and/or modular (e.g., comprising an assembly of modules, each of which may include any suitable number of segments 14, each having any suitable dimensions and/or configuration, and/or any suitable number of cell(s) 18, each having any suitable dimensions and/or configurations). For example, and referring additionally to FIG. 6, shown is a segment 14*f*, which may be suitable for use in some embodiments of the present actuators (e.g., 10*b*). Segment 14*f* may be similar to segments 14*d* and 14*e* of actuator 10*b* (in that segment 14*f* includes two recesses 64*a* such that segment 14*f* may be coupled (e.g., between) two of elastomeric cells 18); however, segment 14*f* differs from segments 14*d* and 14*e* in that segment 14*f* is configured to be coupled to a first one of cells 18 and a second one of cells 18 such that the first cell is angularly disposed (e.g., pitched, rolled, and/or yawed) relative to the second cell (e.g., such that the second elastomeric cell is rolled 90 degrees relative to the first elastomeric cell, in the embodiment shown). In at least this way, segment 14*f* and similar segments may be used to configure an actuator (e.g., 10*b*) to provide for a wide range of actuator movements.

In this embodiment, actuator 10*b* comprises one or more fittings 112, each configured to be coupled to one of elastomeric cell(s) 18 and/or at least one of segments 14. For example, in the depicted embodiment, each of one or more fittings 112 is disposable within a fluid channel 30 of one of cell(s) 18 and/or at least one of segments 14. In the embodiment shown, one or more fittings 112 may be used to secure at least one elastomeric cell 18 relative to at least one of segments 14. For example, a projection 48*a* coupled to a cell 18 may be received within a recess 64*a* of a segment 14, and a fitting 112 may be disposed through a fluid channel 30 of the segment and into the cell (e.g., into a fluid channel 30 of the cell) to secure the cell relative to the segment. In these ways and others, one or more fittings 112 may facilitate a coupling and/or seal between cell(s) 18 and segments 14. In this embodiment, fittings 112 may be open (e.g., configured to allow fluid communication through the fitting) or closed, such that, for example, the fitting(s) may be used to permit or block fluid communication between cell(s) 18 and segments 14.

Figure 7A:
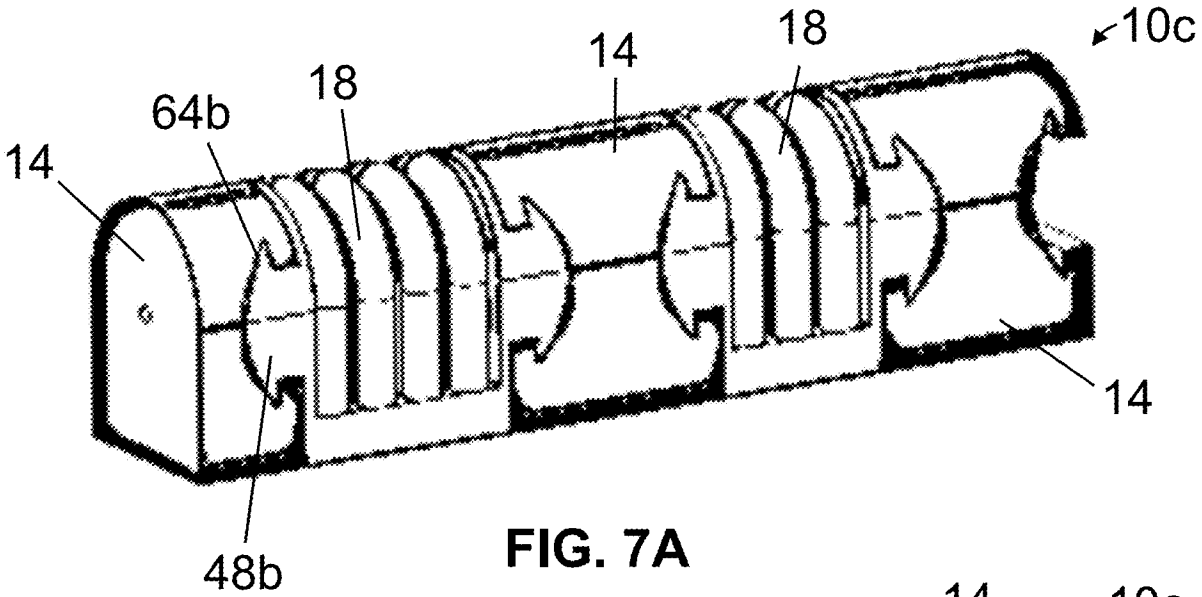
FIG. 7A is a perspective view of a third embodiment of the present actuators, which may be suitable for use in some embodiments of the present manipulating apparatuses.
Figure 7B:
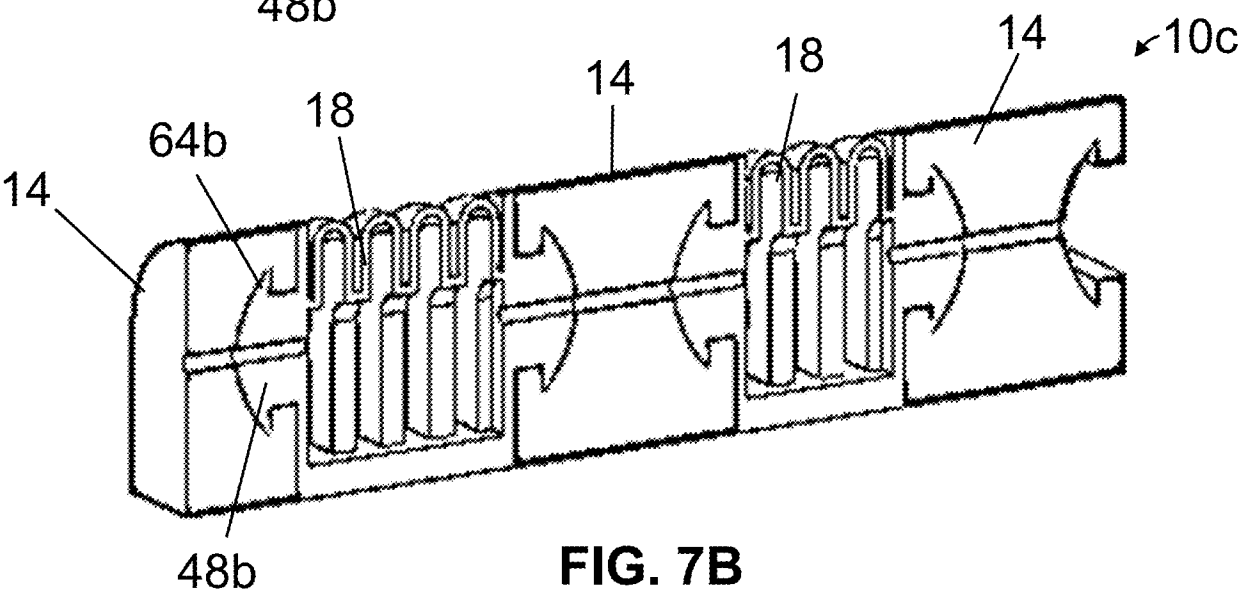
FIGS. 7B and 7C are cross-sectional and cross-sectional exploded views, respectively of the actuator of FIG. 7A.
Figure 7C:
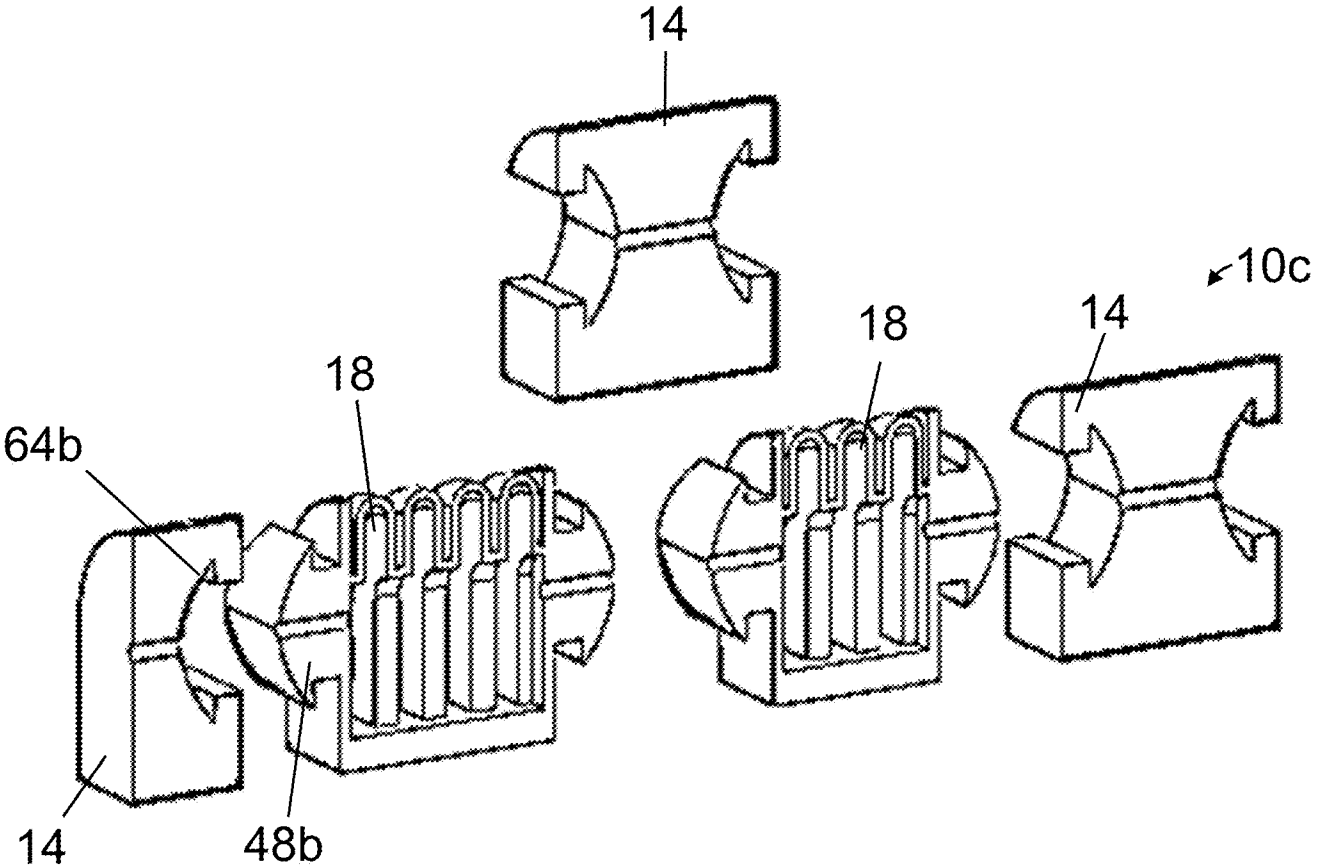

Referring now to FIGS. 7A-7C, shown is a third embodiment 10*c* of the present actuators, which may be suitable for use in some embodiments of the present manipulating apparatuses (e.g., 82, 94, and/or the like). Actuator 10*c* may be substantially similar to actuator 10*b* with the primary exceptions described below. In actuator 10*b*, interior surfaces of one or more recesses 64*a* (e.g., and corresponding exterior surfaces of projection(s) 48*a*) are generally planar; however, in actuator 10*c*, one or more interior surfaces of recess(es) 64*b* (e.g., and corresponding exterior surfaces of projection(s) 48*b*) are generally curved. In yet other embodiments, one or more recesses (e.g., 64*a*, 64*b*, and/or the like) and corresponding projection(s) (e.g., 48*a*, 48*b*, and/or the like) can comprise any suitable shapes or dimensions.

Figure 8:
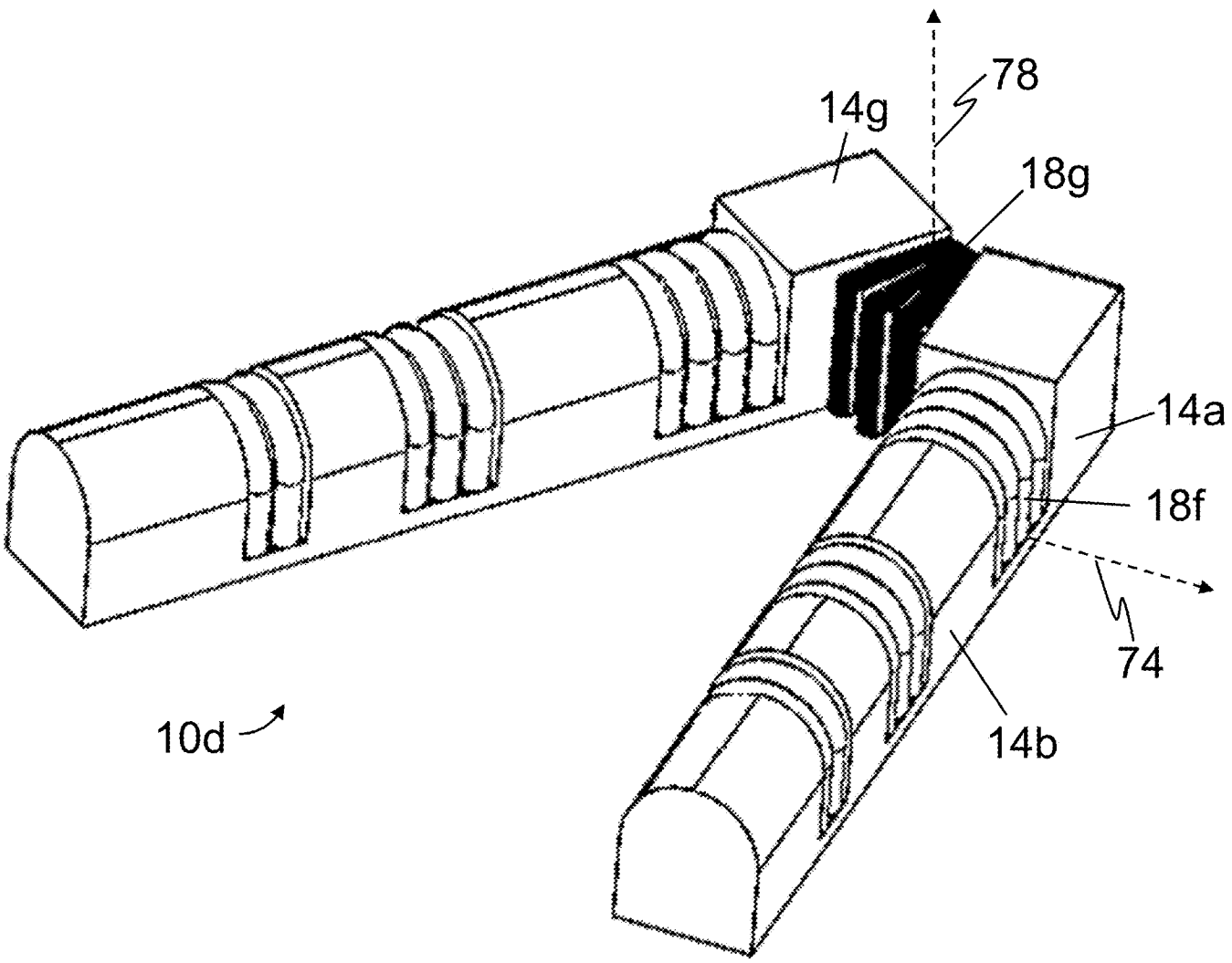
FIG. 8 is a perspective view of a fourth embodiment of the present actuators, which may be suitable for use in some embodiments of the present manipulating apparatuses.

FIG. 8 is a perspective view of a fourth embodiment 10*d* of the present actuators, which may be suitable for use in some embodiments of the present manipulating apparatuses (e.g., 82, 94, and/or the like). Actuator 10*d* is substantially similar to actuator 10*a*, with the primary differences described below. In the embodiment shown, actuator 10*d* comprises a semi-rigid or rigid segment 14*g* with a cell 18*g* disposed between first segment 14*a* and segment 14*g*. In this embodiment, first cell 18*f* is configured such that an adjustment of an internal pressure of the first cell angularly displaces second segment 14*b* relative to first segment 14*a* about a first axis 74, and second cell 18*g* is configured such that an adjustment of an internal pressure of the second cell angularly displaces segment 14*g* relative to first segment 14*a* about a second axis 78 that is not parallel to the first axis. For example, in the embodiment shown, second axis 78 is substantially perpendicular to first axis 74 such that angular displacement of second segment 14*b* relative to first segment 14*a* about first axis 74 may correspond to flexion and extension of a finger, and angular displacement of segment 14*g* relative to first segment 14*a* about second axis 78 may correspond to abduction and adduction of adjacent fingers (e.g., when actuator 10*d* is coupled to a human hand).

Figure 9:
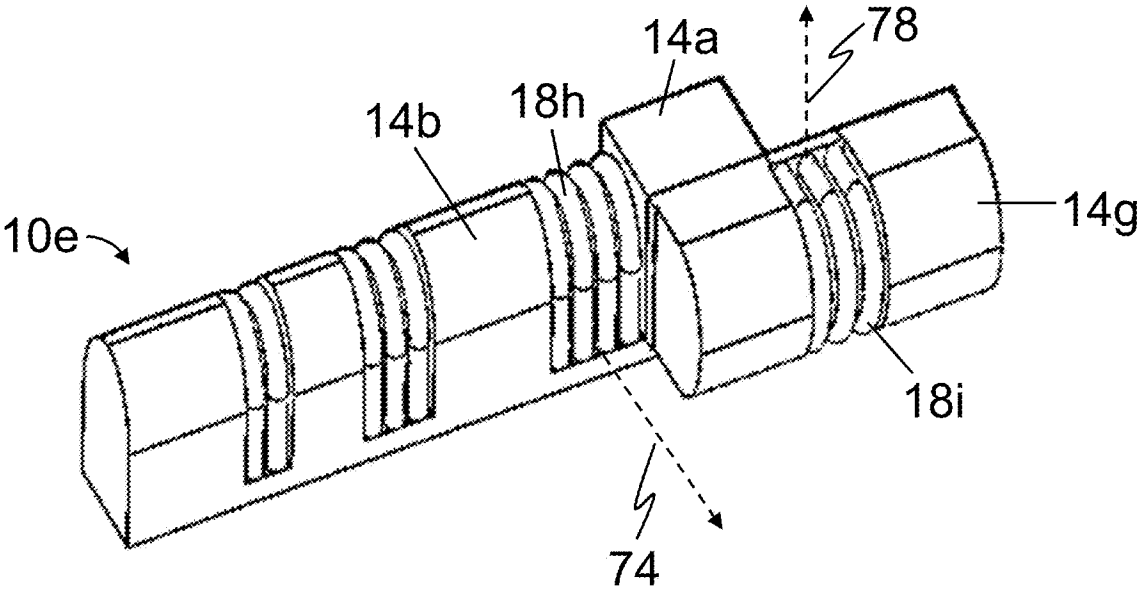
FIG. 9 is a perspective view of a fifth embodiment of the present actuators, which may be suitable for use in some embodiments of the present manipulating apparatuses.

FIG. 9 is a perspective view of a fifth embodiment 10*e* of the present actuators, which may be suitable for use in some embodiments of the present manipulating apparatuses (e.g., 82, 94, and/or the like). Actuator 10*e* is substantially similar to actuator 10*d*, with the primary exception that a longitudinal axis (e.g., along which length 24 is measured) of second elastomeric cell 18*i* is substantially parallel to a longitudinal axis of first elastomeric cell 18*h*. In this embodiment, cell 18*i* is rotated along its longitudinal axis relative to cell 18*h* such that actuation of cell 18*i* will impart lateral movement to cell 18*h* (and segments 14*a* and 14*b*).

Figure 10A:
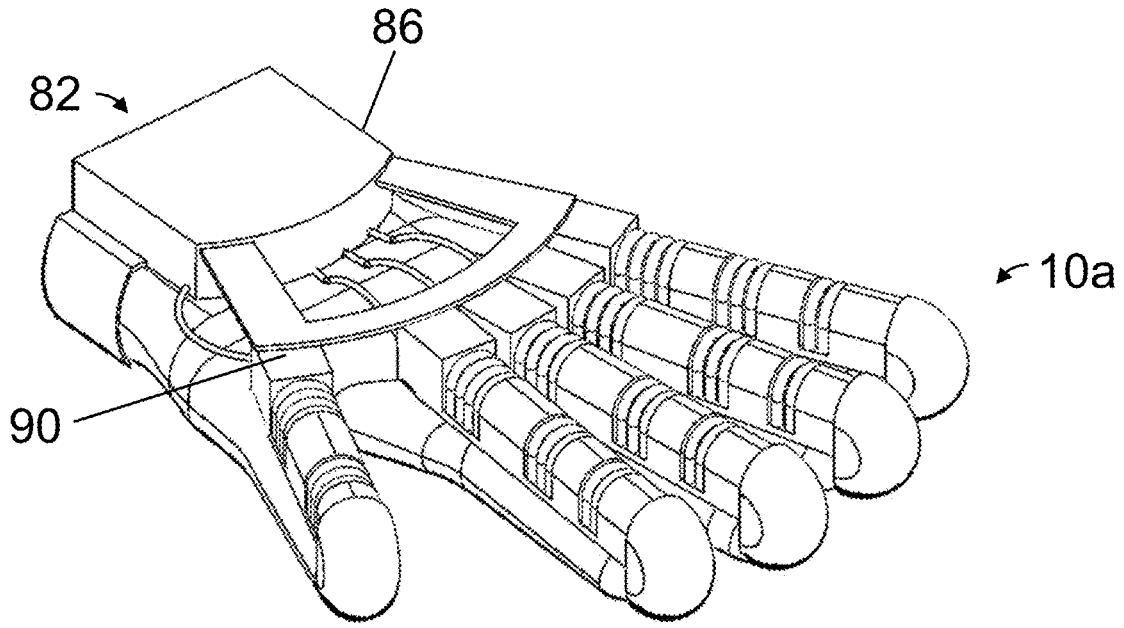
FIGS. 10A and 10B are perspective views of a first embodiment of the present manipulating apparatuses, shown coupled to a human hand.
Figure 10B:
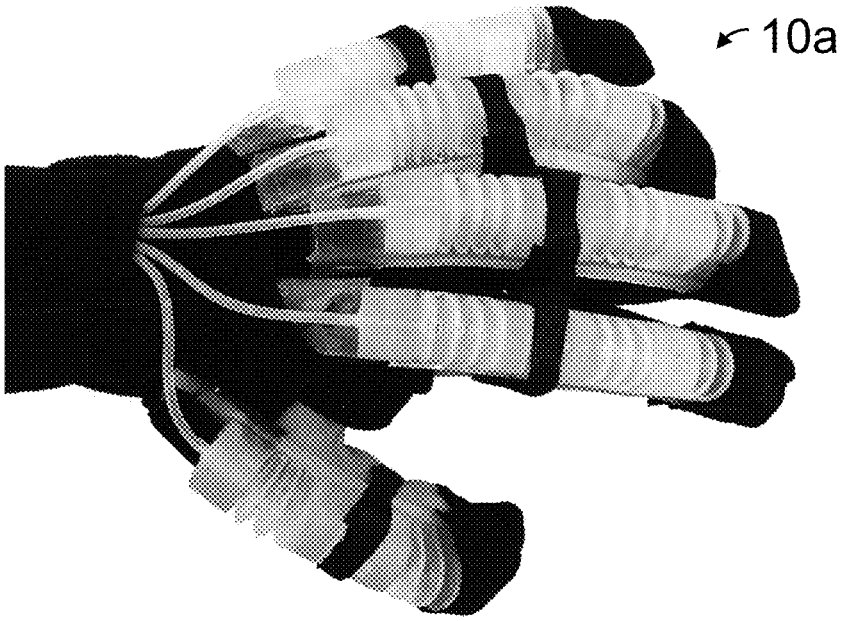

FIGS. 10A and 10B are perspective views of one embodiment 82 of the present manipulating apparatuses, shown coupled to a human hand. As shown, apparatus 82 comprises a plurality of actuators (e.g., 10*a*) (e.g., one for each of five human fingers of a human hand). While not necessarily required, in this embodiment, apparatus 82 comprises a frame or wearing fixture 86, which may be rigid, semi-rigid, or flexible where each of the plurality of actuators 10*a* is coupled to the frame or wearing fixture (e.g., which may, in turn, be coupled to a user's wrist such that apparatus 82 resembles an exoskeleton). In the depicted embodiment, each of actuators 10*a* are coupled to frame or wearing fixture 86 by way of a ball and socket coupler 90 (e.g., to allow a user to spread their fingers, with minimal to no interference by apparatus 82). However, in other embodiments, such coupling can be accomplished in any suitable fashion, such as, for example, through hook-and-loop fasteners, adhesive, other fasteners (e.g., nuts, bolts, screws, rivets, and/or the like), and/or the like. In some embodiments, an elastomeric cell (e.g., 18*g*) may be disposed between segments of adjacent actuators 10*a* such as to provide for abduction and/or adduction, in a same or a similar fashion to as described and shown above with respect to actuators 10*d* and 10*e*.

Some embodiments of the present actuators and/or manipulating apparatuses (e.g., 10*a*, 10*b*, 10*c*, 10*d*, 10*e*, 82, and/or the like) may be suitable for use during rehabilitation (e.g., after injury, reconstructive surgery, stroke, and/or the like). For example, some embodiments of the present methods for rehabilitating a human joint comprise coupling an actuator (e.g., 10*a*) across the human joint, the actuator comprising a semi-rigid or rigid first segment (e.g., 14*a*), a semi-rigid or rigid second segment (e.g., 14*b*), and a fluid-driven elastomeric cell (e.g., 18) disposed between the first segment and the second segment, and communicating fluid to the elastomeric cell to cause angular displacement of the second segment relative to the first segment (e.g., compare FIGS. 2A and 2B) to induce movement in the human joint (e.g., in a CPM mode, where the actuator encourages or assists movement in the human joint). At least through such inducement of motion, some embodiments of the present actuators and/or manipulating apparatuses may be used to, for example, improve range of motion, long term mobility of joints, soft-tissue compliance, and/or the like, promote healing and/or growth of cartilage and/or the like, mitigate edema, arthofibrosis, and/or the like, and/or the like (e.g., regardless of any neurological impairments).

Some embodiments of the present methods for rehabilitating a human joint comprise communicating fluid from an elastomeric cell (e.g., 18) to resist angular displacement of a second segment (e.g., 14*b*) relative to a first segment (e.g., 14*a*) to resist movement in the human joint (e.g., in an active resistive movement mode, where the actuator resists movement in the human joint) or prevent movement in the human joint (e.g., to immobilize the human joint, which may encourage healing). At least through such resistance to motion, some embodiments of the present actuators and/or manipulating apparatuses may be used to, for example, reduce joint spasticity, muscle atrophy, and/or the like, increase strength and/or the like, and/or the like.

Figure 11:
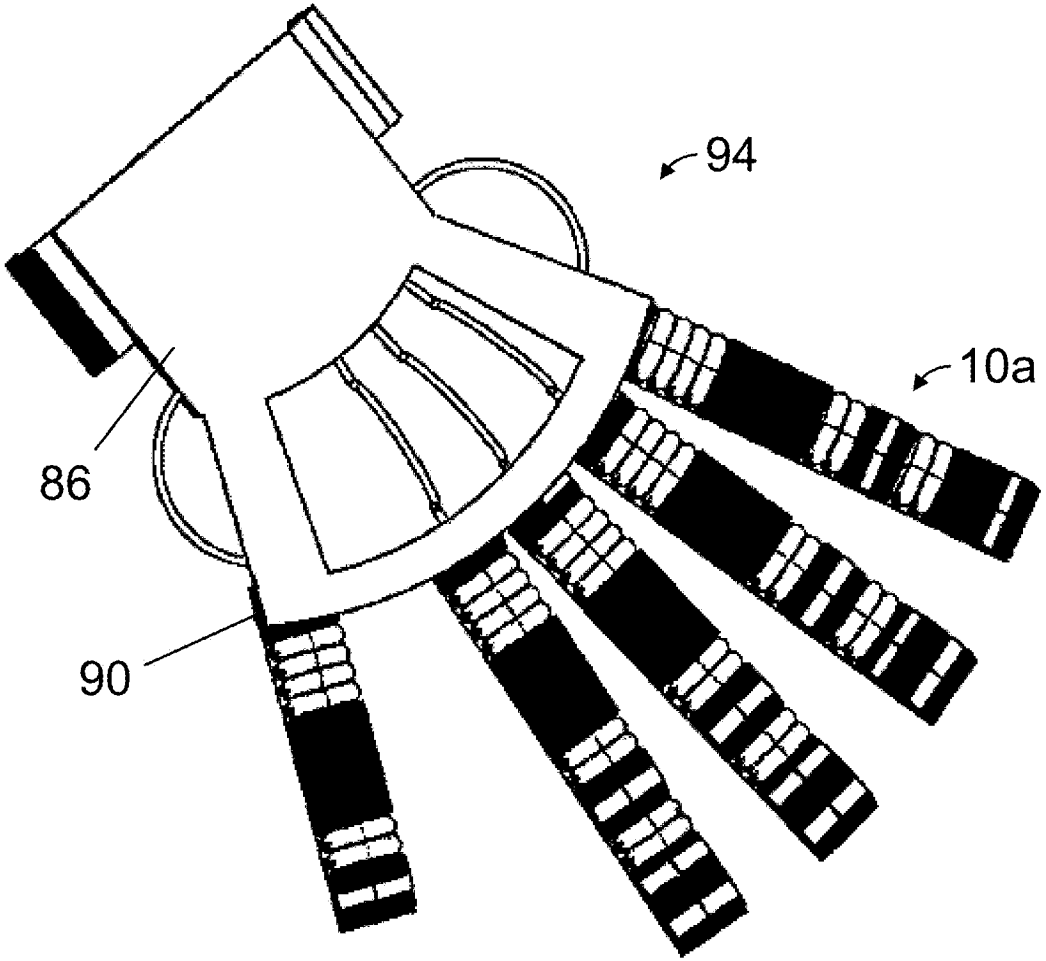
FIG. 11 is a top view of a second embodiment of the present manipulating apparatuses.

FIG. 11 is a top view of one embodiment 94 of the present manipulating apparatuses. Manipulating apparatus 94 is substantially similar to manipulating apparatus 82, with the primary exception that manipulating apparatus 94 is configured as robotic manipulator and/or end effector. In this embodiment, for example, ball and socket couplers 90 (e.g., in addition to one or more elastomeric cells 18) may be actively movable with one or more actuators (e.g., cells 18 and/or other types of actuators), which may be controlled via commands sent from a processor 76. Similarly to as described above, ball and socket couplers 90 are provided only by way of example, as coupling between an actuator (e.g., 10*a*) and a frame (e.g., 86) can be accomplished in any suitable fashion, such as, for example, through hook-and-loop fasteners, adhesive, other fasteners (e.g., nuts, bolts, screws, rivets, and/or the like), and/or the like.

Figure 12:
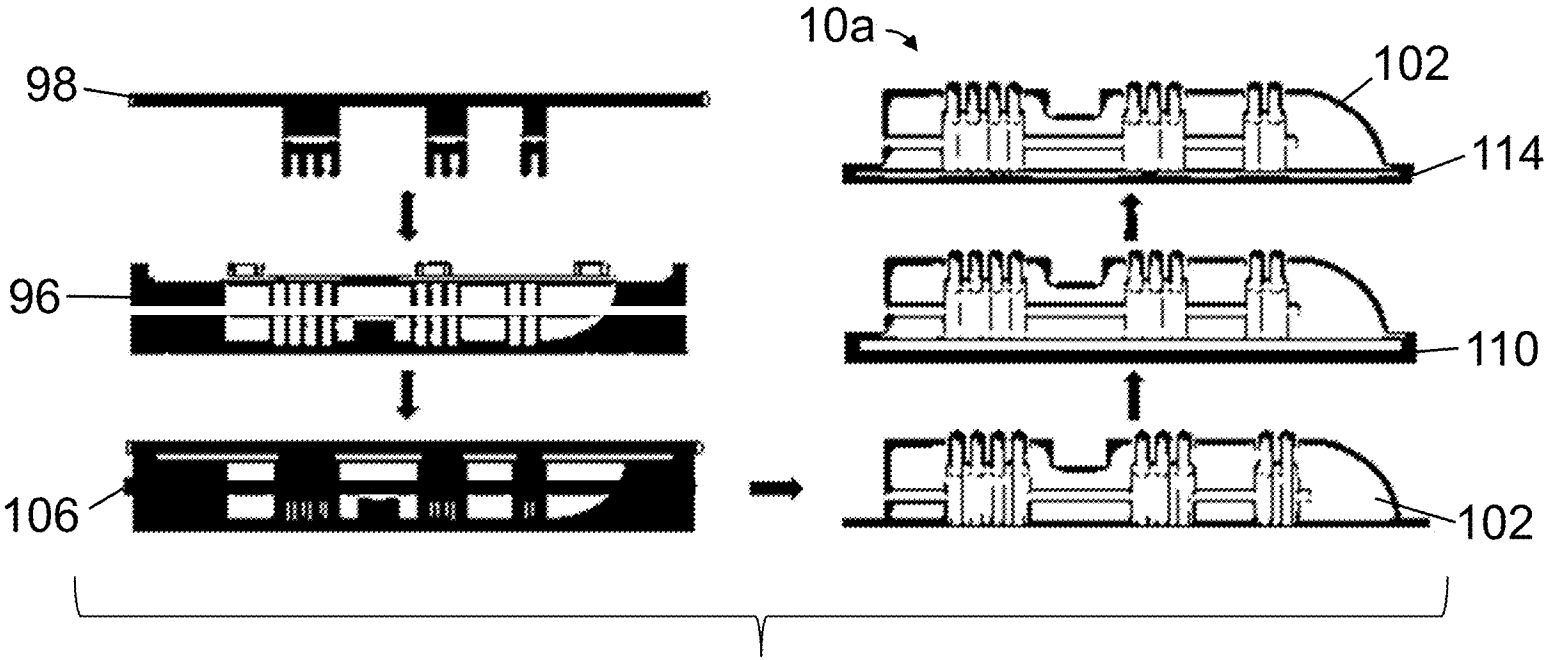
FIG. 12 depicts one embodiment of the present methods for making one embodiment of the present actuators.
Figure 13A:
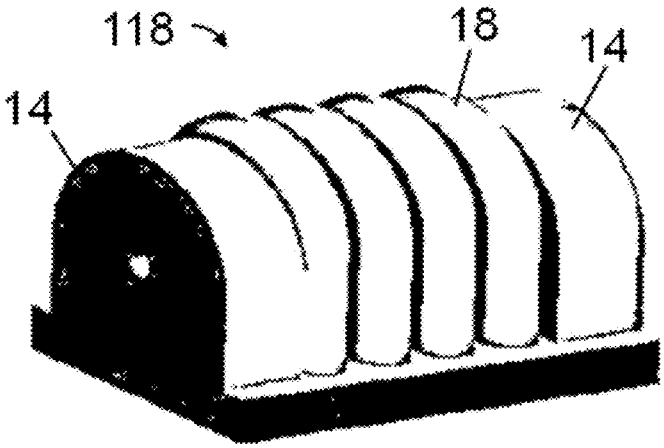
FIG. 13A is a perspective view of a model of one embodiment of the present actuators.
Figure 13B:
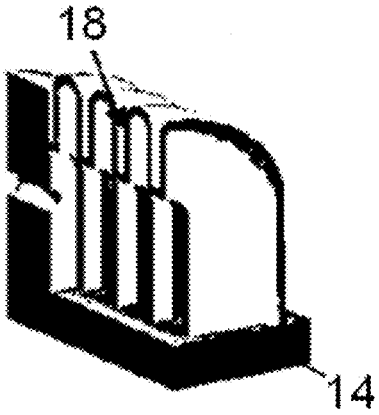
FIGS. 13B-13D are various cross-sectional views of the model of FIG. 13A.
Figure 13C:
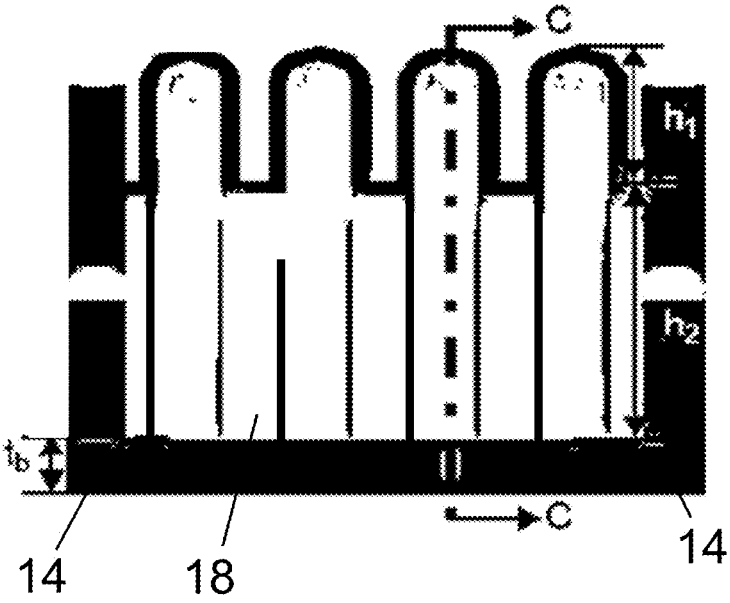
Figure 13D:
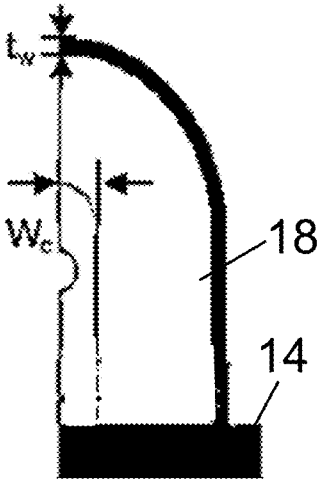

FIG. 12 depicts one embodiment of the present methods for making one embodiment of the present actuators. In the embodiment shown, an actuator (e.g., 10*a*) may be fabricated via a compression and over-molding process. In this embodiment, a first mold piece 96 and a second mold piece 98 (e.g., designed using computer-aided design software) may be used to form a first portion 102 of the actuator (e.g., which portion 102 at least partially defines segments 14 and/or elastomeric cells 18 or a portion of a sidewall 46 thereof). For example, in the depicted embodiment, a (e.g., polymeric) material may be poured into first mold piece 96, second mold piece 98 may be mated with the first mold piece, and the first and second mold pieces may be compressed. In the embodiment shown, a rod 106 may be inserted into and/or through the mated first and second mold pieces, 96 and 98, respectively (e.g., to a form fluid channel 30 within first portion 102). In this embodiment, material within the mated first and second mold pieces may be thermosetted and/or cured, the first and second mold pieces may be decoupled, and first portion 102 of the actuator may be removed from the mold pieces. In the depicted embodiment, a third mold piece 110 may be filled with a (e.g., polymeric) material and coupled to first portion 102, whereby the material may be thermosetted and/or cured to form a second portion 114 of the actuator (e.g., which second portion 114 at least partially defines segments 14 and/or elastomeric cells 18 or a portion of a sidewall 46 thereof) adjacent the first portion (e.g., to form an interface and/or overmolded bond between the first and second portions of the actuator). In at least this way, the actuator, and more particularly, elastomeric cells 18 thereof, may be tightly sealed (e.g., if the elastomeric cells are defined between first portion 102 and second portion 114).

Some embodiments of the present actuators may be designed using a finite element analysis [15]. FIGS. 13-21 depict various aspects of an example of such a design process, and are provided by way of illustration. In the example shown, a model 118 (FIGS. 13A-13D) of an actuator having an elastomeric cell 18 and two segments 14 was provided to determine relationships between certain variable design parameters and certain performance characteristics, including a range of motion, generated force, and/or the like (e.g., versus an internal pressure of the elastomeric cell), and operating internal pressures of the elastomeric cell. In this example, half of model actuator 118 was evaluated, due to, for example, symmetrical geometry and boundary conditions. In the example shown, a 3D 20-node solid tetrahedral element (e.g., an element that may be suitable for fully incompressible hyperelastic materials) was used to generate a mesh of model actuator 118. Some of the design parameters that were considered in the depicted example are included in TABLE 1, below, and many are indicated on actuator model 118 in FIGS. 13A-13D.

TABLE 1

Evaluated Design Parameters for each of 6 Simulation Runs

| Run # | $N_s$ | $t_w$ (mm) | $t_b$ (mm) | $h_1/h_2$ | $W_c$ (mm) | Material |
|---|---|---|---|---|---|---|
| 1 | 3 | 0.75 | 4 | 0.6 | 2.5 | PMC 724, RTV-4234-T4 |

TABLE 1-continued

Evaluated Design Parameters for each of 6 Simulation Runs

| Run # | $N_s$ | $t_w$ (mm) | $t_b$ (mm) | $h_1/h_2$ | $W_c$ (mm) | Material |
|---|---|---|---|---|---|---|
| 2 | 2, 3, 4 | 0.75 | 4 | 0.6 | 2.5 | RTV-4234-T4 |
| 3 | 3 | 0.5, 0.625, 0.75, 1, 1.25, 1.5 | 4 | 0.6 | 2.5 | RTV-4234-T4 |
| 4 | 3 | 0.75 | 3, 4, 5 | 0.6 | 2.5 | RTV-4234-T4 |
| 5 | 3 | 0.75 | 4 | 0.3, 0.6, 1.0 | 2.5 | RTV-4234-T4 |
| 6 | 3 | 0.75 | 4 | 0.6 | 2.5, 5.0 | RTV-4234-T4 |

In TABLE 1, above, $N_s$ represents the number of ridges on ridged or corrugated portions (e.g., 50, FIG. 1A) of an elastomeric cell. In the example shown, the Yeoh $3^{rd}$ model was used to represent hyperelastic behavior of elastomers. In this example, the Yeoh model parameters for RTV-4234-T4 and PMC-724 were calculated based on experimental data and are provided below in TABLE 2.

TABLE 2

Parameters of Yeoh $3^{rd}$ Model for Evaluated Elastomers

| Elastomer | $C_{10}$ (MPa) | $C_{20}$ (MPa) | $C_{30}$ (MPa) |
|---|---|---|---|
| RTV-4234-T4 | 0.194 | −0.023 | 0.021 |
| PMC-724 | 0.084 | −0.0031 | 0.0012 |

In this example, each simulation run was used to systematically evaluate the effect of each design parameter on system performance characteristics, and the results were used to identify potentially desirable design parameters for an actuator (e.g., an actuator configured to be coupled to a human finger).

Figure 14:
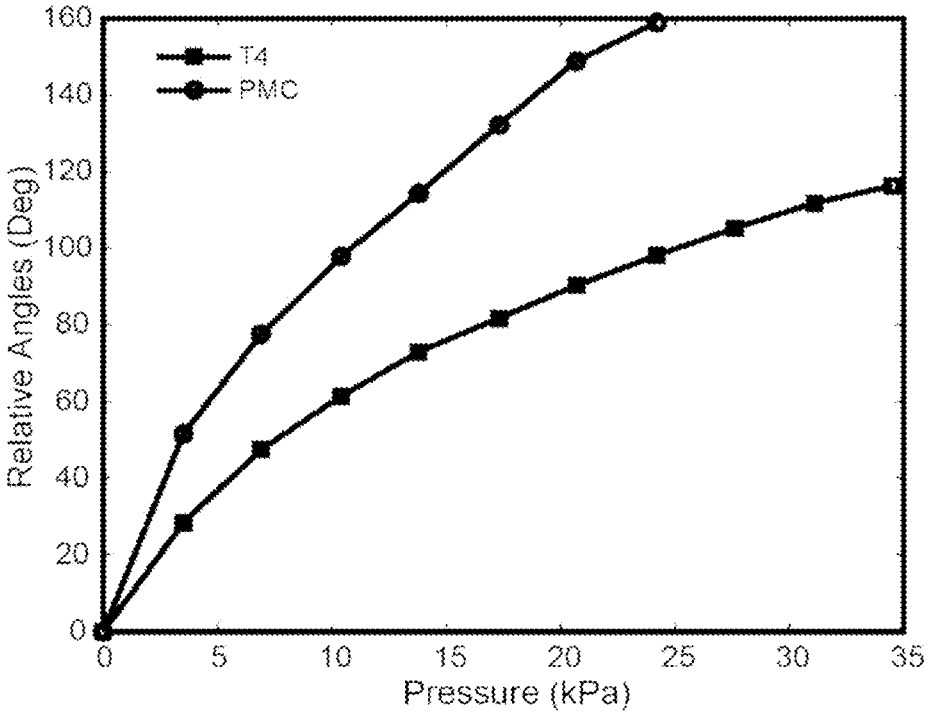
FIG. 14 is a graph of range of motion versus internal cell pressure for two actuators, each comprising a different material.

In the depicted example, simulation run 1 compared range of motion and generated force versus internal cell pressure for two otherwise identical actuators, one comprising PMC-724 and one comprising RTC-4234. FIG. 14 shows a simulation of range of motion versus internal cell pressure for the actuator comprising PMC-724 and the actuator comprising RTC-4234. As shown, the actuator comprising PMC-724 reached a range of motion of 100 degrees at an internal cell pressure of 10.4 kilopascals (kPa), which is lower than the internal cell pressure of 24.2 kPa required for the actuator comprising RTV-4234-T4 to reach the same range of motion. Furthermore, the force generated by the actuator comprising PMC-724 at a range of motion of 100 degrees was 0.32 newtons (N), which is lower than the 0.8 N generated by the actuator comprising RTV-4234-T4 at the same range of motion. Considering the greater range of motion and generated force provided by the actuator comprising PMC-724 at a lower internal cell pressure (e.g., when compared to the actuator comprising RTV-4232-T4) (e.g., which may be desirable, particularly in certain CPM applications), in this example, actuators comprising PMC-724 were selected for further evaluation.

Figure 15:
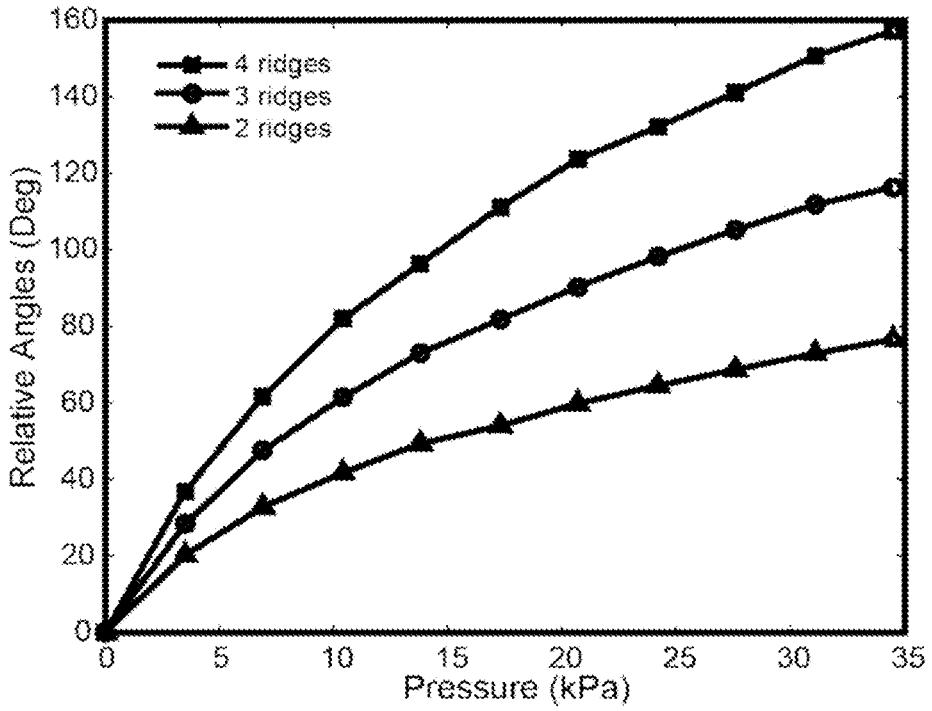
FIG. 15 is a graph of range of motion versus internal cell pressures for three actuators, each having a different number of ridges.

In the depicted example, simulation run 2 compared range of motion versus internal cell pressure for three otherwise identical actuators, each comprising a cell having 2, 3, or 4, ridges respectively. The results of simulation run 2 are depicted in FIG. 15. As shown, at an internal cell pressures of 35 kPa, the actuator comprising a cell with 2-ridges (the "2-ridge actuator") achieved a range of motion 77 degrees, the 3-ridge actuator achieved a range of motion of 116 degrees, and the 4-ridge actuator achieved a range of motion of 156 degrees. Suitable ranges of motion for a joint on a human finger may vary depending on the joint; for example, a suitable range of motion may be 72 degrees for a distal interphalangeal (DIP) joint, 90 degrees for a metacarpophalangeal (MCP) joint, 100 degrees for a proximal interphalangeal (PIP) joint, and 80 degrees for other interphalangeal joints [16, 17]. Likewise, for a human thumb, a suitable range of motion may be 60 degrees for the MCP joint and 80 degrees for the interphalangeal (IP) joint [16, 17]. In designing embodiments of the present actuators for use coupled to a human finger or thumb, such suitable ranges of motion may be considered (e.g., along with dimensions of the human finger or thumb). For example, based at least in part on the results of simulation run 2, actuators configured to be coupled to a human finger having a 4-ridge cell corresponding to the MIP joint, a 3-ridge cell corresponding to the PIP joint, and a 2-ridge cell corresponding to the DIP joint may be desirable. For similar reasons, and considering the relatively small dimensions of a human thumb, actuators configured to be coupled to a human thumb having two 3-ridge cells, each corresponding to the MCP joint and IP joint, respectively, may be desirable.

Figure 16A:
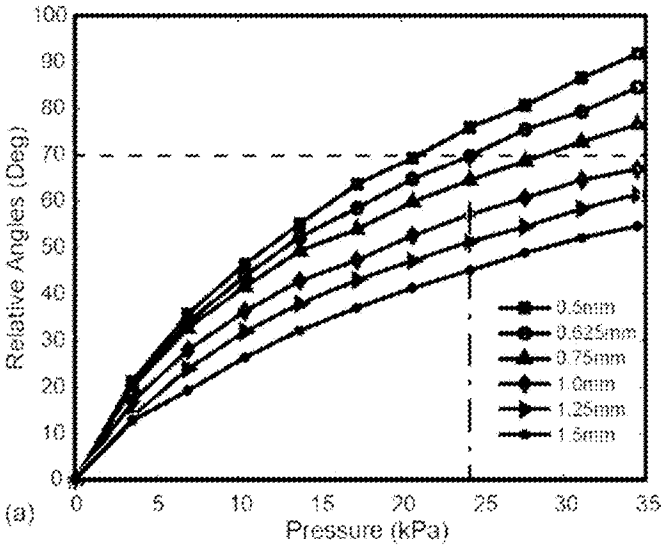
FIGS. 16A-16C are graphs showing ranges of motion versus internal cell pressures for actuators having various numbers of ridges and various upper elastomeric cell wall thicknesses.
Figure 16C:
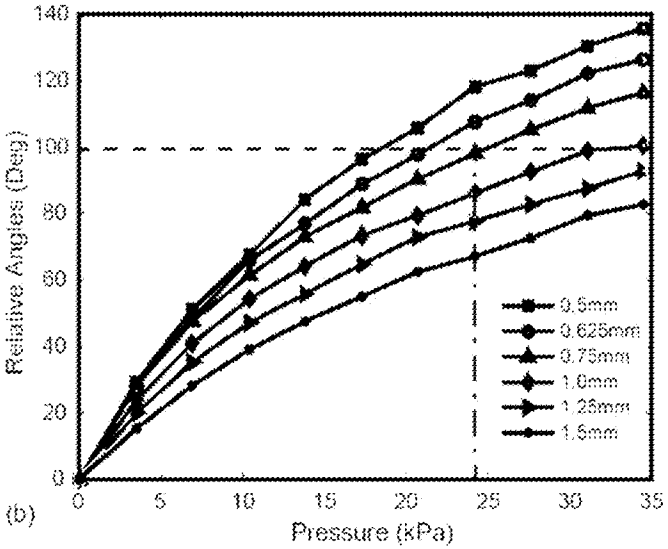
Figure 16B:
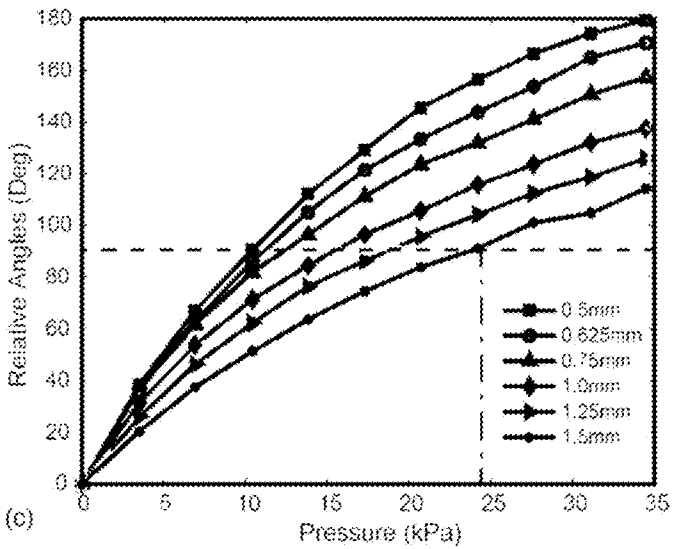

In this example, simulation run 3 compared range of motion versus internal cell pressure for 2-ridge, 3-ridge, and 4-ridge actuators of varying upper elastomeric cell 18 wall thicknesses ($t_w$). The results of simulation run 3 are depicted in FIG. 16A for the 2-ridge actuators, FIG. 16B for the 3-ridge actuators, and in FIG. 16C for the 4-ridge actuators. From FIGS. 16A-16C, it can be seen that upper cell wall thickness has an effect on range of motion for a given actuator. As shown, in general, actuators having thinner upper cell wall thicknesses achieve larger ranges of motion at lower internal cell pressures than do actuators having thicker upper cell wall thicknesses. To illustrate, in the example shown, a 2-ridge actuator having an upper cell wall thickness of 0.5 mm achieved a range of motion of 70 degrees at an internal cell pressure of 20.4 kPa, while a 2-ridge actuator having an upper cell wall thickness of 1.5 mm would require an internal cell pressure above 35 kPa to achieve a range of motion of 70 degrees. As shown by the dash-dot lines in FIGS. 16A-16C, a suitable range of motion for all joints of a human finger may be achieved by an actuator having an elastomeric cell corresponding to a DIP joint with an upper cell wall thickness of 0.625 mm, an elastomeric cell corresponding to a PIP joint with an upper cell wall thickness of 0.75 mm, and an elastomeric cell corresponding to an MCP joint with an upper cell wall thickness of 1.50 mm.

Figure 17:
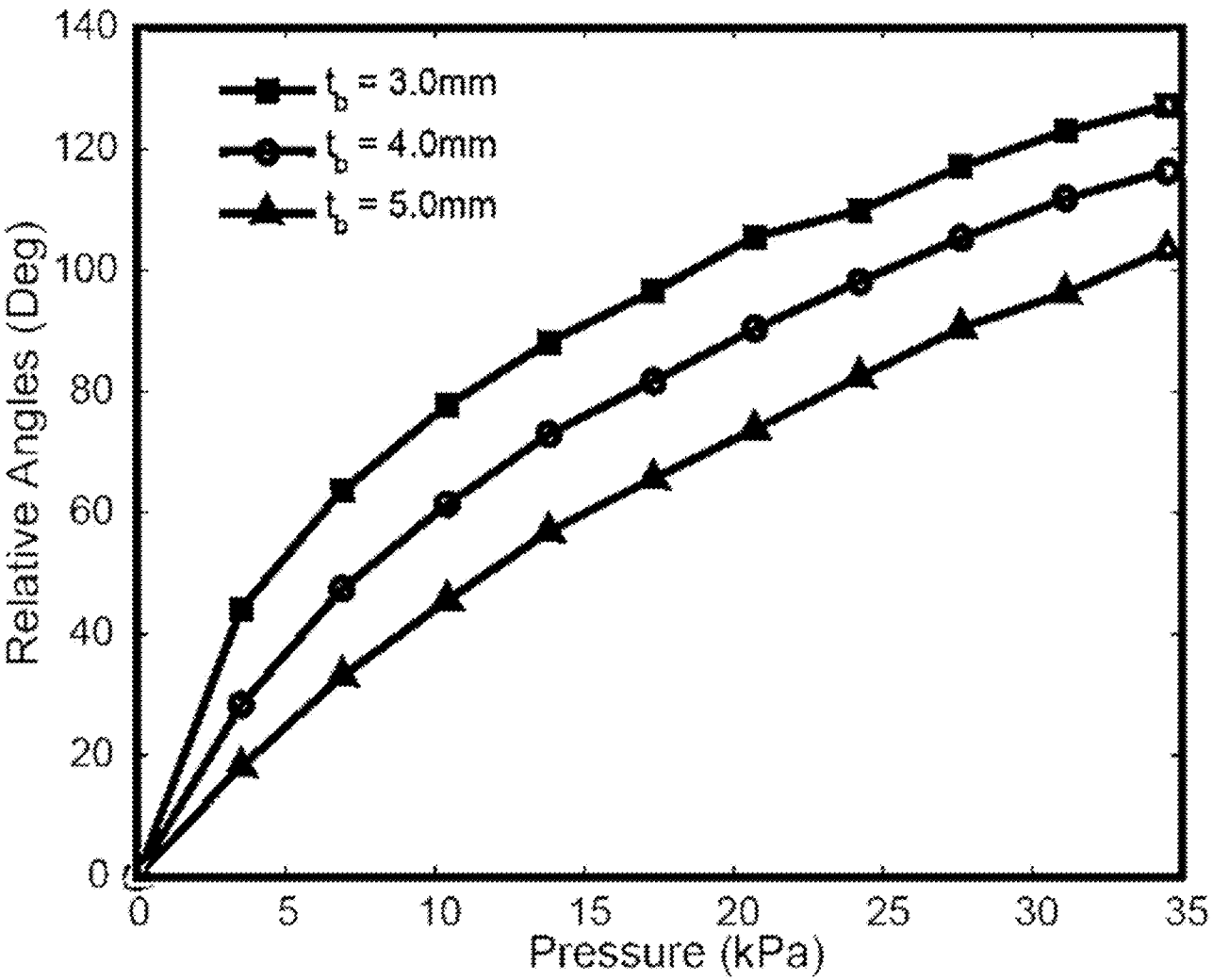
FIG. 17 is a graph of range of motion versus internal cell pressures for three actuators, each having a different base thickness.

In the depicted example, simulation run 4 compared range of motion versus internal cell pressure for three 3-ridge actuators, which although otherwise identical, each comprise an elastomeric cell having a base thickness ($t_b$) (e.g., a base wall thickness) (e.g., second thickness 70, FIG. 1B) of 3 mm, 4 mm, and 5 mm, respectively. The results of simulation run 4 are depicted in FIG. 17. As can be seen in FIG. 17, in general, actuators having elastomeric cells with larger base thicknesses require higher internal cell pressures to reach a given range of motion. For example, as shown, an actuator having a base thickness of 3 mm achieved a range of motion of 100 degrees at internal cell pressures of 17.3 kPa, compared to an actuator having a base thickness of 4 mm and an actuator having a base thickness of 5 mm, which achieved the same range of motion at internal cell pressures of 24.2 kPa and 35 kPa, respectively.

Figure 18:
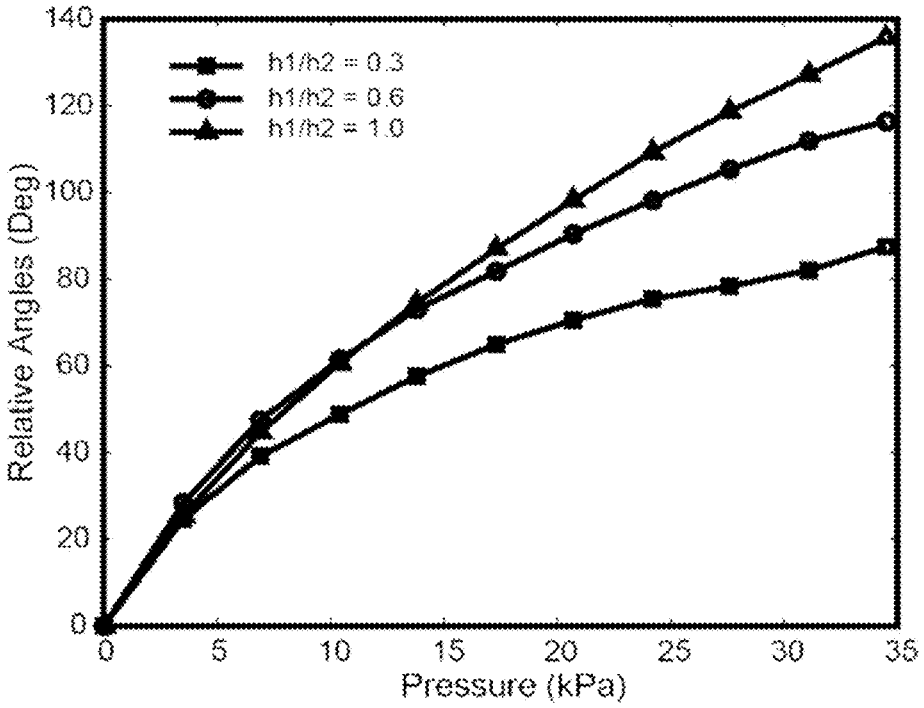
FIG. 18 is a graph of range of motion versus internal cell pressures for three actuators, each having a different elastomeric cell sidewall configuration.

In the example shown, simulation run 5 compared range of motion versus internal cell pressure for three actuators, which although otherwise identical, each comprise an elastomeric cell having a ratio of h1 to h2 (FIG. 13D) of 0.3, 0.6, and 1.0, respectively (e.g., a ratio indicative of a relationship between a maximum external height of the cell to a minimum external height of the cell). The results of simulation run 5 are depicted in FIG. 18. As can be seen in FIG. 18, in general, actuators having elastomeric cells with higher h1 to h2 ratios require lower internal cell pressures to achieve a given range of motion. To illustrate, in the example shown, an actuator having an elastomeric cell with an h1 to h2 ratio of 0.3 would reach a range of motion of 100 degrees at an internal cell pressure higher than 35 kPA, while actuators having elastomeric cells with ratios of h1 to h2 of 0.6 and 1.0 may achieve a range of motion of 100 degrees at internal cell pressures of 24.2 kPa and 20.7 kPa, respectively.

Figure 19:
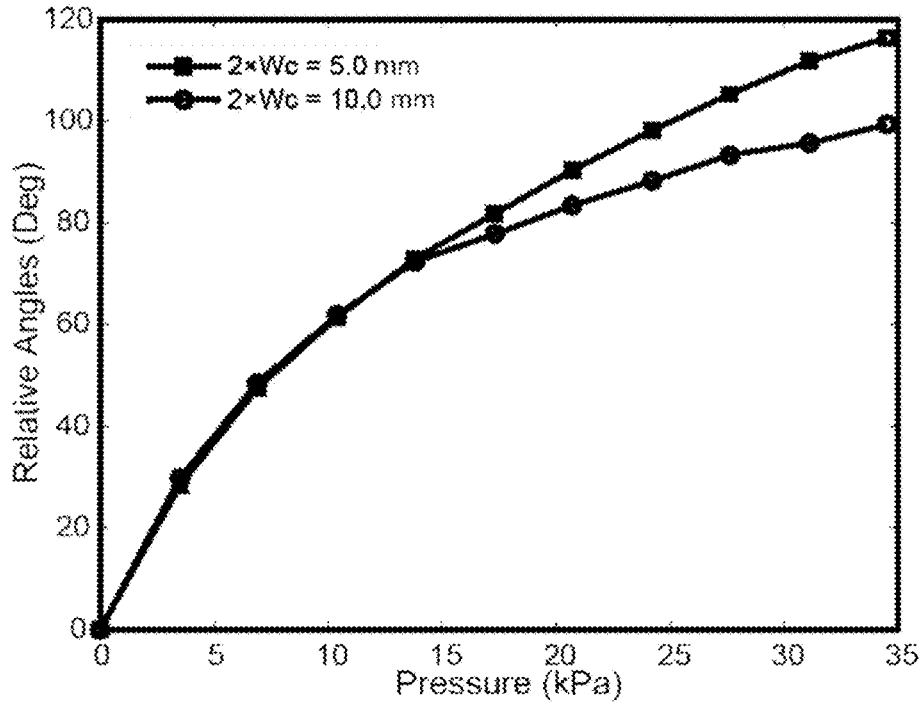
FIG. 19 is a graph of range of motion versus internal cell pressures for two actuators, each having an elastomeric cell with a different minimum internal width.

In this example, simulation run 6 compared range of motion versus internal cell pressure for two actuators, which although otherwise identical, each comprise an elastomeric cell having a minimum internal width (two times $w_c$) of 5 mm and 10 mm, respectively. The results of simulation run 6 are depicted in FIG. 19. As shown in FIG. 19, in the depicted example, the effect of minimum internal cell width on range of motion of an actuator may be relatively small for internal cell pressures below 13.8 kPa. Nevertheless, in the example shown, at internal cell pressures above 13.8 kPa, actuators having elastomeric cells with smaller minimum internal widths may achieve larger ranges of motion than actuators having elastomeric cells with larger minimum internal widths (e.g., which may be a result of smaller minimum internal widths providing for elastomeric cells having deeper ridges that allow for increased cell expansion).

Figure 20A:
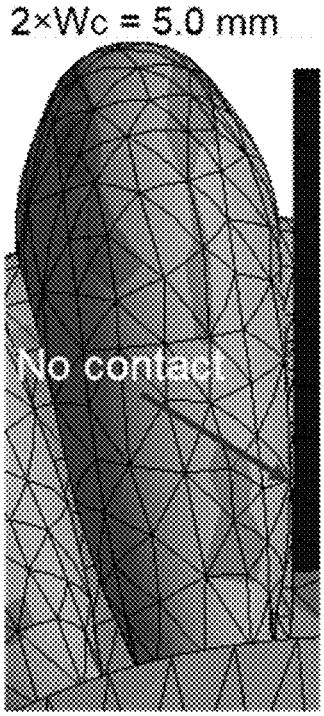
FIGS. 20A-20D depict simulated actuations of the actuators of FIG. 19.
Figure 20C:
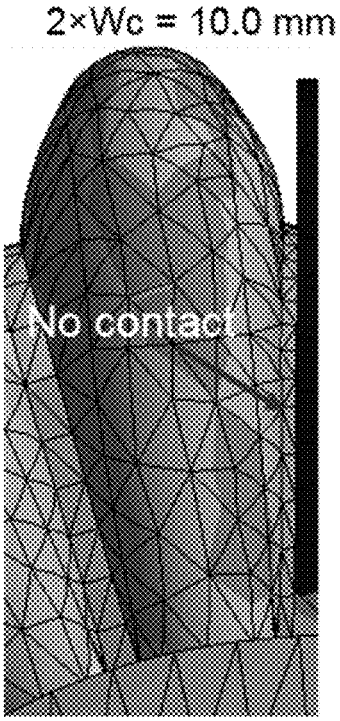
Figure 20B:
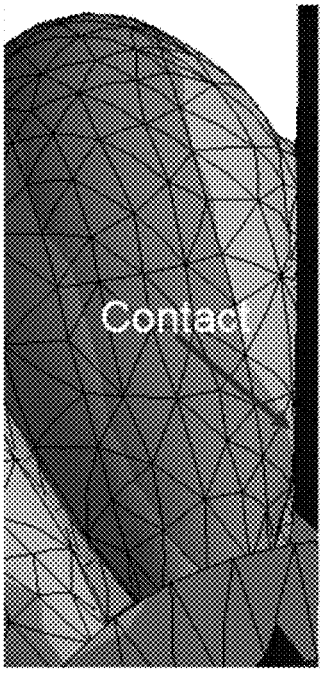
Figure 20D:
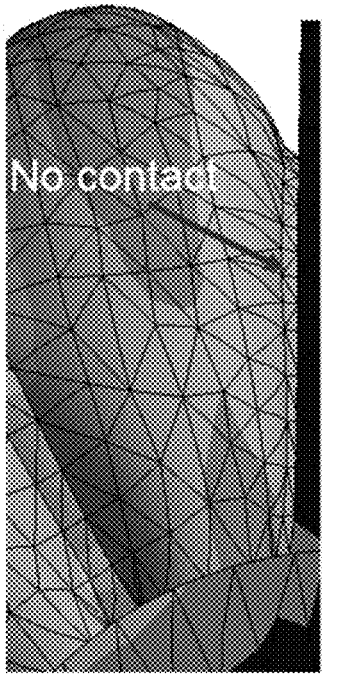

FIGS. 20A-20D depict the two actuators analyzed in simulation run 6 at internal cell pressures of 6.9 kPa (FIGS. 20A and 20C, respectively) and 24.2 kPa (FIGS. 20B and 20D, respectively). As shown, at an internal cell pressure of 6.9 kPa, the two actuators may behave similarly to one another. However, at an internal cell pressure of 24.2 kPa, adjacent ridges of the elastomeric cell having a minimum internal width of 5 mm may contact one another (e.g., thus providing for enhanced transfer of force through the elastomeric cell, and thus greater range of motion); such behavior was not observed for the elastomeric cell having a minimum internal width of 10 mm.

Figure 21:
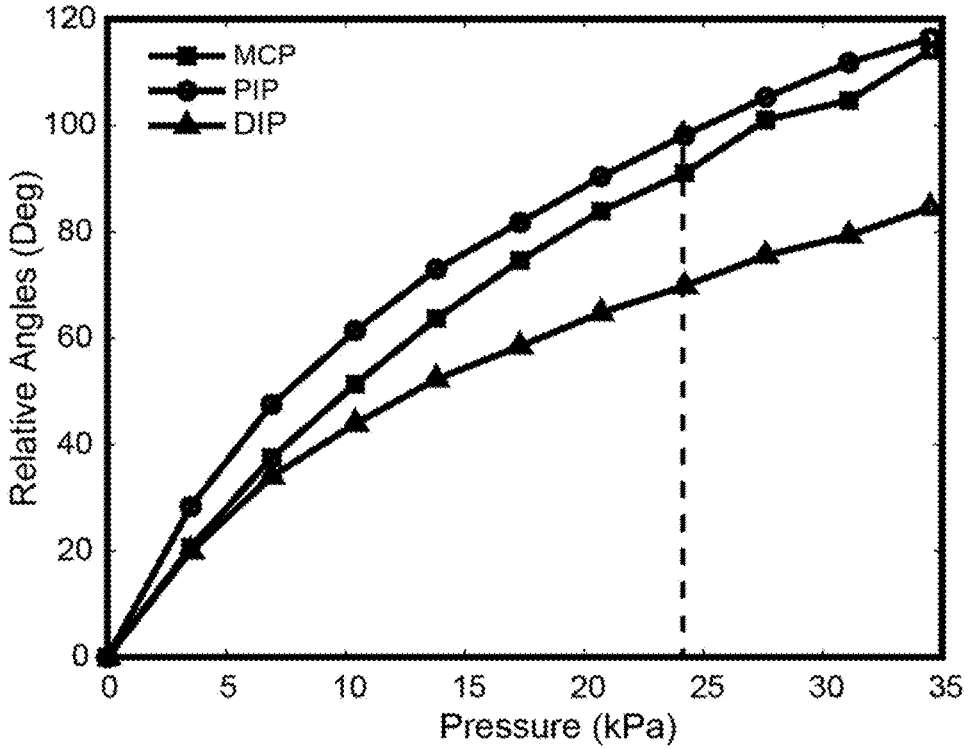
FIG. 21 is a graph of ranges of motion versus internal cell pressures for one embodiment of the present actuators.

Based at least in part on the exemplary simulations, provided above, one example of an actuator suitable for coupling to a human finger may comprise: a 4-ridge elastomeric cell corresponding to an MCP joint and having an upper cell wall thickness of 1.5 mm, a 3-ridge elastomeric cell corresponding to a PCP joint and having an upper cell wall thickness of 0.75 mm, and a 2-ridge elastomeric cell corresponding to a DIP joint and having an upper cell wall thickness of 0.625 mm, each elastomeric cell having a base thickness of 4 mm, a ratio of h1 to h2 of 0.6, and a minimum internal cell width of 5 mm. FIG. 21 is a graph showing range of motion versus internal cell pressures for such an actuator (e.g., where each joint of the actuator is simulated individually, for example, by using model actuator 118 of FIGS. 13A-13D or a similar model to simulate each joint). As shown, at internal cell pressures at or below 24.2 kPa, such an actuator is capable of a range of motion at each elastomeric cell is suitable for a respective joint of a human finger.

Figure 22:
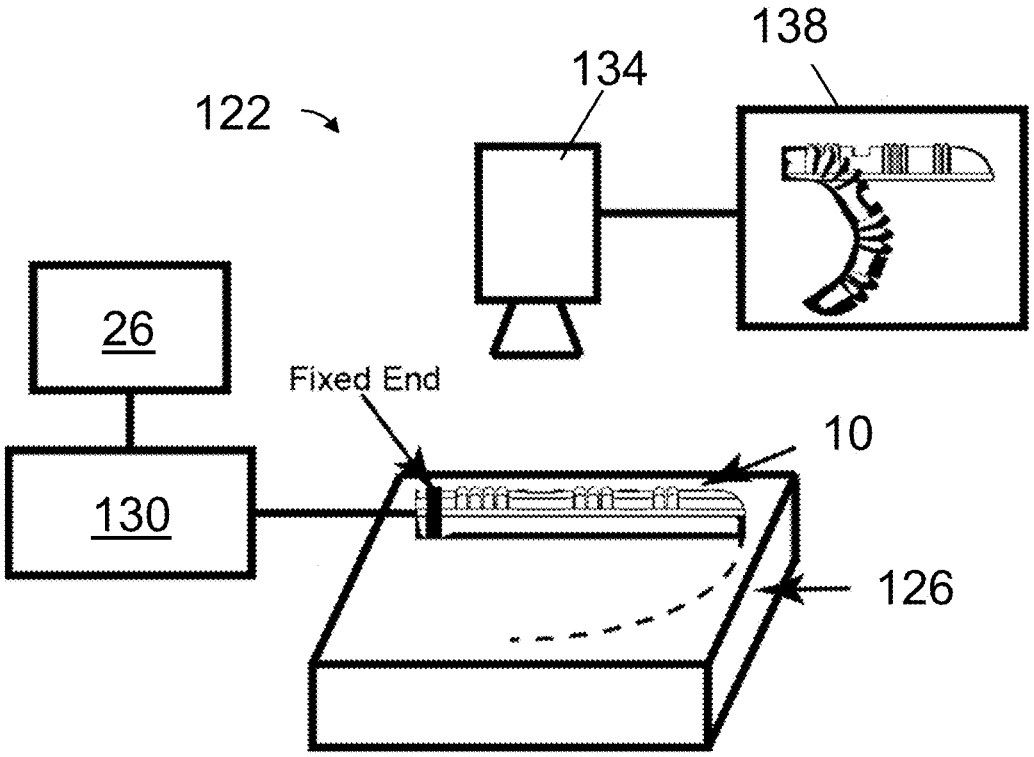
FIG. 22 is a diagram of an apparatus, which may be used for testing some embodiments of the present actuators.

Referring now to FIG. 22, shown is an apparatus 122 that may be used for testing of some embodiments of the present actuators. In the embodiment shown, apparatus 122 includes a platform 126 on which an embodiment of the present actuators (e.g., 10) may be mounted (e.g., and fixed at one or more portions, such as at a proximal end of the actuator, as shown). In this embodiment, apparatus 122 includes a fluid source 26 coupled to the actuator and configured to supply fluid to the actuator (e.g., via a tube, such as, for example, a tube having an internal diameter of approximately 1.6 mm). In the depicted embodiment, apparatus 122 comprises a regulator 130 configured to regulate fluid source 26.

Figure 23A:
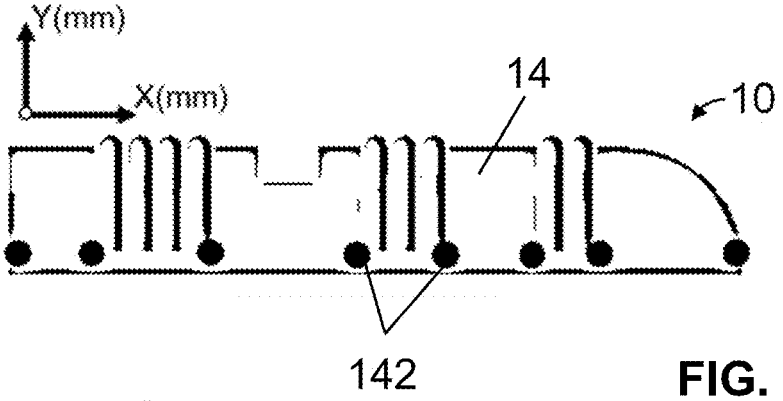
FIGS. 23A and 23B depict one embodiment of the present apparatuses during testing.
Figure 23B:
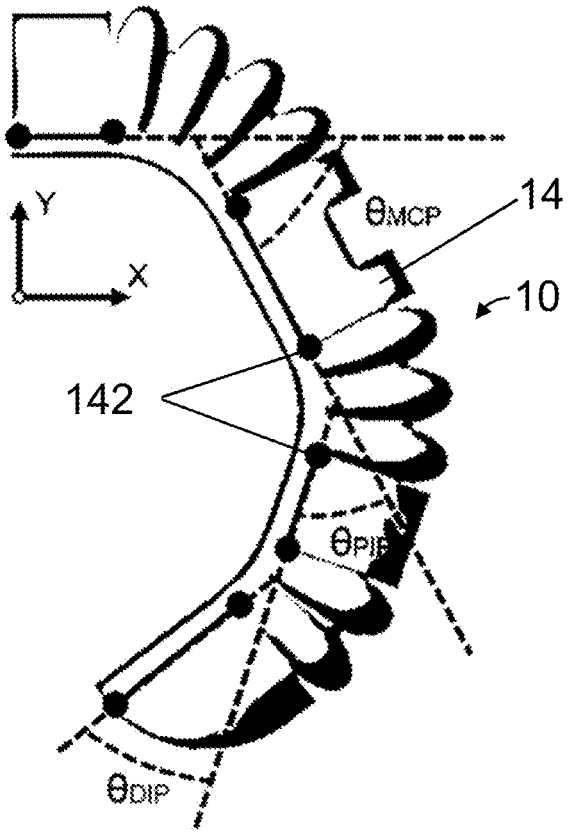

In the embodiment shown, apparatus 122 comprises a sensor 134 configured to capture data indicative of a position of at least a portion of the actuator (e.g., relative to platform 126). In this embodiment, sensor 134 comprises a camera (e.g., a 16 megapixel camera); however, in other embodiments, a sensor (e.g., 134) can comprise any sensor capable of providing the functionality of this disclosure. In the depicted embodiment, apparatus 122 comprises a processor 138 (e.g., computer) configured to receive data captured by sensor 134 and process the data to determine, for example, the position of at least a portion of the actuator, such as a segment of the actuator, relative to other segments of the actuator and/or relative to platform 126. Such position determinations may be facilitated by markers 142 (e.g., as shown in FIGS. 23A and 23B), which may be placed on segments 14 of the actuator to enhance tracking of the segments by sensor 134 and/or processor 138.

Using any suitable testing apparatus, such as, for example apparatus 122, may facilitate the quantification of certain performance characteristics for a given actuator, including a range of motion, and/or the like (e.g., versus internal pressure(s) of one or more elastomeric cells), and operating internal pressure(s) of one or more elastomeric cells. For example, FIGS. 24A-24D depict an example of an actuator actuation, where an internal pressure of each elastomeric cell of the actuator was increased simultaneously from 0 kPa (FIG. 24A) to 35 kPa (FIG. 24D).

Figure 26:
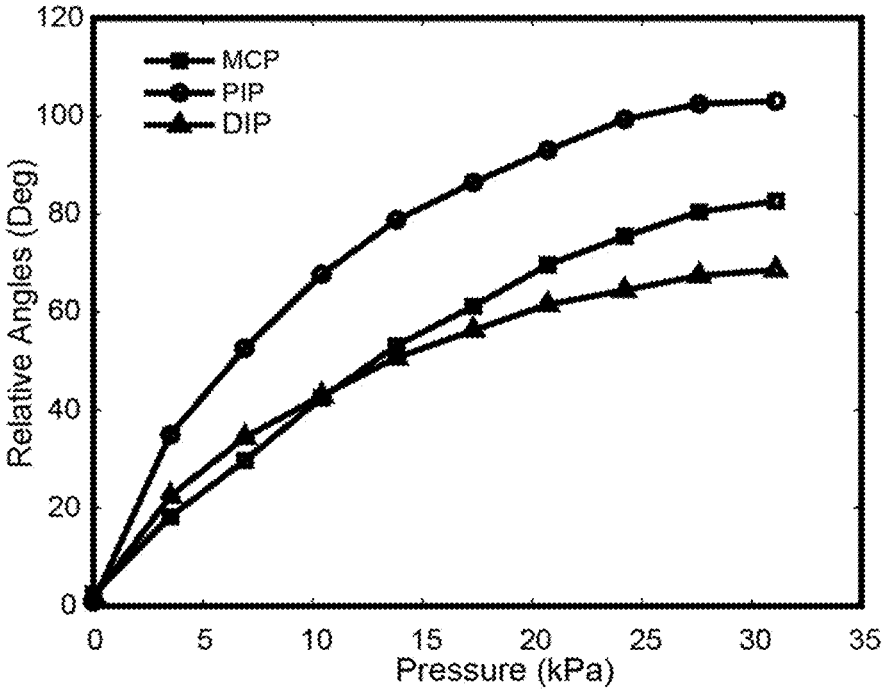
FIG. 26 is a graph of ranges of motion versus internal cell pressures for one embodiment of the present actuators.
Figure 25:
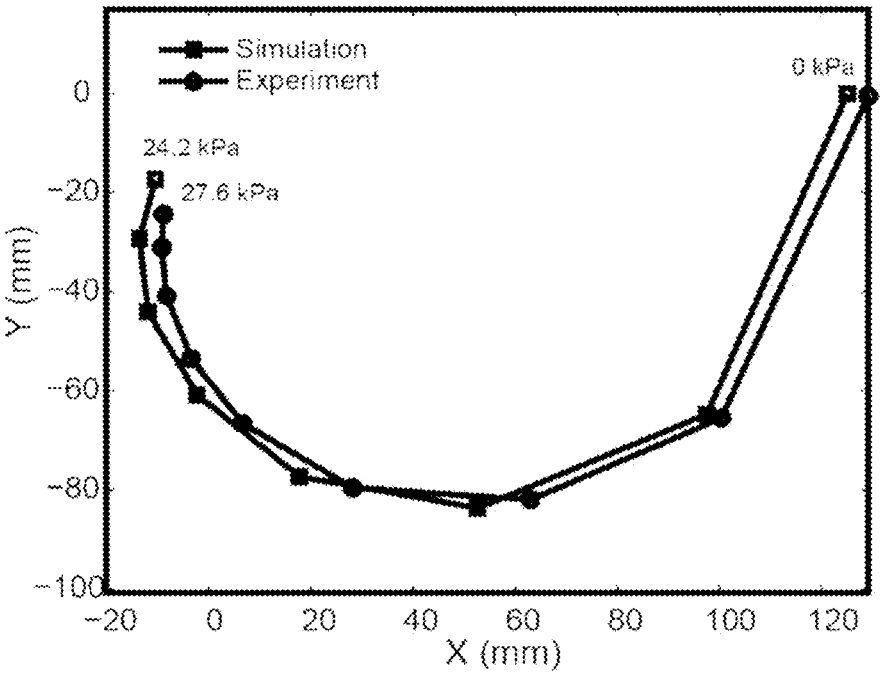
FIG. 25 is a graph showing, for one embodiment of the present actuators, a distal end trajectory during actuation.

FIG. 25 depicts actuator distal end (e.g., tip) trajectories obtained (e.g., through use of apparatus 122) from the actuation depicted in FIGS. 24A-24D as well as actuator distal end trajectories obtained from a simulation of the actuator (e.g., as described above). As shown, the actual and simulated distal end trajectories generally agree and only minor deviations are present. Also shown in FIG. 25, internal cell pressures required for full range of motion of the actual actuator were 27.6 kPa (as compared to 24.2 kPa for the simulated actuator). Notably, these values are lower than reported internal cell pressures required for full range of motion for other actuators of a similar type (e.g., 39 kPa for a simulation and 43 kPa for an experiments [13], 345 kPa [14], and 200 kPa [18]). FIG. 26 is a graph showing range of motion for each cell of the actuator and actuation depicted in FIGS. 24A-24D. The ranges of motion shown in FIG. 26 generally agree with the ranges of motion predicted by the simulations (FIG. 21).

Figure 27:
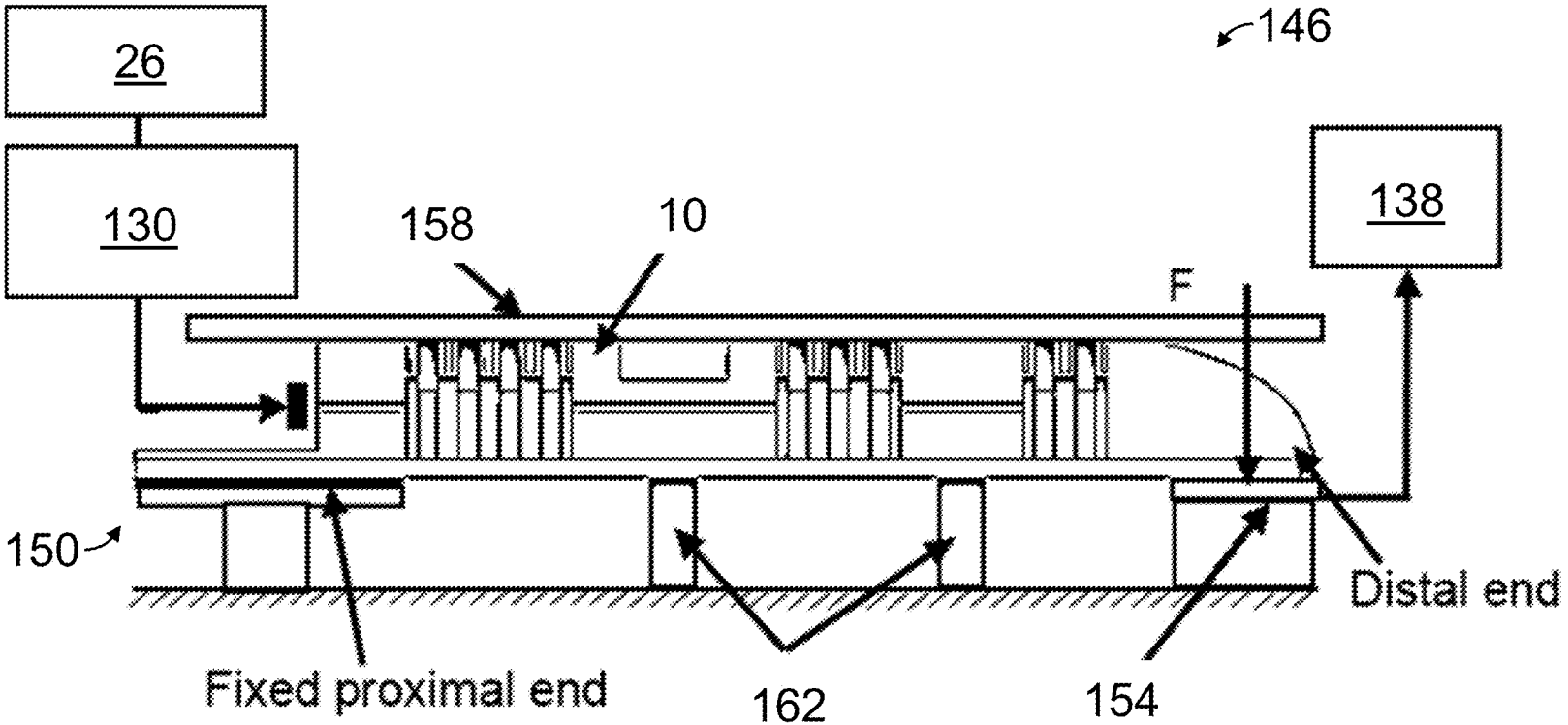
FIG. 27 is a diagram of an apparatus, which may be used for testing some embodiments of the present actuators.

Referring now to FIG. 27, shown is an apparatus 146 that may be used for testing of some embodiments of the present actuators. In the embodiment shown and similarly to apparatus 142, apparatus 146 comprises a fluid source 26, regulator 130, and processor 138. In this embodiment, apparatus 146 comprises a mount 150 configured to secure an embodiment of the present actuators (e.g., 10) such that a force generated by the actuator (e.g., by a distal end of the actuator) may be measured by a load cell 154. For example, in the depicted embodiment, mount 150 is configured to fixedly secure at least a portion of the actuator, such as a proximal end of the actuator, relative to load cell 154. In the embodiment shown, mount 150 comprises a rigid retaining member 158 (e.g., a rigid plate) configured to constrain the degrees of freedom in which the actuator is permitted to move (e.g., to enhance accuracy of force measurements obtained from data captured by load cell 154). In this embodiment, mount 150 includes one or more supports 162, which may be placed relative to the actuator to simulate coupling of the actuator to a human finger.

Figure 28:
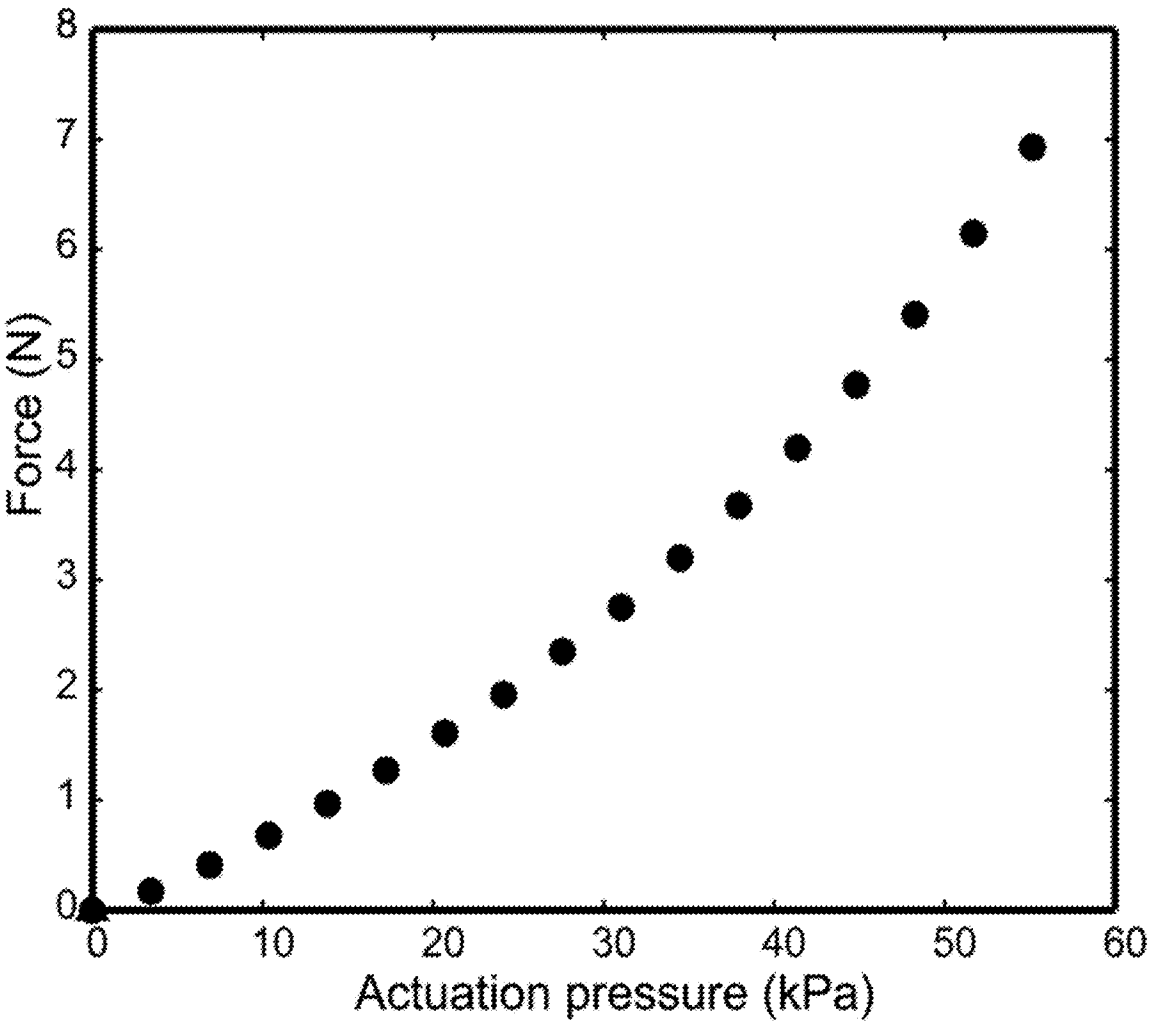
FIG. 28 is a graph showing, for one embodiment of the present actuators, a force generated by a distal end of the actuator versus internal cell pressures.

Using any suitable testing apparatus, such as, for example apparatus 146, may facilitate the quantification of certain performance characteristics for a given actuator, including a generated force, and/or the like (e.g., versus internal pressure(s) of one or more elastomeric cells), and operating internal pressure(s) of one or more elastomeric cells. For example, as shown in FIG. 28, using apparatus 146, measurements of force generated by a distal end of an actuator comprising RTV-4234-T4 were obtained. The data depicted in FIG. 28 was obtained by increasing the internal pressure of the elastomeric cells of the actuator from 0 to 55 kPa in increments of 3.45 kPa. As shown, the force generated by the distal end of the actuator reached values of approximately 7 N (e.g., which corresponds to a torque generated by the distal end of the actuator of approximately 0.77 newton-meters (Nm)). Notably, such force and torque values are higher than those reported for some existing hand rehabilitation devices and hand motion assist exoskeletons [2, 14, 19].

Referring now to FIGS. 29-33, the cells (e.g., elastomeric cells) of the present actuators may, in some variations, include a ridged or corrugated portion 50 that has ridges (e.g., 44) of varying profiles (e.g., varying in height, shape, width, thickness, spacing between ridges, and/or the like). Additionally, a base or smooth portion 54 may have any of various profiles (e.g., flat or planar, concave, convex, and/or the like) and/or its profile may vary between cells or within a single cell. In some embodiments, a base or smooth portion 54 (and/or other portions of a sidewall 46) can comprise a single type of material or multiple materials (e.g., composite materials). For example, a sidewall 46 may include objects, structures, or components, which may be embedded in the sidewall, such as, for example, fabric, carbon fiber, metal, plastics, strings, pressure sensors, force sensors, strain sensors, etc. By way of further example, a sidewall 46 may be solid or may include hollow voids that may be filled with air or other fluids to adjust certain mechanical properties (e.g., stiffness) of the sidewall. Further, various ones of the present actuators and cells may be combined in different configurations, in parallel, in sequence, perpendicular, or forming an angle, such as, for example, as described in more detail above and below.

Figure 29:
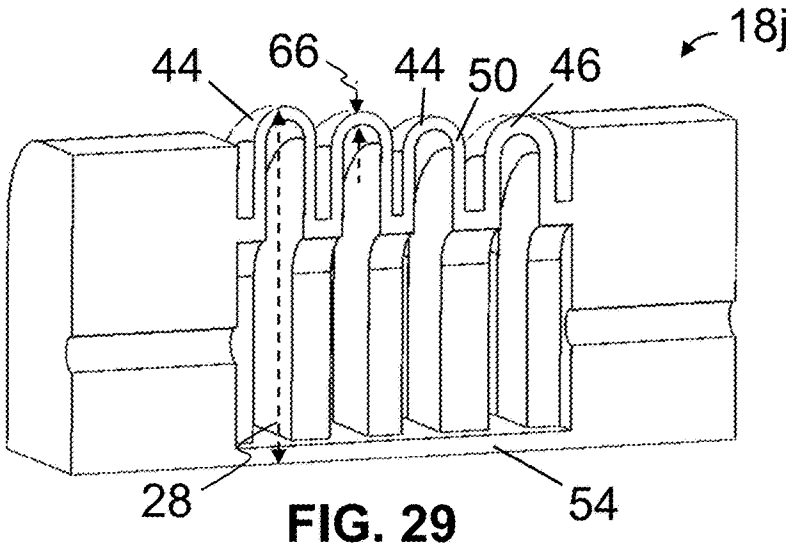
FIG. 29 is a cross-sectional view of a variation of a cell for the present actuators.

FIG. 29 is a cross-sectional view of a variation of a cell 18*j* for the present actuators. Cell 18*j* is substantially similar to cell 18 shown in and described with reference to FIG. 1C, with the primary differences described below. In the embodiment shown, cell 18*j* includes a ridged or corrugated portion 50 having ridges 44 of differing heights (e.g., such that height 28 of cell 18*j* varies along the length of the cell) and defined by sidewall 46 portions of differing thicknesses 66, which, in the depicted embodiment, are tallest and thinnest at the left and get progressively shorter and, in some instances, thicker to the right. In this embodiment, taller and/or thinner ridges may allow for greater deflection and a greater area over which fluid pressure can act, thereby altering the mechanical properties of the cell and resulting actuation profile of the cell.

Figure 30B:
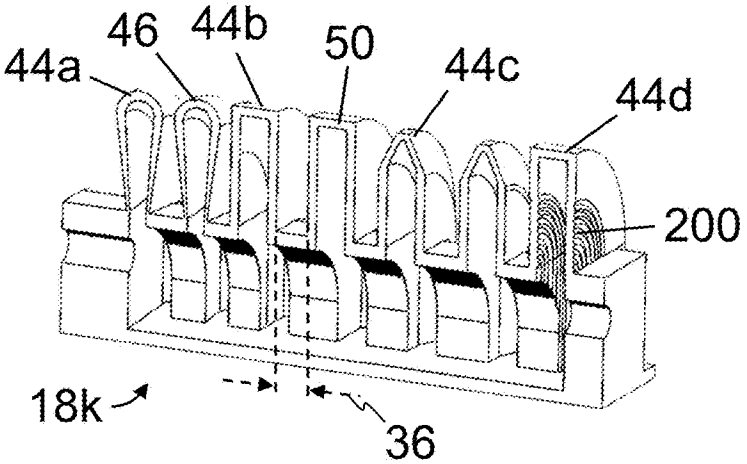
FIGS. 30A and 30B, respectively, are perspective and cross-sectional views of an additional variation of a cell for the present actuators.
Figure 30A:
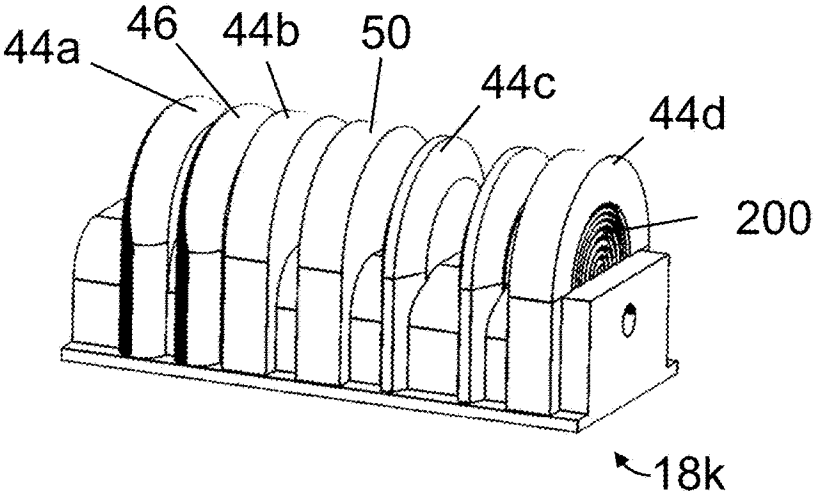
Figure 31B:
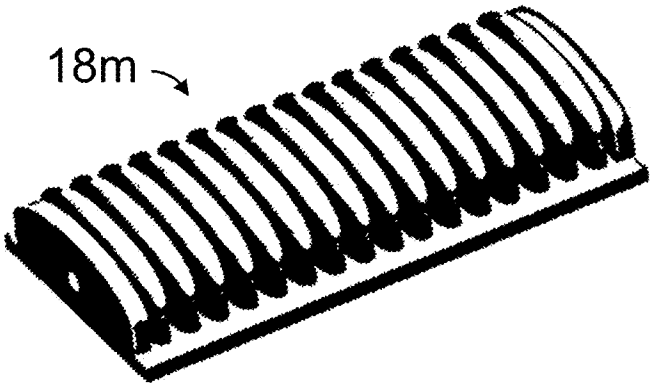
FIGS. 31A-31D are perspective views of additional variations of cells for the present actuators.
Figure 31D:
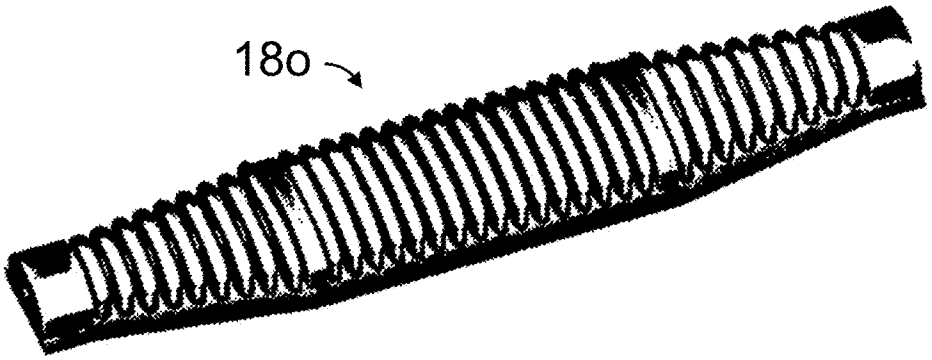
Figure 31A:
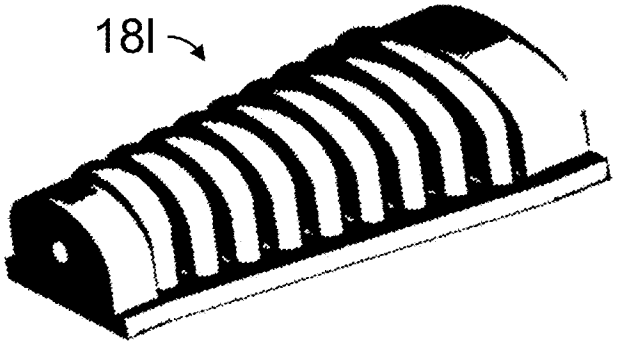
Figure 31C:
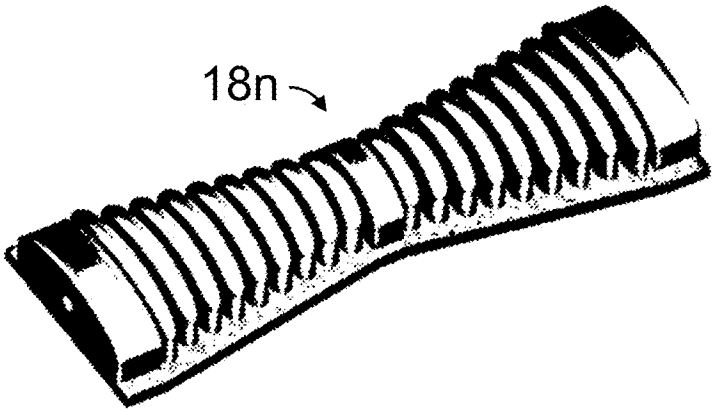

FIGS. 30A and 30B, respectively, are perspective and cross-sectional views of an additional variation of a cell 18*k* for the present actuators. Cell 18*k* is substantially similar to cell 18 shown in and described with reference to FIG. 1C, with the primary differences described below. In the embodiment shown, cell 18*k* includes a ridged or corrugated portion 50 having ridges of different shapes, including rounded ridges 44*a*, rectangular ridges 44*b*, triangular ridges 44*c*, and rectangular ridges 44*d* with corrugated end surfaces 200. As also shown in FIGS. 30A and 30B, a distance 36 between adjacent ridges of corrugated portion 50 can be varied to adjust the curvature or actuation profile of cell 18*k*. For a given cell, by varying ridge shapes or profiles, ridge heights, ridge thicknesses, distances between adjacent ridges, and/or the like, a resulting actuation profile of the cell may be varied.

FIGS. 31A-31D are perspectives view of additional variations of cells 18*l*, 18*m*, 18*n*, and 18*o* for the present actuators. Cells 18*l*, 18*m*, 18*n*, and 18*o* are substantially similar to cell 18 shown in and described with reference to FIG. 1C, with the primary differences described below. In the embodiments shown, cells 18*l*, 18*m*, 18*n*, and 18*o* each includes ridges that are wider than they are tall (e.g., have at least one ridge with a width that is two or more times wider than it is tall). In this embodiment, cells 18*l*, 18*n*, and 18*o* also include ridges that vary in width and height along the length of the respective cells, which may alter the mechanical properties and resulting actuation profiles of the respective cells (e.g., when fluid pressure acts within the respective cells).

Figure 32:
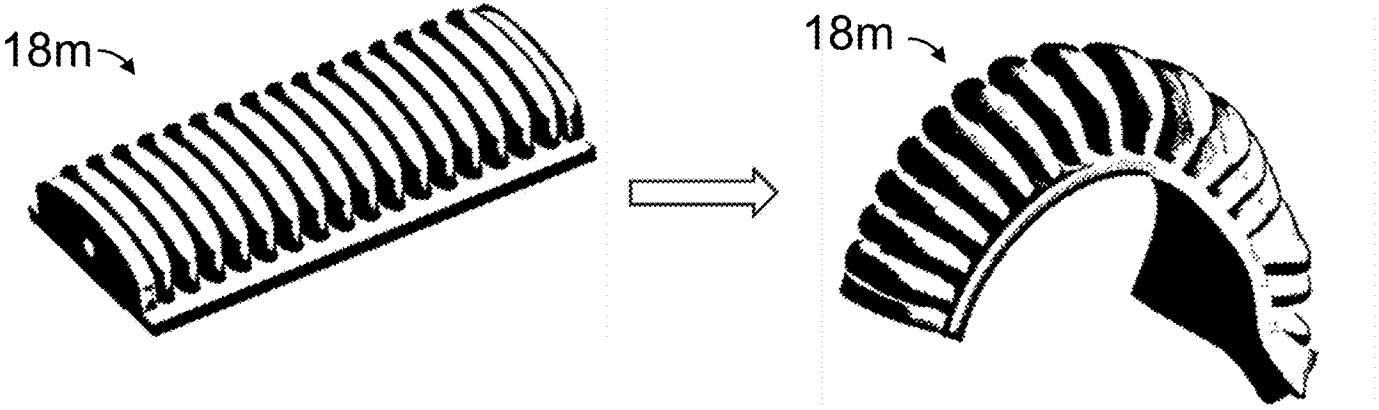
FIG. 32 depicts an exemplary actuation of a cell of the present actuators.
Figure 33:
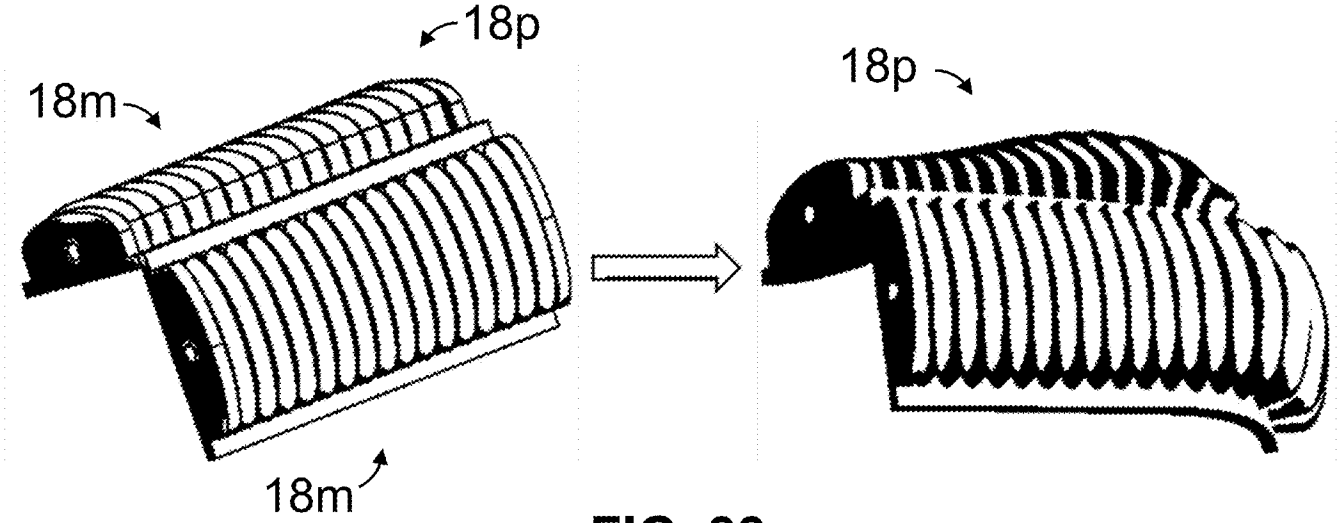
FIG. 33 depicts an exemplary actuation of a further, compound cell for the present actuators.

FIG. 32 depicts an exemplary actuation of cell 18*m* of the present actuators. As shown, cell 18*m* has ridges of constant height and width and products a substantially arcuate shape when actuated. FIG. 33 depicts an exemplary actuation of a further, compound cell 18*p* for the present actuators. In this embodiment, two cells 18*m* are joined (e.g., coupled together or integrally formed with one another) along their edges to form compound cell 18*p*. In this embodiment, the curvature of each cell faces toward the other cell to form a V-shaped open channel that curves along an arc, as shown, when actuated.

The various embodiments of the present actuators can be used for a variety of applications (e.g., different human joints). For example, embodiments of the present actuators in smaller sizes can be configured and used for finger flexion/extension and abduction/adduction. By way of further example, larger sizes of the present actuators can be configured and used for wrist, ankle, and knee joints for flexion/extension. Such embodiments can also help with ankle inversion/eversion and wrist ulnar flexion/radial flexion and, similar in some respects to wrist and ankle joints, one or more of the present actuators can be couple at different locations of the elbow and shoulder joints for elbow flexion/extension, forearm pronation/supination, shoulder adduction/abduction, shoulder horizontal adduction/adduction, and shoulder internal/external rotation.

Figure 34:
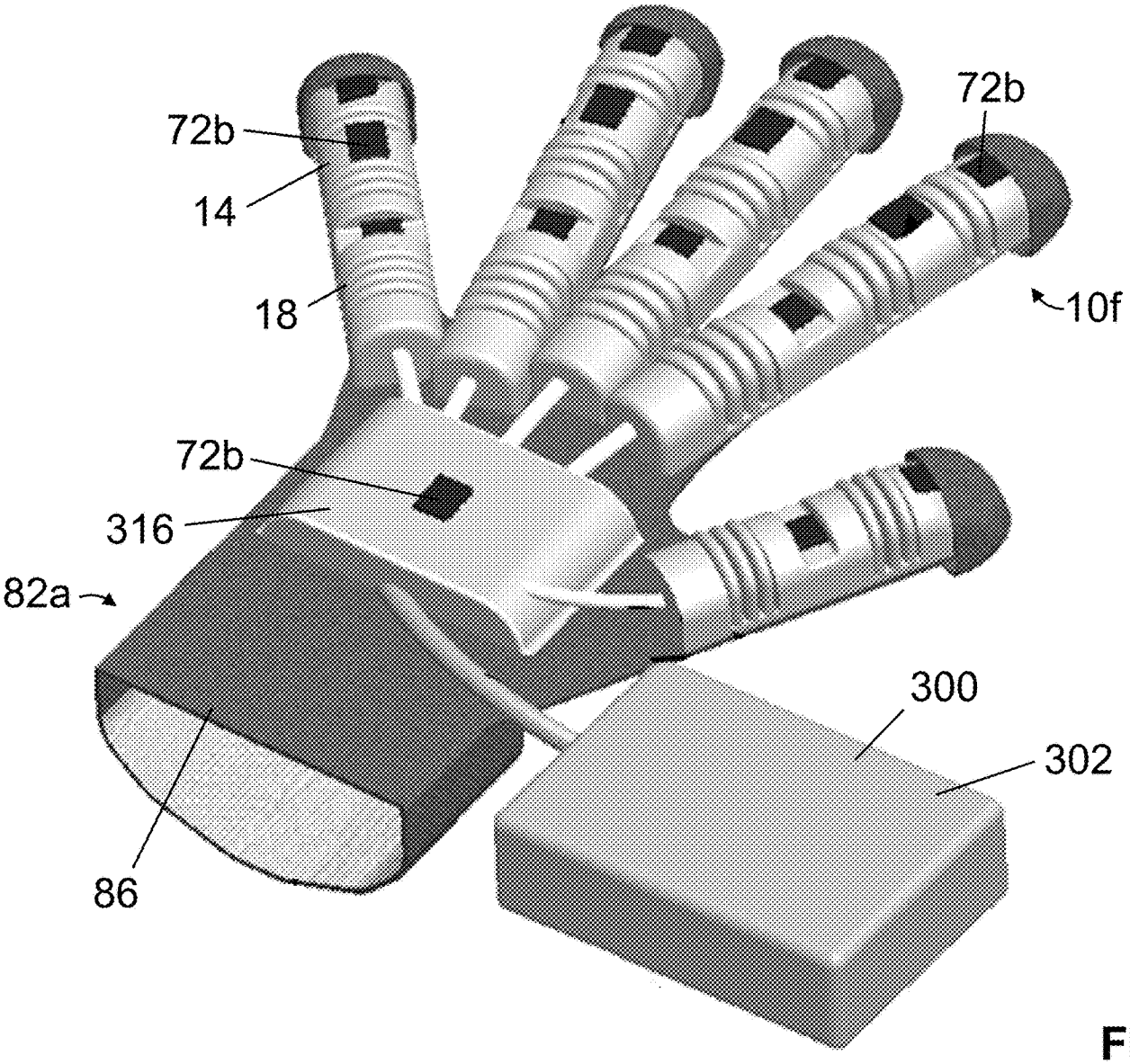
FIG. 34 is a perspective view of a third embodiment of the present manipulating apparatuses.

FIG. 34 is a perspective view of a third embodiment 82*a* of the present manipulating apparatuses. Apparatus 82*a* is substantially similar to apparatus 82 (e.g., is configured to be coupled to a human hand), with the primary differences described below. As shown, apparatus 82*a* comprises a plurality of actuators 10*f* (e.g., one for each of five human fingers of a human hand), each of which may be substantially similar to actuator 10*a*, with the primary differences described below.

In this embodiment, apparatus 82*a* comprises one or more sensors 72*b*, each configured to capture data indicative of an angular displacement and/or velocity, a translational position, velocity, and/or acceleration, and/or the like of a structure to which it is coupled (e.g., sensor(s) 72*b* may comprise inertial sensor(s), such as, for example, inertial measurement unit(s)). For example, in the depicted embodiment, sensor(s) 72*b* may be coupled to (e.g., embedded within) segment(s) 14 of an actuator 10*f* such that the sensor(s) may capture data indicative of a motion of the actuator and/or of the segment(s) and/or cell(s) 18 thereof. In the embodiment shown, sensor(s) 72*b* may be coupled to a portion of apparatus 82*a* other than actuators 10*f* (e.g., such as frame or wearing fixture 86) such that the sensor(s) may capture data indicative of a motion of the apparatus other than a motion of an actuator 10*f* relative to the apparatus. In this way, for example, data captured by sensor(s) 72*b* coupled to actuators 10*f* may be adjusted (e.g., by subtraction of data captured by sensor(s) 72*b* coupled to frame or wearing fixture 86) to remove contributions to the data caused by movement of the frame or wearing fixture. Similarly to as described above for actuator 10*a*, in this embodiment, each actuator 10*f* may (e.g., also) comprise one or more pressure or contact sensors 72*a* configured to capture data indicative of a force applied by its segment(s) 14 to an object (e.g., a user's hand coupled to apparatus 82*a*).

In this embodiment, apparatus 82*a* includes a manifold 316 configured to allow fluid communication between actuators 10*f* and a fluid source (e.g., 26). For example, in the depicted embodiment, manifold 316 may be configured to allow fluid communication between a fluid source (e.g., 26) and one or more of cells 18 of one or more of actuators 10*f*, whether individually (e.g., one of the cells at a time), in sets of two or more of the cells, and/or collectively. By way of further example, in the embodiment shown, apparatus 82*a*, and more particularly, manifold 316, includes one or more valves 324 configured to control fluid communication between actuators 10*f* and a fluid source (e.g., 26), by, for example, selectively blocking fluid passageway(s) of the manifold. For example, in this embodiment, valve(s) 324 may include (e.g., electrically-actuated) solenoid valve(s) configured to selectively allow fluid communication between a fluid source (e.g., 26) and one or more of cells 18 of one or more of actuators 10*f*. By way of further example, in the depicted embodiment, valve(s) 324 may include (e.g., electrically-actuated) proportional valve(s) configured to selectively control a flow rate of fluid communication between a fluid source (e.g., 26) and one or more of cells 18 of one or more of actuators 10*f* (e.g., to provide for control over a rate of flexion and/or extension of the one or more actuators).

Figure 35:
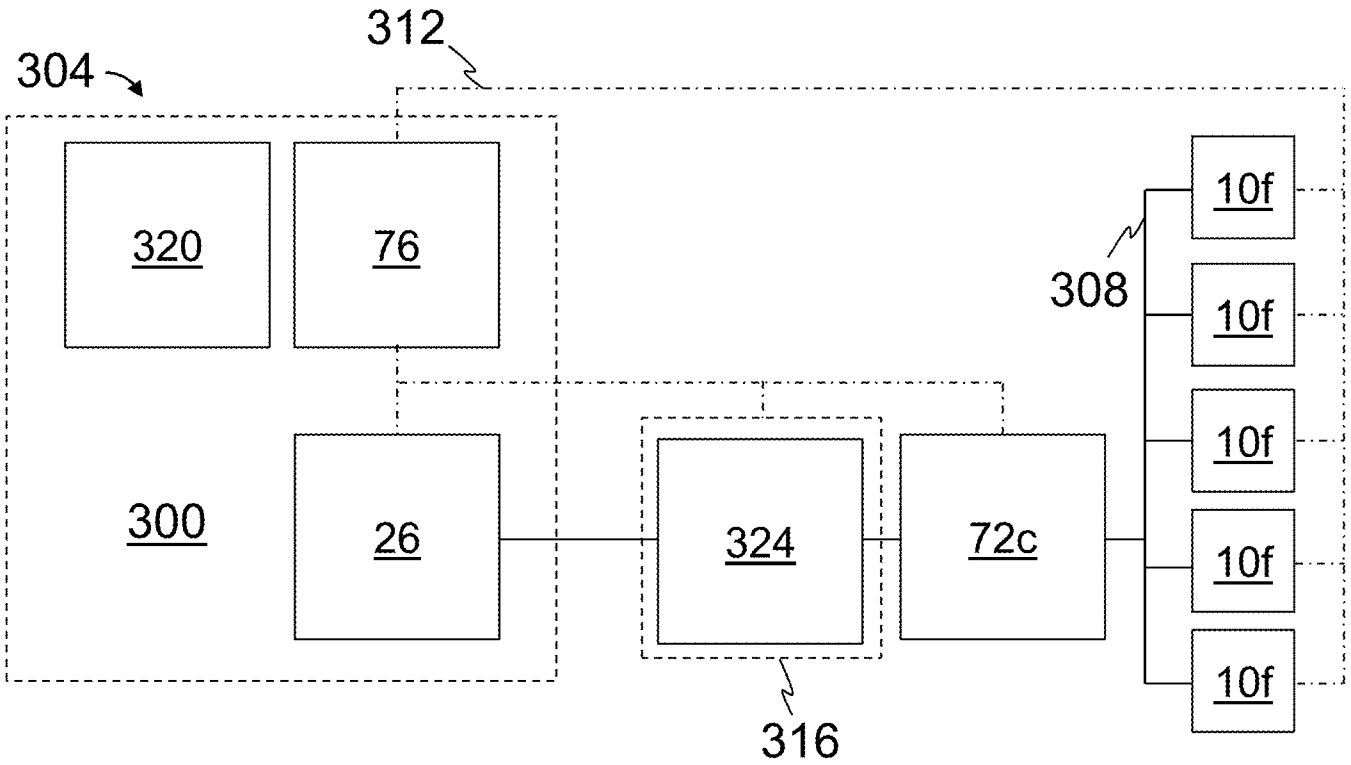
FIG. 35 is conceptual block diagram of a control system, which may be suitable for use with some embodiments of the present actuators and/or manipulating apparatuses.

In the embodiment shown, apparatus 82*a* includes a control unit 300 configured to control actuation (e.g., flexion, extension, and/or the like) of actuators 10*f*, as described in more detail below. In this embodiment, control unit 300 is disposed within a housing 302, and the control unit and housing may be configured (e.g., sized) to be carried by a user of apparatus 82*a* (e.g., worn on a belt, disposed in a clothing pocket, and/or the like). Provided by way of example, and referring additionally to FIG. 35, shown is a conceptual block diagram of a control system 304 (including control unit 300), which may be suitable for use with some embodiments of the present actuators and/or manipulating apparatuses (e.g., 82*a*). In FIG. 35, fluid communication may be indicated by solid lines 308 and electrical communication may be indicated by dash-dot lines 312. As depicted, control unit 300 may include a fluid source 26 and a processor 76, each of which may be the same as or substantially similar to as described above with respect to actuator 10*a*, and may include a communications device 320. In some embodiments, a control unit (e.g., 300) may include a manifold (e.g., 316) and/or one or more valves (e.g., 324).

In the embodiment shown, apparatus 82*a* includes one or more pressure sensors 72*c*, each configured to capture data indicative of an internal pressure within one or more of cells 18 of one or more of actuators 10*f*. For example, in this embodiment, each of sensor(s) 72*c* may be in fluid communication with one or more of cells 18 of one or more of actuators 10*f*, via, for example, being coupled to and in fluid communication with a fluid passageway of manifold 316 and/or a fluid line in fluid communication with the cell(s). In the depicted embodiment, data from sensor(s) 72*c* may be used detect, determine, and/or approximate a torque and/or force acting on respective cell(s) 18 and/or associated segment(s) 14 and/or an associated actuator 10*f* (e.g., exerting a torque or force on an actuator 10*f* may result in a detectable change in an internal pressure of cell(s) 18 of the actuator).

In the embodiment shown, processor 76 may be configured to control actuation actuators 10*f*, via, for example, control of fluid source 26 and/or one or more valves 324. In this embodiment, such control may be based, at least in part, on data captured by one or more sensors, such as, for example, sensor(s) 72*a*, sensor(s) 72*b*, sensor(s) 72*c*, and/or the like. For example, in this embodiment, processor 76 may receive data captured by one or more sensors 72*a* and/or one or more sensors 72*c* indicative of an actual torque or force applied by an actuator 10*f* to a human digit. In the depicted embodiment, if the data captured by sensor(s) 72*a* and/or sensor(s) 72*c* indicates that the actual torque or force applied by the actuator to the digit is at or near (e.g., within 1, 2, 5, 7, 8, or 10 percent of) a maximum allowed torque or force (e.g., which may, for example, be defined by a clinician and/or stored in a memory in communication with the processor), the processor may actuate fluid source 26 and/or one or more valves 324 to prevent the actuator from exceeding the maximum torque or force. For further example, in the embodiment shown, if the data captured by sensor(s) 72*a* and/or sensor(s) 72*c* is indicative of a user-desired movement of the digit (e.g., indicates that the user wishes to flex or extend the digit, which may be based on pre-defined criteria), the processor may actuate fluid source 26 and/or one or more valves 324 to assist the user in performing the desired movement, and, in some instances, within an acceptable (e.g., pre-defined) range of motion for the digit or joints thereof and/or pursuant to an acceptable (e.g., pre-defined) path for the digit or joints thereof, which may be facilitated by feedback from one or more sensors 72*a*.

For yet further example, in this embodiment, processor 76 may receive data captured by one or more sensors 72*b* indicative of a flexion or extension of an actuator 10*f*. In the depicted embodiment, if the data captured by sensor(s) 72*b* indicates that the flexion or extension of the actuator is at or near (e.g., within 1, 2, 5, 7, 8, or 10 percent of) a maximum allowed flexion or extension (e.g., which may be defined and/or stored as described above), the processor may actuate fluid source 26 and/or one or more valves 324 to prevent the actuator from exceeding the maximum flexion or extension.

In these ways and others, apparatus 82*a* may be configured to achieve a wide range of desirable functionality. For example, apparatus 82*a* may be used in a rehabilitative setting to: (1) set a torque or force to be applied by an actuator 10*f* to resist movement of a human digit or joint thereof (e.g., during active resistive motion treatment, to immobilize the digit or joint, and/or the like); (2) prevent hyperextension and/or hyperflexion of a human digit or joint thereof (e.g., during CPM treatment); (3) assist a user in performing desired movements of a human digit or joint thereof (e.g., as described above); and/or the like. However, the present actuators and/or manipulating apparatuses (e.g., 82*a*) are not limited to solely the rehabilitative field.

For example, some embodiments of the present actuators and/or manipulating apparatuses (e.g., 82*a*) may be suited for use as haptic input and/or output devices in, for example, the computing, virtual reality, telerobotics, gaming, and/or the like field. To illustrate, in some embodiments, forces exerted by an actuator (e.g., 10*f*) on a human digit may comprise a haptic output (e.g., to simulate interacting with a virtual object, such as touching or grasping the virtual object, provide other information to the user, and/or the like) and/or forces exerted by the digit on the actuator may comprise haptic input (e.g., indicative of a user selection, command, and/or the like, a desired movement of an object in a virtual environment, other input, and/or the like). For example, some embodiments of the present actuators and/or manipulating apparatuses (e.g., 82*a*) may include a haptics processor (e.g., 76) configured to receive data captured by sensor(s) (e.g., sensor(s) 72(*a*), sensor(s) 72*b*, sensor(s) 72*c*, and/or the like) and identify one or more processor-executable commands associated with data captured by the sensor(s). Such processor-executable command(s) may include any suitable command, such as, for example, open or close an application, execute or cease executing a function or method, create, select, delete, modify, and/or otherwise interact with an object, manipulate a pointer or cursor, and/or the like. Such processor-executable command(s) may be identified in any suitable fashion, such as, for example, via comparing or searching data captured by the sensor(s) with or for threshold(s) and/or trend(s) that may be pre-associated with the command(s). To illustrate, data indicative of a user exerting a force on apparatus 82*a* and/or actuator(s) 10*f* thereof that is above or below a pre-determined threshold and/or that is sustained for a pre-determined period of time may be associated with a command, data indicative of a user moving the apparatus and/or actuator(s) by a pre-determined displacement and/or at a pre-determined rate may be associated with a command, data indicative of a user moving the apparatus and/or actuator(s) along or proximate a pre-determined path may be associated with a command, data indicative of a lack of user interaction with the apparatus and/or actuator(s) for a pre-determined period of time may be associated with a command, and/or the like. In some embodiments, a haptics processor (e.g., 76) may be configured to execute at least one of the command(s) and/or to transmit at least one of the command(s) to a processor (e.g., a processor external to apparatus 82*a*).

Figure 36:
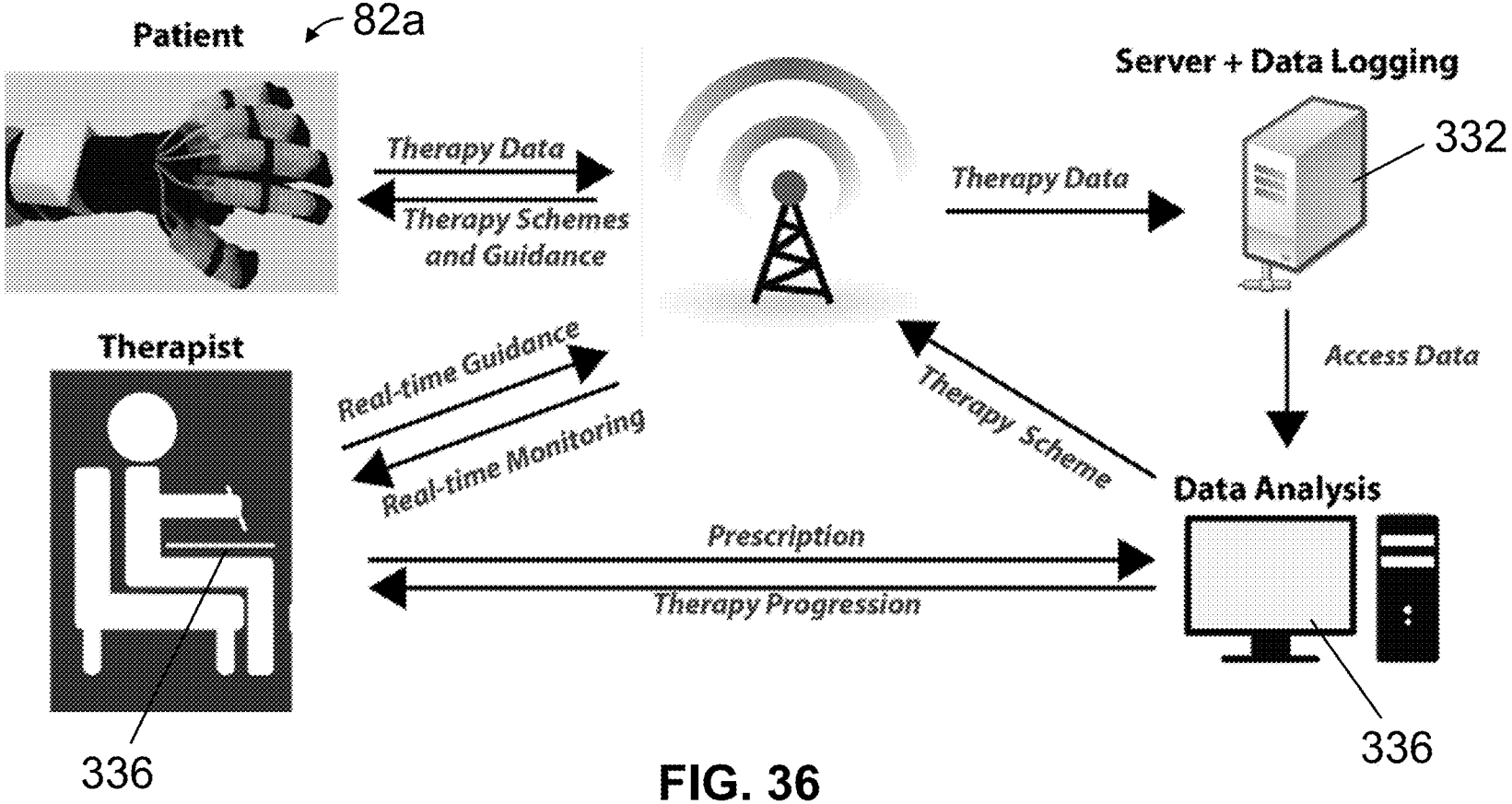
FIG. 36 is a conceptual block diagram of system in which embodiments of the present actuators and/or manipulating apparatuses can be used.

In the embodiment shown, apparatus 82*a* comprises a communications device 320 configured to allow communication to and/or from the apparatus and other devices. For example, and referring additionally to FIG. 36, shown is a conceptual block diagram of a system 328 in which embodiments of the present actuators and/or manipulating apparatuses (e.g., 82*a*) can be used. As shown, in this embodiment, communications device 320 may be configured to communicate with server(s) 332 (e.g., for data storage, software updates, and/or the like), processor(s) 336 external to apparatus 82*a* (e.g., for analysis of data received from the apparatus and/or from server(s) 332 and/or monitoring, running user interfaces for, issuing commands to, and/or programming the apparatus, and/or the like), and/or the like. In the depicted embodiment, communications device 320 comprises a wireless communications device and may be configured to communicate using any suitable communications protocol, such as, for example, Wi-Fi, Bluetooth, radio, cellular, and/or the like; however, in other embodiments, a communications device (e.g., 320) may be configured to communicate over a wired interface.

For example, in the embodiment shown, communications device 320 may transmit to server(s) 332, processor(s) 336 external to apparatus 82*a*, and/or the like data captured by sensor(s) 72*a*, sensor(s) 72*b*, sensor(s) 72*c*, and/or the like (e.g., whether raw or processed, for example, by processor 76) and/or the like. For further example, in this embodiment, communications device 320 may receive data, software, programming, command(s), and/or the like (e.g., a targeted and/or maximum allowed force and/or torque to be applied to a human digit or joint thereof by an actuator 10*f*, a maximum allowed flexion or extension of the actuator, a desired path of movement for the digit or joint, and/or the like), from server(s) 332, processor(s) 336 external to apparatus 82*a*, and/or the like. In these ways and others, apparatus 82*a* may, for example, provide for remote monitoring and/or control of the apparatus (e.g., by a clinician), thereby enhancing patient care.

In some embodiments, the present systems (e.g., 328) may comprise control and/or monitoring software, which may be executed on processor(s) (e.g., 336) external to an apparatus (e.g., 82*a*), such as, for example, on a desktop computer, laptop computer, tablet, other mobile device, and/or the like. In some embodiments, such control and/or monitoring software may facilitate a clinician in receiving data from an apparatus (e.g., 82*a*) and/or server(s) (e.g., 332), transmitting data, software, programming, command(s), and/or the like to the apparatus, and/or the like. In some embodiments, such control and/or monitoring software may include a graphical user interface configured to provide quantitative and/or qualitative feedback on the status of an apparatus (e.g., 82*a*) and/or of a patient using the apparatus. For example, in some embodiments, such a graphical user interface may, based at least in part on data captured by sensor(s) (e.g., 72*a*, 72*b*, 72*c*, and/or the like), provide a visual depiction or animation of historical, current, or projected future position(s) of an apparatus (e.g., 82*a*) and/or actuators (e.g., 10*f*) thereof.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

REFERENCES

These references, to the extent that they provide exemplary procedural or other details supplementary to those set forth herein, are specifically incorporated herein by reference.

[1] P. Aubin, K. Petersen, H. Sallum, J. W. Conor, A. Correia and L. Stirling. A pediatric robotic thumb exoskeleton for at-home rehabilitation: The isolated orthosis for thumb actuation (IOTA). International Journal of Intelligent Computing and Cybernetics 7(3), 2014.

[2] S. Balasubramanian, J. Klein and E. Burdet. Robot-assisted rehabilitation of hand function. Curr. Opin. Neurol. 23(6), 2010. Available: http://journals.1ww.com/co-neurology/Fulltext/2010/12000/ Robot_assisted_rehabilitation_of_hand_function.19.aspx.

[3] B. Birch, E. Haslam, I. Heerah, N. Dechev and E. J. Park. Design of a continuous passive and active motion device for hand rehabilitation. Presented at Engineering in Medicine and Biology Society, 2008. EMBS 2008. 30th Annual International Conference of the IEEE. 2008, DOI: 10.1109/IEMBS.2008.4650162.

[4] N. S. K. Ho, K. Y. Tong, X. L. Hu, K. L. Fung, X. J. Wei, W. Rong and E. A. Susanto. An EMG-driven exoskeleton hand robotic training device on chronic stroke subjects: Task training system for stroke rehabilitation. Presented at Rehabilitation Robotics (ICORR), 2011 IEEE International Conference On. 2011, DOI: 10.1109/ ICORR.2011.5975340.

[5] H. Kawasaki, S. Ito, Y. Ishigure, Y. Nishimoto, T. Aoki, T. Mouri, H. Sakaeda and M. Abe. Development of a hand motion assist robot for rehabilitation therapy by patient self-motion control. Presented at Rehabilitation Robotics, 2007. ICORR 2007. IEEE 10$^{th}$ International Conference On. 2007, DOI: 10.1109/ICORR.2007.4428432.

[6] R. C. V. Loureiro and W. S. Harwin. Reach & grasp therapy: Design and control of a 9-DOF robotic neuro-rehabilitation system. Presented at Rehabilitation Robotics, 2007. ICORR 2007. IEEE 10th International Conference On. 2007, DOI: 10.1109/ICORR.2007.4428510.

[7] P. S. Lum, S. B. Godfrey, E. B. Brokaw, R. J. Holley and D. Nichols. Robotic approaches for rehabilitation of hand function after stroke. American Journal of Physical Medicine & Rehabilitation 91(11), 2012. Available: http:// dx.doi.org/10.1097/PHM.0b013e31826bcedb. DOI: 10.1097/PHM.0b013 e31826bcedb.

[8] Pilwon Heo and Jung Kim. Power-assistive finger exoskeleton with a palmar opening at the fingerpad. Biomedical Engineering, IEEE Transactions On 61(11), pp. 2688-2697. 2014. DOI: 10.1109/TBME.2014.2325948.

[9] C. Schabowsky, S. Godfrey, R. Holley and P. Lum. Development and pilot testing of HEXORR: Hand EXOskeleton rehabilitation robot. Journal of NeuroEngineering and Rehabilitation 7(1), pp. 36. 2010. Available: http://www.jneuroengrehab.com/content/7/1/36.

[10] S. Ueki, Y. Nishimoto, M. Abe, H. Kawasaki, S. Ito, Y. Ishigure, J. Mizumoto and T. Ojika. Development of virtual reality exercise of hand motion assist robot for rehabilitation therapy by patient self-motion control. Presented at Engineering in Medicine and Biology Society, 2008. EMBS 2008. 30th Annual International Conference of the IEEE. 2008, DOI: 10.11009/ IEMBS.2008.4650156.

[11] A. Wege, K. Kondak and G. Hommel. "Development and control of a hand exoskeleton for rehabilitation" Human Interaction with Machines, G. Hommel and S. Huanye, Eds. 2006, 149-157, DOI: 10.1007/1-4020-4043-1_16.

[12] L. Connelly, Yicheng Jia, M. L. Toro, M. E. Stoykov, R. V. Kenyon and D. G. Kamper. A pneumatic glove and immersive virtual reality environment for hand rehabilitative training after stroke. Neural Systems and Rehabilitation Engineering, IEEE Transactions On 18(5), pp. 551-559. 2010. DOI: 10.1109/TNSRE.2010.2047588.

[13] P. Polygerinos, S. Lyne, Zheng Wang, L. F. Nicolini, B. Mosadegh, G. M. Whitesides and C. J. Walsh. Towards a soft pneumatic glove for hand rehabilitation. Presented at Intelligent Robots and Systems (IROS), 2013 IEEE/RSJ International Conference On. 2013, DOI: 10.1109/ IROS.2013.6696549.

[14] P. Polygerinos, Z. Wang, K. C. Galloway, R. J. Wood and C. J. Walsh. Soft robotic glove for combined assistance and at-home rehabilitation. Robotics and Autonomous Systems (0), Available: http://dx.doi.org/10.1016/ j.robot.2014.08.014.

[15] Haghshenas-Jaryani M, Carrigan W, Wijesundara M B J: Design and Development of a Novel Soft-and-Rigid Actuator System for Robotic Applications, Paper No 47761, Proceedings of the ASME 2015 International Design Engineering Technical Conferences & Computers and Information in Engineering Conference IDETC/ CIE2015 Aug. 2-5, 2015, Boston, Mass., USA [16] H. Kawasaki, S. Ito, Y. Ishigure, Y. Nishimoto, T. Aoki, T. Mouri, H. Sakaeda and M. Abe, "Development of a Hand Motion Assist Robot for Rehabilitation Therapy by Patient Self-Motion Control," Rehabilitation Robotics, 2007. ICORR 2007. IEEE 10th International Conference on, pp. 234-240.

[17] M. C. Hume, H. Gellman, H. McKellop and R. H. Brumfield Jr., "Functional range of motion of the joints of the hand," J. Hand Surg., vol. 15, no. 2, March pp. 240-243.

[18] Kadowaki, Y, Noritsugu, T, Takaiwa, M, Sasaki, D., Kato, M, "Development of Soft Power-Assist Glove and Control Based on Human Intent," Journal of Robotics and Mechatronics, vol. 23, no. 2, pp. 281-291.

[19] S. Ueki, H. Kawasaki, S. Ito, Y. Nishimoto, M. Abe, T. Aoki, Y. Ishigure, T. Ojika and T. Mouri, "Development of a Hand-Assist Robot With Multi-Degrees-of-Freedom for Rehabilitation Therapy," Mechatronics, IEEE/ASME Transactions on, vol. 17, no. 1, pp. 136-146.

The invention claimed is:

1. A manipulating apparatus comprising:

an actuator comprising:

a haptic processor;

a semi-rigid first segment;

a semi-rigid second segment; and\one or more flexible cells disposed between the first segment and the second segment, each cell having a first end and a second end;

one or more sensors configured to detect one or more physical characteristics, where at least one of the one or more sensors comprise a pressure sensor coupled to one of the segments and configured to capture data indicative of a force applied between the one of the segments and an object coupled to the one of the segments;

where the actuator is configured to be coupled to a fluid source such that the fluid source can communicate fluid to vary internal pressures of the one or more cells;

where each cell is configured such that adjustments of an internal pressure of the cell rotates the first end relative to the second end to angularly displace the second segment relative to the first segment; and where the haptic processor is configured to receive the data indicative of the force applied between the one of the segments and the object and to communicate with the actuator to ensure that the force applied between the one of the segments and the object does not exceed a threshold.

2. The apparatus of claim 1, where the actuator further comprises: a semi-rigid third segment; and where the one or more flexible cells of the actuator comprise:

a first flexible cell disposed between the first segment and the second segment; and a second flexible cell disposed between the first segment and the third segment; where the first cell is configured such that adjustments of an internal pressure of the first cell angularly displaces the second segment relative to the first segment about a first axis; and where the second cell is configured such that adjustments of an internal pressure of the second cell angularly displaces the third segment relative to the first segment about a second axis that is non-parallel to the first axis.

3. The manipulating apparatus of claim 2, where the second axis is substantially perpendicular to the first axis.

4. The apparatus of claim 1, comprising a fluid source configured to be coupled to the actuator and to vary internal pressures of the cell(s).

5. The apparatus of claim 1, where the actuator is configured such that an internal pressure in at least one of the cells can be varied independently of an internal pressure in another one of the cells.

6. The apparatus of claim 1, where at least one of the segments is removably coupled to at least one of the cell(s).

7. The apparatus of claim 1, where at least one of the cell(s) is at least partially defined by a sidewall having a corrugated portion.

8. The apparatus of claim 1, where at least one of the cell(s) is at least partially defined by a sidewall having an elastic portion.

9. The apparatus of claim 1, where, when the first and second segments are substantially aligned with one another, the cell(s) disposed between the first and second segments extend a total length along an axis of the actuator that extends through the first and second segments that is from 10% to 90% of a length of the actuator along the axis.

10. The apparatus of claim 1, where the actuator is configured to be coupled across a joint of a human body part.

11. The apparatus of claim 10, comprising one or more straps configured to couple the actuator across the joint of the human body part.

12. The apparatus of claim 1, where at least one of the one or more sensors comprises a pressure sensor in fluid communication with the interior of at least one of the cell(s) and configured to capture data indicative of an internal pressure of the at least one cell.

13. The apparatus of claim 1, where at least one of the one or more sensors comprises at least one of a position, velocity, and acceleration sensor configured to capture data indicative of movement of the second segment relative to the first segment.

14. The apparatus of claim 1, wherein the haptics processor is further configured to:

receive data captured by at least one of the one or more sensors; and identify one or more processor-executable commands associated with data captured by the at least one sensor.

15. An apparatus comprising: a plurality of actuators, each comprising:

a haptic processor;

a semi-rigid first segment;

a semi-rigid second segment; and one or more flexible cells disposed between the first segment and the second segment, each cell having a first end and a second end;

where the actuator is configured to be coupled to a fluid source such that the fluid source can communicate fluid to vary internal pressures of the one or more cells; and where each cell is configured such that adjustments of an internal pressure of the cell rotates the first end relative to the second end to angularly displace the second segment relative to the first segment; and one or more sensors configured to detect one or more physical characteristics, where at least one of the one or more sensors comprise a pressure sensor coupled to one of the segments and configured to capture data indicative of a force applied between the one of the segments and an object coupled to the one of the segments;

a frame or wearing fixture;

where each of the plurality of actuators is coupled to the frame or wearing fixture; and where the haptic processor is configured to receive the data indicative of the force applied between the one of the segments and the object and to communicate with the actuator to ensure that the force applied between the one of the segments and the object does not exceed a threshold.

16. The apparatus of claim 15, where the apparatus is configured to be coupled to a human hand such that each of the plurality of actuators is coupled to a human finger of the human hand.

17. The apparatus of claim 15, where at least one of the one or more sensors comprises a pressure sensor in fluid communication with the interior of at least one of the cell(s) and configured to capture data indicative of an internal pressure of the at least one cell.

18. The apparatus of claim 15, where at least one of the one or more sensors comprises at least one of a position, velocity, and acceleration sensor configured to capture data indicative of movement of the second segment relative to the first segment.

19. The apparatus of claim 15, wherein the haptics processor is further configured to: receive data captured by at least one of the one or more sensors; and identify one or more processor-executable commands associated with data captured by the at least one sensor.

* * * * *